US010195475B2

(12) United States Patent
Schreiber et al.

(10) Patent No.: US 10,195,475 B2
(45) Date of Patent: Feb. 5, 2019

(54) RESISTANCE TRAINING SYSTEM

(71) Applicant: Functionwear, LLC, Boulder, CO (US)

(72) Inventors: Daniel Schreiber, Boulder, CO (US); Christopher T. Cranke, Upper Marlboro, MD (US)

(73) Assignee: Functionwear, LLC, Boulder, CO (US)

( * ) Notice: Subject to any disclaimer, the term of this patent is extended or adjusted under 35 U.S.C. 154(b) by 0 days.

(21) Appl. No.: 15/234,861

(22) Filed: Aug. 11, 2016

(65) Prior Publication Data

US 2017/0028244 A1 Feb. 2, 2017

Related U.S. Application Data

(63) Continuation-in-part of application No. 14/862,817, filed on Sep. 23, 2015, which is a continuation-in-part
(Continued)

(51) Int. Cl.
*A63B 21/00* (2006.01)
*A63B 21/02* (2006.01)
(Continued)

(52) U.S. Cl.
CPC ..... *A63B 21/0557* (2013.01); *A41F 9/00* (2013.01); *A43B 5/00* (2013.01);
(Continued)

(58) Field of Classification Search
CPC ..... A63B 21/0552
See application file for complete search history.

(56) References Cited

U.S. PATENT DOCUMENTS 843,478 A 2/1907 Muller
1,269,518 A 6/1918 Bain
(Continued)

FOREIGN PATENT DOCUMENTS

| | | |
|---|---|---|
| CA | 2393413 | 2/2004 |
| GB | 245274 | 1/1925 |
| KR | 101011469 | 1/2011 |

OTHER PUBLICATIONS

International Search Report received in corresponding PCT/US13/39703 dated Aug. 30, 2013.
(Continued)

*Primary Examiner* — Loan H Thanh
*Assistant Examiner* — Rae Fischer
(74) *Attorney, Agent, or Firm* — Maginot, Moore & Beck, LLP

(57) ABSTRACT

A physical training system configured to be worn on a human body includes an article of footwear configured to receive a foot. A medial connection member is disposed on the medial side of the article of footwear and a lateral connection member is disposed on the lateral side of the article of footwear opposite the first connection member. The dorsal side of the article of footwear extends between the medial connection member and the lateral connection member. The physical training system further includes a torso member configured to engage the torso of the wearer. At least one elastic resistance band extends between the lateral connection member and the torso member and between the medial connection member and the torso member.

19 Claims, 45 Drawing Sheets

Related U.S. Application Data of application No. 14/533,190, filed on Nov. 5, 2014, now Pat. No. 9,586,082, which is a continuation of application No. 13/887,925, filed on May 6, 2013, now Pat. No. 8,915,827, which is a continuation-in-part of application No. 13/464,853, filed on May 4, 2012, now Pat. No. 8,968,166.

(60) Provisional application No. 61/778,726, filed on Mar. 13, 2013, provisional application No. 62/054,128, filed on Sep. 23, 2014, provisional application No. 62/096,134, filed on Dec. 23, 2014, provisional application No. 62/205,291, filed on Aug. 14, 2015.

(51) Int. Cl.

| | |
|---|---|
| ***A63B 21/055*** | (2006.01) |
| ***A63B 23/035*** | (2006.01) |
| ***A43B 5/00*** | (2006.01) |
| ***A41F 9/00*** | (2006.01) |
| *A63B 69/00* | (2006.01) |
| *A63B 21/04* | (2006.01) |
| *A63B 21/16* | (2006.01) |

(52) U.S. Cl.

CPC .. *A63B 21/00061* (2013.01); *A63B 21/00065* (2013.01); *A63B 21/0552* (2013.01); *A63B 21/4007* (2015.10); *A63B 21/4009* (2015.10); *A63B 21/4015* (2015.10); *A63B 21/4019* (2015.10); *A63B 21/4025* (2015.10); *A63B 21/4043* (2015.10); *A63B 23/03541* (2013.01); *A63B 23/03575* (2013.01); *A63B 21/0442* (2013.01); *A63B 21/169* (2015.10); *A63B 21/4005* (2015.10); *A63B 21/4013* (2015.10); *A63B 21/4021* (2015.10); *A63B 69/0022* (2013.01); *A63B 69/0028* (2013.01); *A63B 2209/02* (2013.01); *A63B 2209/10* (2013.01); *A63B 2225/096* (2013.01)

(56) References Cited

U.S. PATENT DOCUMENTS

| | | | | |
|---|---|---|---|---|
| 1,562,294 | A | | 11/1925 | Cooper |
| 1,618,273 | A | | 2/1927 | Davidson |
| 2,097,376 | A | | 10/1937 | Marshman |
| 3,162,441 | A | | 12/1964 | Karik |
| 3,999,752 | A | | 12/1976 | Kupperman et al. |
| 4,273,328 | A | | 6/1981 | Ozbey et al. |
| 4,596,387 | A | | 6/1986 | Roberts |
| 4,728,103 | A | | 3/1988 | Fulton |
| 4,815,729 | A | | 3/1989 | Stefanski |
| 4,815,731 | A | | 3/1989 | Suarez et al. |
| 4,993,705 | A | | 2/1991 | Tolle |
| 5,186,701 | A | | 2/1993 | Wilkinson |
| 5,203,754 | A | * | 4/1993 | Maclean ..... A63B 21/0004 482/121 |
| 5,263,916 | A | | 11/1993 | Bobich |
| 5,433,688 | A | | 7/1995 | Davies |
| 5,490,826 | A | | 2/1996 | Rose |
| 5,518,480 | A | | 5/1996 | Frappier |
| 5,545,113 | A | | 8/1996 | Bobich |
| 5,653,668 | A | | 8/1997 | Wilkinson |
| 5,683,336 | A | | 11/1997 | Pape |
| 5,716,307 | A | | 2/1998 | Vadher |
| 5,720,042 | A | | 2/1998 | Wilkinson |
| 5,727,254 | A | | 3/1998 | Dicker |
| 5,782,727 | A | | 7/1998 | Pierce |
| 5,792,034 | A | | 8/1998 | Kozlovsky |
| 5,800,319 | A | | 9/1998 | Choate |
| 5,820,534 | A | | 10/1998 | Vadher |
| 5,867,826 | A | | 2/1999 | Wilkinson |
| 5,993,362 | A | | 11/1999 | Ghobadi |
| 6,099,446 | A | | 8/2000 | Johnson et al. |
| 6,361,516 | B1 | | 3/2002 | Hamel |
| 6,551,221 | B1 | | 4/2003 | Marco |
| 6,962,555 | B2 | | 11/2005 | Behman |
| 7,004,892 | B2 | | 2/2006 | Marco |
| 7,087,003 | B1 | | 8/2006 | Katterjohn |
| 7,261,679 | B2 | | 8/2007 | Sload |
| 7,608,026 | B1 | | 10/2009 | Nicassio |
| 7,618,356 | B1 | | 11/2009 | Johnson et al. |
| 7,628,742 | B2 | | 12/2009 | Weaver |
| 7,744,511 | B2 | | 6/2010 | Grigoriev et al. |
| 7,794,368 | B2 | | 9/2010 | Rutherford |
| 7,850,583 | B2 | | 12/2010 | Smith |
| 8,142,336 | B1 | | 3/2012 | Yates |
| 8,337,371 | B2 | | 12/2012 | Vollmer, Jr. |
| 2002/0066208 | A1 | | 6/2002 | Hall |
| 2002/0068667 | A1 | | 6/2002 | Strachan |
| 2004/0204302 | A1 | | 10/2004 | Flynn |
| 2005/0043150 | A1 | | 2/2005 | Nitta et al. |
| 2005/0261113 | A1 | | 11/2005 | Wilkinson |
| 2006/0040805 | A1 | | 2/2006 | Wilkinson |
| 2006/0183609 | A1 | | 8/2006 | Flynn |
| 2007/0060454 | A1 | | 3/2007 | Vogel |
| 2008/0287840 | A1 | | 11/2008 | Koscielny et al. |
| 2009/0217550 | A1 | | 9/2009 | Koo |
| 2011/0209264 | A1 | | 9/2011 | Williams et al. |
| 2013/0045842 | A1 | | 2/2013 | Wood |
| 2013/0067767 | A1 | | 3/2013 | Casto |

OTHER PUBLICATIONS

European Search Report in corresponding EP13785085 dated Apr. 19, 2016.

* cited by examiner

RESISTANCE TRAINING SYSTEM

CROSS-REFERENCE TO RELATED APPLICATIONS

This application is a continuation-in-part of U.S. patent application Ser. No. 14/862,817, filed Sep. 23, 2015, which is a continuation-in-part of U.S. patent application Ser. No. 14/533,190, filed Nov. 5, 2014, which is a continuation of U.S. patent application Ser. No. 13/887,925, filed May 6, 2013 (now U.S. Pat. No. 8,915,827), which is a continuation-in-part of U.S. patent application Ser. No. 13/464,853, filed May 4, 2012 (now U.S. Pat. No. 8,968,166), and also claims priority from U.S. provisional patent application Ser. No. 61/778,726, filed Mar. 13, 2013, U.S. provisional patent application Ser. No. 62/054,128, filed Sep. 23, 2014, U.S. provisional patent application Ser. No. 62/096,134, filed Dec. 23, 2014, and U.S. provisional patent application Ser. No. 62/205,291, filed Aug. 14, 2015. The entire disclosures in the foregoing applications are incorporated herein by reference.

FIELD

The disclosure herein relates to the field of exercise equipment and, more particularly, to a total body sports performance enhancement system that allows the user to build strength at a faster rate through resistance training. The disclosure herein further pertains to improved footwear and belt configurations for use in such systems.

BACKGROUND

Sports performance enhancement systems can improve endurance, precision, strength and efficiency, as well as several other key athletic and fitness attributes. Being an athlete and/or staying in shape requires considerable time and effort. Athletes must train their entire bodies in order to achieve total body fitness, which is a prerequisite in order to excel as a top tier athlete and to obtain an optimal body condition. The rewards of such an achievement are immense, yet the journey towards these pinnacles requires a great deal of time consuming dedication and exertion. The problem is that, normally, the aspiring athlete and/or fitness enthusiast would have to work out a vast array of different body parts, such as the upper and lower body, limbs hands, feet, etc. Then, he or she must maintain his/her cardio fitness by running and or jogging. Then, in the case of the athletes, they must practice movements in their particular sports to improve and sharpen the skill sets required for those sports. Therefore, there is a need for a versatile total body exercise system that can save time yet not compromise on the rigorous training that serious competitors and fitness enthusiasts need to reach their goals while effectively activating multiple muscles simultaneously.

Most devices and systems that attempt to create a total body workout system fall short because they either do not cover the entire spectrum of an effective complete body workout, or are ineffective due to poor design, or are either unsafe or uncomfortable to use. In other words, there is no safe and effective full body workout system that encompasses the foundation of free weight resistance. The two free weight exercises that represent the most strength or power are bench presses and leg presses (or leg squats). Each represents or addresses upper and lower body strength. Other exercises that represent the next best strength enhancement in free weights are arm and leg curls, as well as arm and leg extensions. These exercises are often thought of as the cornerstone of free weight exercise. For years, these strength enhancements have provided adequate strength and performance enhancement exercise for millions of people. However, the problem remains that these strength enhancement exercises are very time consuming, and most devices that attempt to provide the full body workout are usually stationary exercises machines.

The exercises mentioned above provide good workouts because the focus of resistance force is underneath the finger tips and inside the palm of the hand (in the case of upper-body workouts), or near the ankles (in the case of lower-body workouts). These upper and lower body exercise actions are revolutionary because they incorporate two parts of the human body that make humans unique compared to any other species. The first part is the soles of the feet, which allow humans to walk upright. The second part is the fingers and palms of the hands that allow humans to build and create objects with their hands. One of the best ways to improve the human body from the athlete's standpoint is to stay true to these focus areas while exercising. It is also to be noted that the inside of the hand and the bottom of the feet, particularly the balls of the feet, are the main points of focus for resistance force. Most athletes are limited to performing one workout regimen in intervals, thus consuming a lot of time and also incorporating multiple body parts, but losing the core points of focus in doing so. Since each workout is individually performed, each workout requires a specific amount of time. To become a great athlete is one of the most challenging tasks to accomplish. Top athletes perform many full body workouts for many years at an aggressive level.

Resistance band training is an excellent alternative exercise tool that is not as stationary as other techniques and provides an effective workout with more creative capabilities. Early prior art resistance band workout equipment, including products incorporating bows or twisting functions, or products adapted to hang from a door, share a common oversight. In particular, these products require use of the hands of the athlete, resulting in restricted use of the equipment. That is, these products are intended to provide resistance by use of some sort of handle, but these products have limited usage for aspiring athletes due to the confined parameters in which they were designed.

Different athletes require different skill sets. For example, in the game of basketball, certain players may have a better low post game while others have better shooting abilities. Often, the athlete with the better low post game may want to improve his or her shooting skills; however, most of the commercially available products are too general and not specific enough to improve shooting skills. Most of these products occupy the hands of the athlete during the exercise process, and since the hands are needed for practicing many skills, there is a disconnect between the exercising process and the skill practice.

More recently there have been attempts to provide resistance band exercise systems that free the user's hands. Examples can be found in the following patent documents: U.S. Pat. No. 5,186,701 (Wilkinson), U.S. Pat. No. 5,720,042 (Wilkinson), U.S. Pat. No. 5,993,362 (Ghobadi) and U.S. Pat. No. 6,099,446 (Johnson et al). The entire disclosures in these patents are incorporated herein by reference for purposes of background information. The systems disclosed in these patents have various disadvantages, but the most noticeable, and the one common to all, is the failure to recognize the importance of the foot as opposed to the ankle. More specifically, prior art systems ignore the importance of both plantar flexion and dorsiflexion training. Plantar flexion is the movement which increases the angle between the front part of the foot and the shin; that is, it applies to the movement of the foot about the ankle joint such that the toes are moved away from the shin. Dorsiflexion is the opposite movement; it is the movement which decreases the angle between the dorsum (i.e., the superior surface) of the foot and the leg, so that the toes are brought closer to the shin. Plantar flexion and dorsiflexion are critical to running, jumping and similar athletic activities; yet the stretching and strengthening of these muscles is largely ignored in these prior systems. A major reason for these failings is the improper directivity and application location of the tension forces applied through the resistance bands to the user's foot. If not applied evenly or uniformly, such forces can be ineffective and, more importantly, can cause injury such as sprained or broken ankles.

Also ignored in prior systems is the need for providing the user with the capability of selectively adapting the system so as to exercise the foot and leg muscles in different manners for training in different sports and athletic performances.

It is desirable, therefore, to provide a resistance band training and exercise system which, in at least one embodiment, allows the user to move freely in an untethered manner, thus providing a functional fitness training system. It would also be advantageous if the system frees the user's hands to engage in skill training and permits a user to freely move about and perform a variety of exercise and training activities. It is further desirable to provide such a system which, in at least one embodiment, permits the user to selectively adapt the system to safely and efficiently exercise the muscles that control movement of the user's foot and leg. It would also be desirable to provide components of such a system which assure that the tension forces are applied by the resistance bands to the optimum locations of the user's body parts such as the feet, and in the proper directions, to assure safe and effective exercising routines.

SUMMARY

In accordance with one exemplary embodiment of the disclosure, there is provided a physical training system configured to be worn on a human body. The physical training system includes an article of footwear configured to receive a foot of the human body, the article of footwear including a medial side, a lateral side, a dorsal side, and a sole side. A first connection member is disposed on the medial side of the article of footwear and a second connection member is disposed on the lateral side of the article of footwear opposite the first connection member. The dorsal side of the article of footwear extends between the first connection member and the second connection member. A torso member is configured to engage the torso of the wearer. At least one elastic resistance band extends between the first connection member and the torso member and between the second connection member and the torso member.

In accordance with at least one embodiment of the disclosure, the article of footwear is a shoe, the torso member is a belt, and the first connection member and the second connection member are connection rings. Additionally, in such embodiment, a first strap portion connects the first connection ring to the medial side of the article of footwear and a second strap portion connects the first connection ring to the lateral side of the article of footwear. The first strap portion and the second strap portion may be portions of separate straps or portions of one strap extending across the sole side of the article of footwear.

The above described features and advantages, as well as others, will become more readily apparent to those of ordinary skill in the art by reference to the following detailed description and accompanying drawings. While it would be desirable to provide a sports performance enhancement system that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
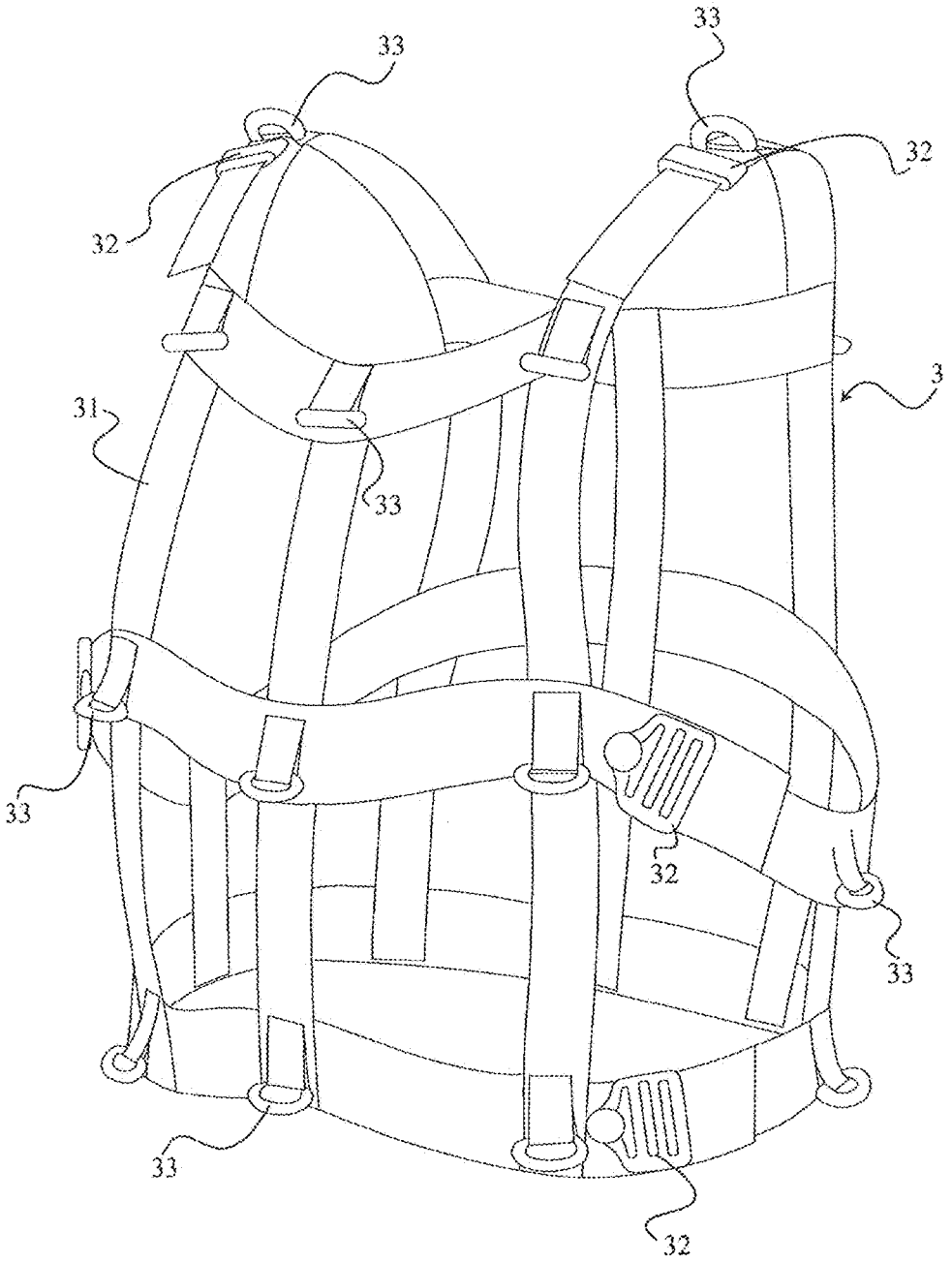
FIG. 1 is a front view in perspective of a vest that is worn in one embodiment of a sports performance enhancement system.

The following detailed descriptions and explanations of the drawings of several embodiments of the sports performance enhancement system reveal methods and apparatus that may be used in various embodiments of the sports performance enhancement system. While various embodiments have been described herein as a "sports performance enhancement system", it will be recognized that the term "sports" as used herein does not limit the system to uses related to games or competitive events. Instead, the term "sports" as used herein relates to any of various physical activities for any of various purposes, including enhancing performance for competitive athletic events, fitness activities, physical therapy, and any of various other physical activities. Accordingly, the "sports performance enhancement system" described herein may be used for any of various purposes, including training for athletic competition, cardio exercise, muscle toning or sculpting, muscle strengthening activities, and any of various other physical activities wherein use of the system may be advantageous. Accordingly, the "sports performance enhancement system" described herein may also be referred to as a "physical training system" or a "resistance training system." All illustrations in the drawings are intended to aid in the descriptions herein and are not, of themselves, intended to be limiting of the claims set forth below.

Exemplary Components of One Embodiment of System

Figure 17:
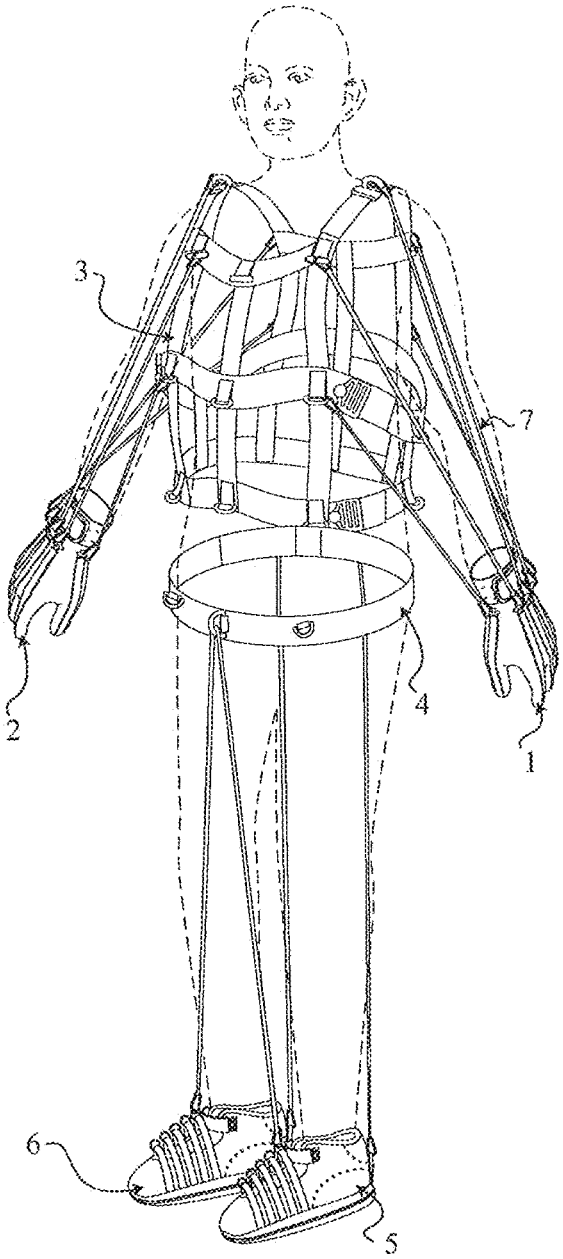
FIG. 17 is a front view in perspective of a first embodiment of a sports performance enhancement system being worn by a user.
Figure 18:
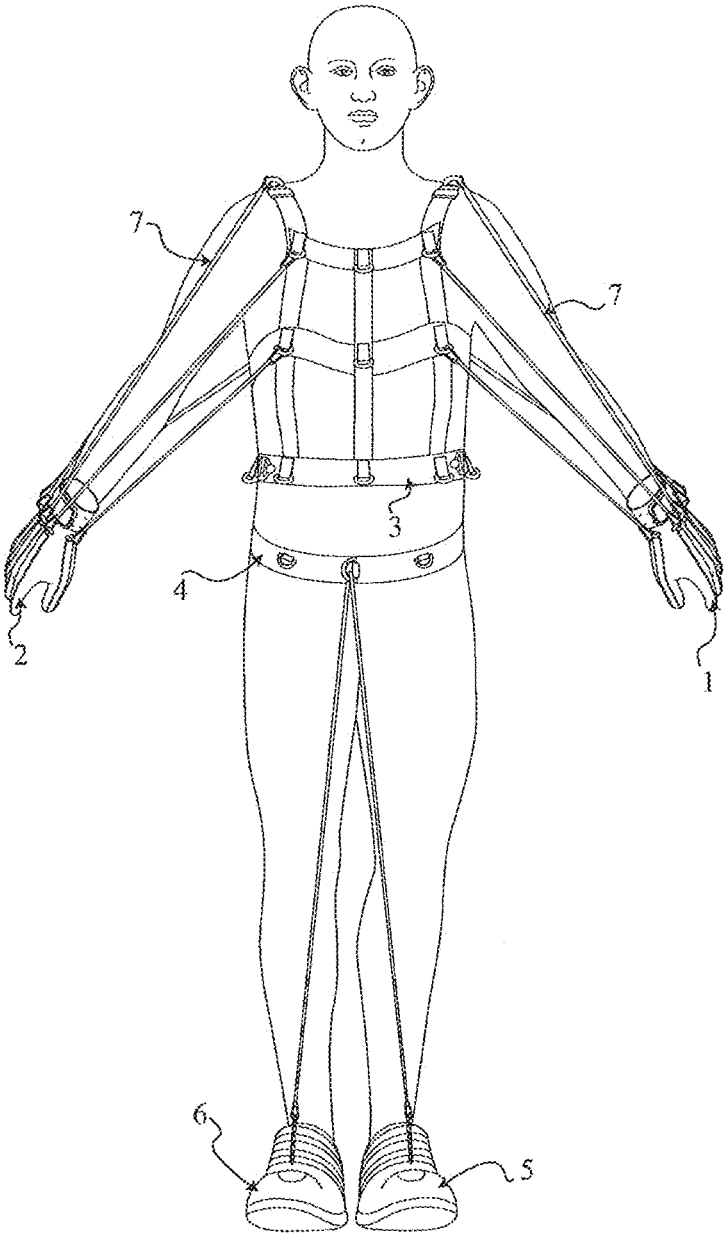
FIG. 18 is a front view in elevation of the system of FIG. 17.
Figure 19:
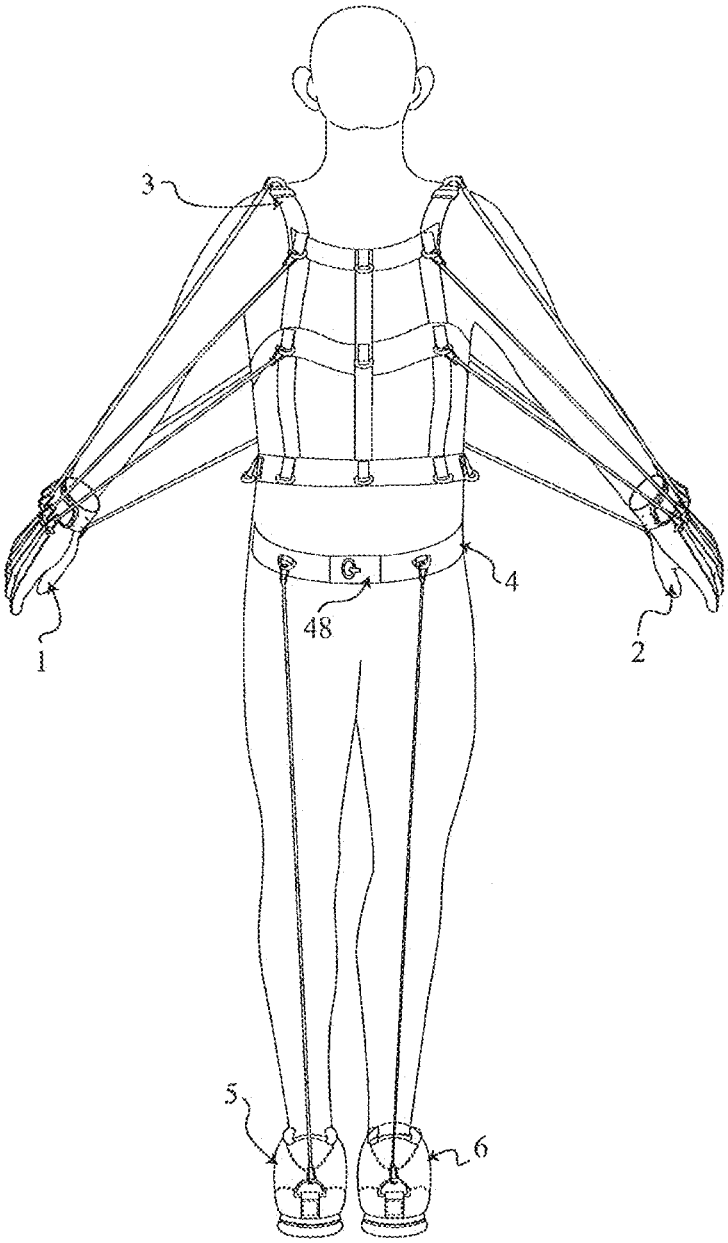
FIG. 19 is a rear view in elevation of the system of FIG. 17.
Figure 20:
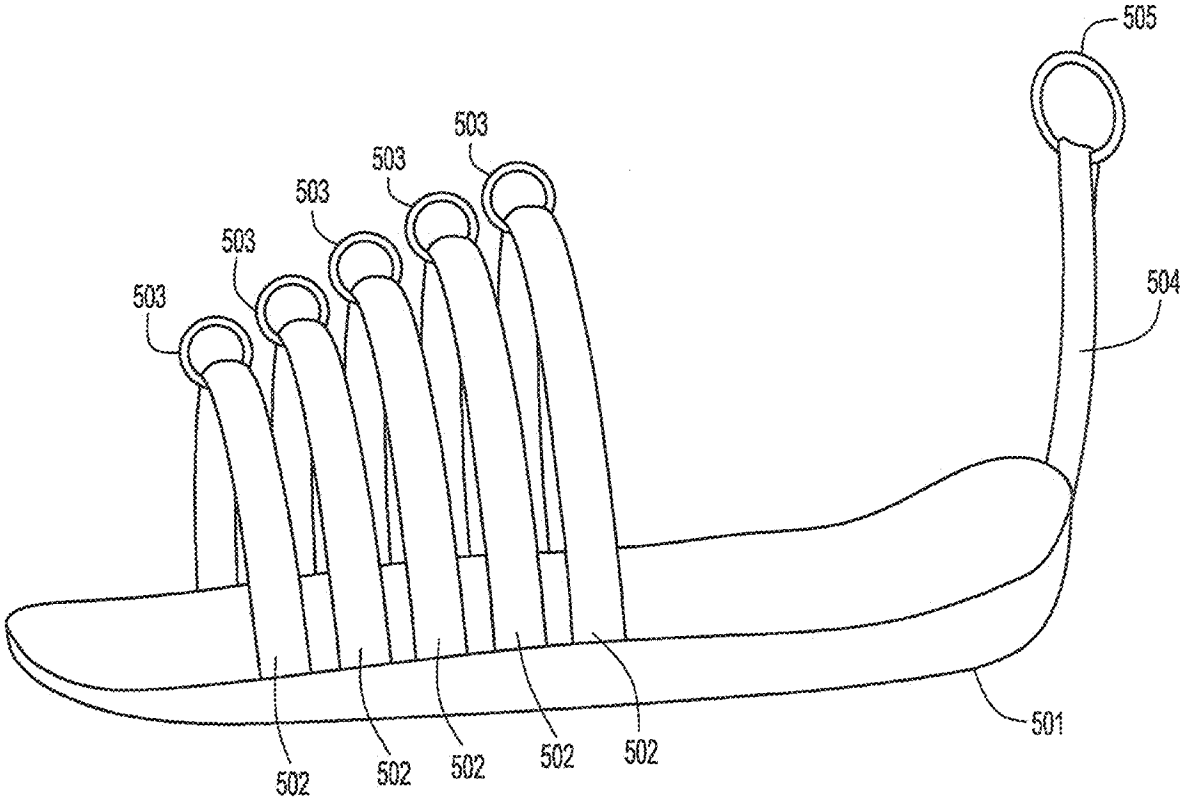
FIG. 20 is a view in perspective of a shoe bed insert that can be used in connection with a sports performance enhancement system.
Figure 21:
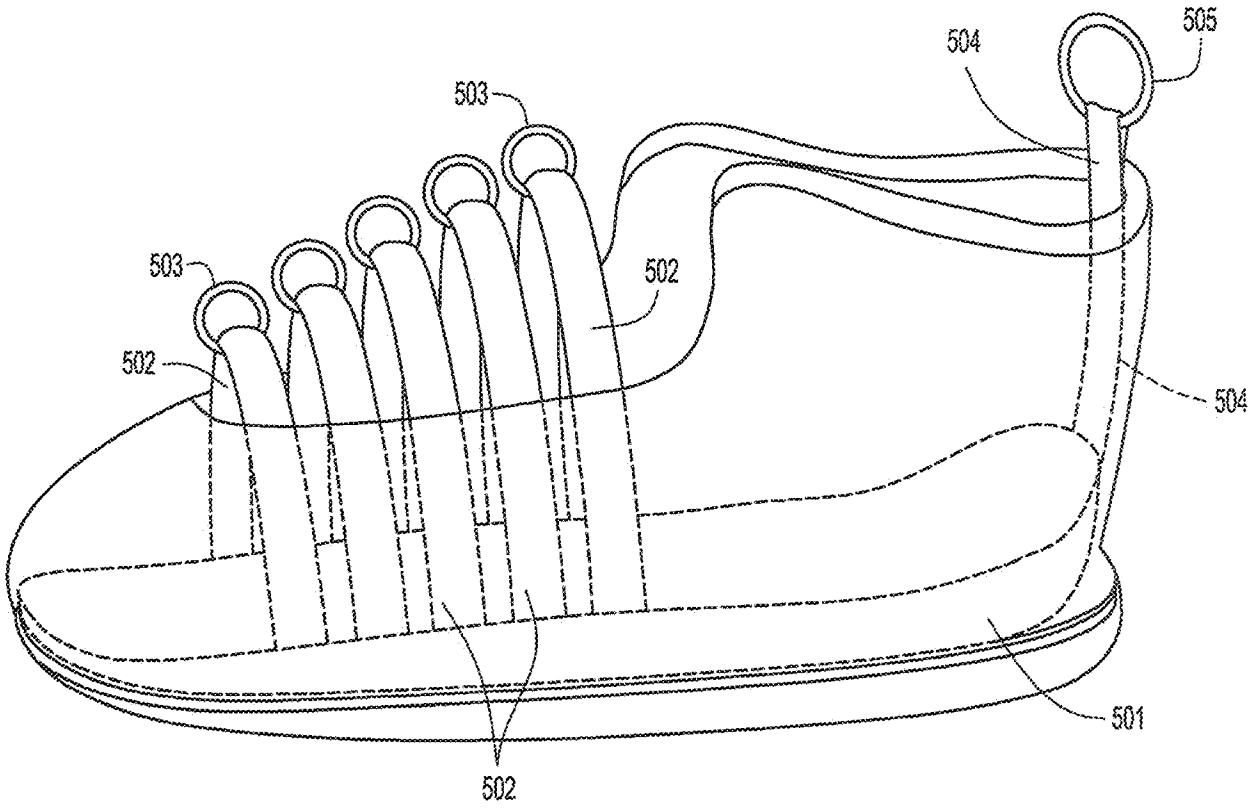
FIG. 21 is a view in section of a shoe with the shoe bed insert of FIG. 20 inserted therein.

Referring initially to the exemplary system illustrated in FIGS. 17, 18 and 19, a sports performance enhancement system comprises a left glove 1, a right glove 2, a vest 3, a belt 4, a left shoe 5, a right shoe 6, and a plurality of resistance bands 7. The gloves 1 and 2 are attached to the vest 3 by the plurality of resistance bands 7, and the shoes 5 and 6 are attached to the belt 4 by one of the plurality of resistance bands 7. The resistance bands 7 may be provided in several different tensions, allowing for users of different strengths to use resistance bands 7 that are appropriate for to their levels of strength and the intensity of workout desired. The variety of resistance band 7 tensions also allows the user to progress up through levels of tension as his/her muscles develop greater strength through use of the system.

Vest

Figure 2:
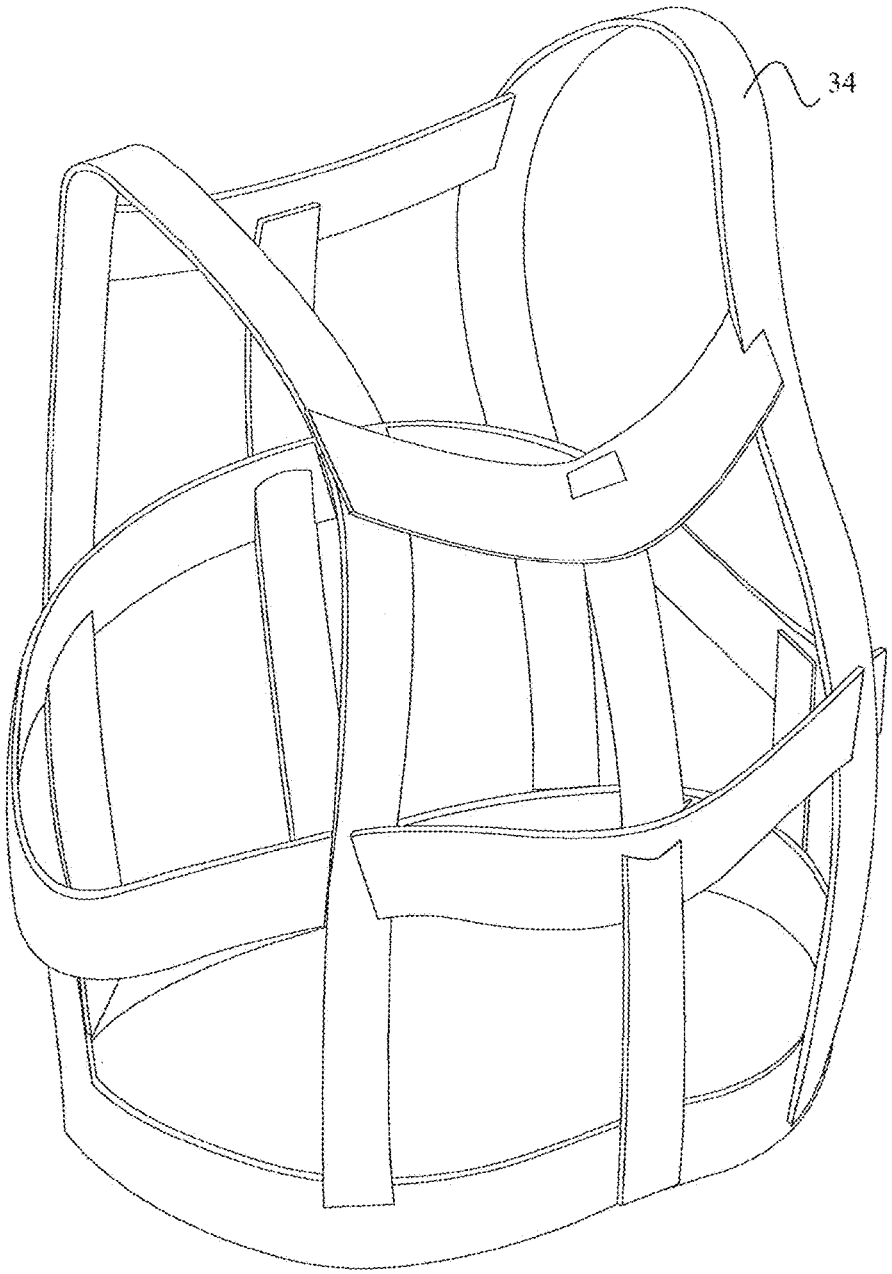
FIG. 2 is a view in perspective of a frame portion of the vest of FIG. 1.

Referring to FIGS. 1 and 2, vest 3 provides a torso member for the sports performance enhancement system and comprises a strap frame 31, a plurality of vest adjustable straps 32, a plurality of vest rings 33, and an inner vest frame 34. The vest 3 is worn on the user's torso, positioned around the upper body, and is secured to the user around the chest area and back area. The inner vest frame 34 is connected to the strap frame 31 from the inside surface of the strap frame. The inner vest frame 34 is made from low density viscoelastic polyurethane foam, or any other similar or related materials. Since the inner vest frame 34 is pressed against the user's body, the inner vest frame 34 deforms according the shape of the user's body; i.e., the frame substantially conforms to the user's body. The strap frame 31 is made from a plurality of straps and has a shape of a human upper body. The plurality of straps comprises a plurality (e.g., three in the illustrated example) of flexible or collapsible girth (i.e., horizontal) straps and a plurality (e.g., six in the illustrated example) of flexible or collapsible elongated (i.e., vertical) straps. The plurality of flexible girth straps is positioned perpendicular to the plurality of flexible elongated straps. Strap frame 31 is made from nylon straps or any other related materials similar to nylon so that the strap frame 31 is able to absorb multi-direction movement forces and deform according to the user's body shape (i.e., the frame remains conformed to the user's body as the user moves in exercise routines). The plurality of vest adjustable straps 32 is connected to the strap frame 31 around the strap frame left side, right side, and shoulder areas. Once the user puts on the strap frame 31, the strap frame 31 can be tightened to the user's upper torso by the plurality of vest adjustable straps 32.

In the illustrated embodiment, the plurality of vest rings 33 is movably connected to the strap frame 31 by a respective plurality of fastenings. The plurality of fastenings allows the plurality of vest rings 33 to freely move so that movement of the plurality of vest rings 33 is not entirely limited. The plurality of fastenings can be loops of material stitched, glued, riveted or any combination thereof. The plurality of vest rings 33 is positioned on the back side and the front side of the strap frame 31. Additionally, 360 degree rotatable or swivel rings can be used as the plurality of vest rings 33.

Belt

Figure 12:
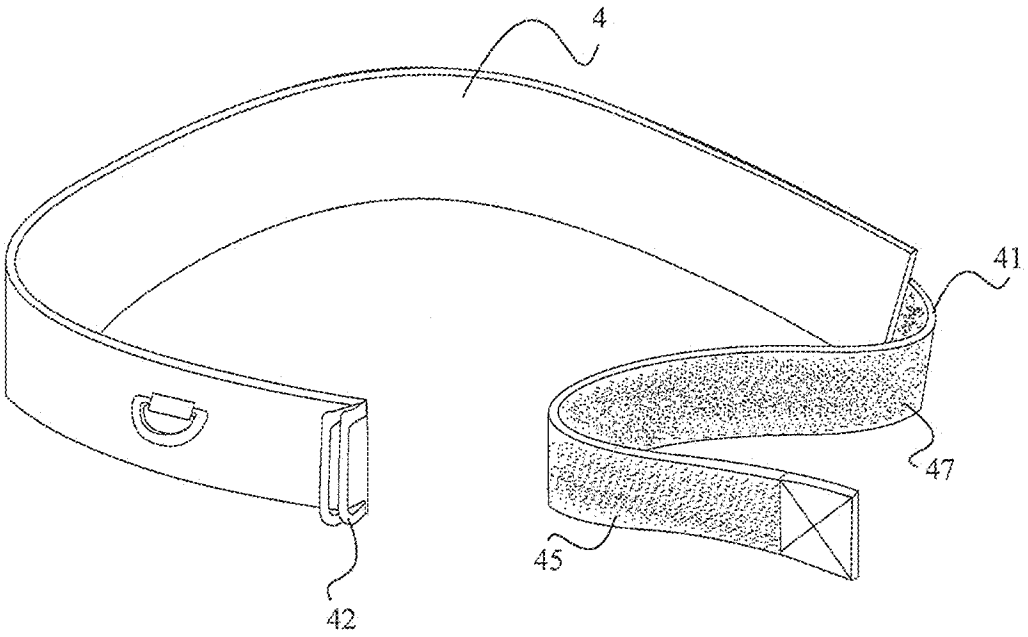
FIG. 12 is a rear view in perspective of a first embodiment of a belt that can be worn in connection with a sports performance enhancement system.
Figure 13:
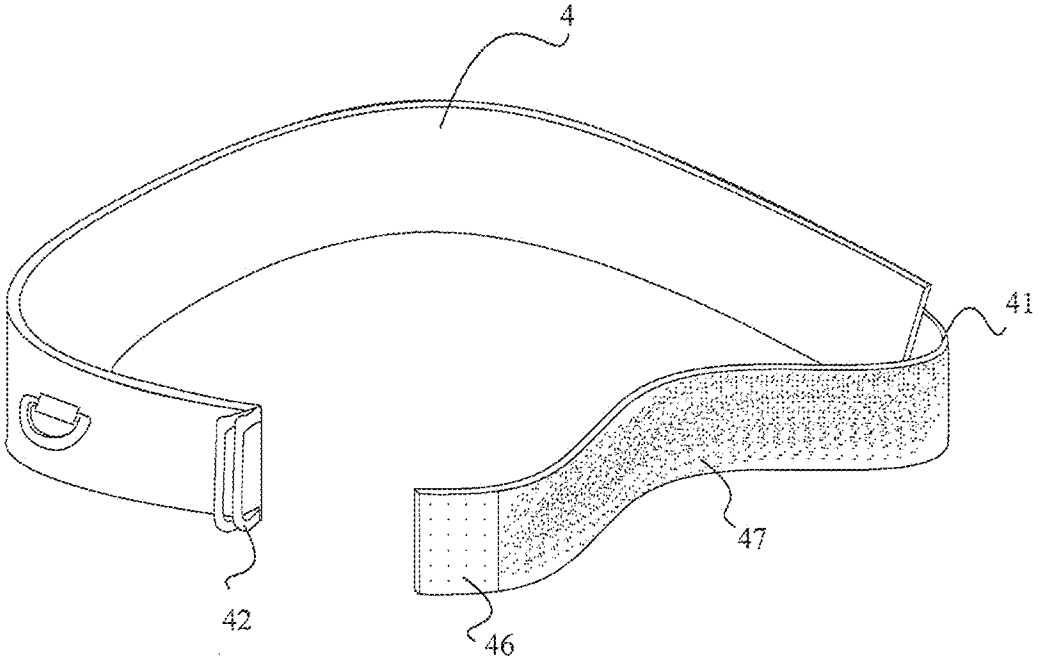
FIG. 13 is another rear view in perspective of the belt in FIG. 12 further illustrating the belt fastener.
Figure 14:
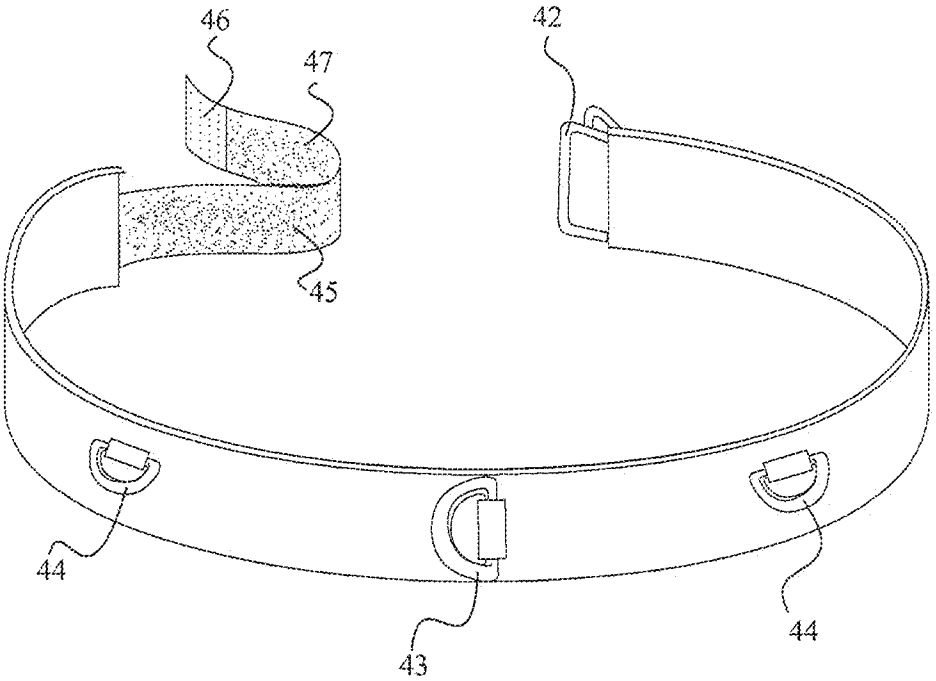
FIG. 14 is a front view of the belt in FIGS. 12 and 13.

With reference to FIGS. 12, 13, and 14, the belt 4, adapted to be worn about a user's middle or lower torso (i.e., the waist or areas below the chest), comprises a belt adjustment strap 41, a double D-ring belt buckle 42, a plurality of vertically oriented rings 43 (i.e., rings pivotable about respective vertical axes), a plurality of horizontally oriented rings 44 (i.e., rings pivotable about respective horizontal axes), an inside belt loop fastener 45, an outside belt loop fastener 47, a belt hook fastener 46, and a back attachment 48. The double D-ring belt buckle 42 is connected to the belt 4 at a first belt end, and the belt adjustment strap 41 is connected to the belt 4 at a second and opposite belt end. The belt can be adjusted to fit by the user's waist by means of Velcro (i.e., hook and loop fastener material), whereby the outside surface of belt adjustment strap 41 comprises partially or entirely loop fastener material 47, and the outside surface of the belt fastener 46 comprises partially or entirely of hook fastener material. The inside surface 45 of strap 41 consists partially or entirely loop fastener material 45. To tighten the belt the user inserts strap 41 through the double D-ring belt buckle 42 and then between the double D-ring belt buckle 42. The hook fastener material 46 also attaches to the loop fastener material on the outside surface of strap 41 to provide additional securing of the belt 4. Since the belt adjustment strap 41 allows the user to adjust the belt 4 according to the user's girth circumference (i.e., waist size), the belt 4 can be fitted to different body structures. The plurality of horizontal rings 44 and the plurality of vertical rings 43 are movably connected to be selectively positioned along the belt 4 by the plurality of fastenings. The horizontal rings 44 and vertical rings 43 can be either D-rings or O-rings. Each horizontal ring 44 is secured to be pivotably movable at least about an axis parallel to the belt 4, and each vertical ring 43 is secured to be pivotably movable at least about an axis perpendicular to the belt 4.

Figure 15:
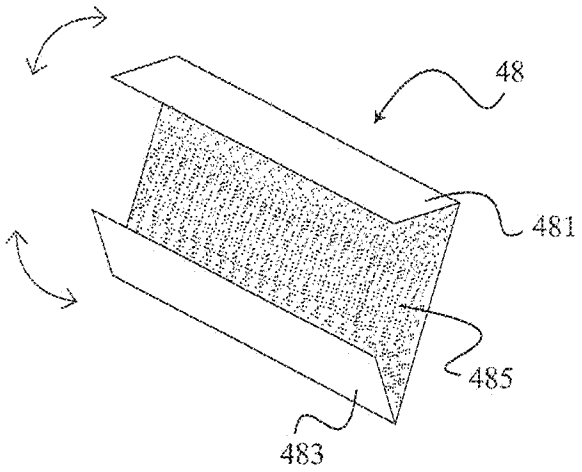
FIG. 15 is rear view in perspective of an attachment member for the belt of FIGS. 12-14.
Figure 16:
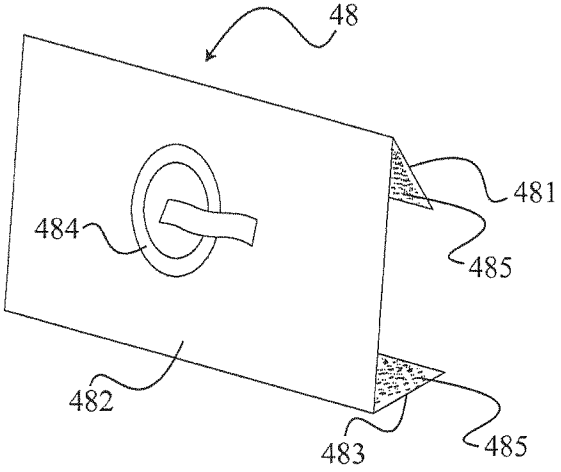
FIG. 16 is a front view in perspective of the attachment member in FIG. 15.

In reference to FIGS. 15 and 16, the back attachment 48 comprises a top flap 481, a middle flap 482, a bottom flap 483, at least one back ring 484, and a back hook material fastener 485. The top flap 481 and bottom flap 483 are respectively connected to the middle flap 482 top end and the middle flap 482 bottom end. The back ring 484 is connected to the middle flap 482 front surface. In the illustrated embodiment, an O-ring is used as back ring 484, but the back ring 484 is not limited to the O-ring configuration and can be any type of ring, such as a D-ring or triangle ring. The back hook material fastener 485 is connected to top flap 481, middle flap 482, and bottom flap 483 opposite back ring 484. With reference to FIGS. 12 and 19, the back hook fastener material 485 in the middle flap 482 of back attachment 48 attaches to the outside belt loop fastener material 47, and the back hook fastener material 485 in the top flap 481 and the bottom flap 483 attach to the inside belt loop fastener material 45.

Figure 30:
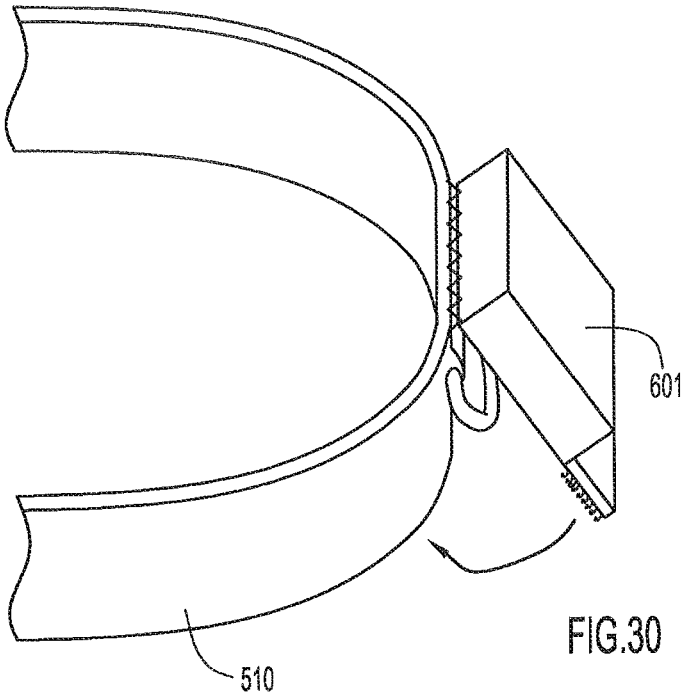
FIG. 30 is a side view in perspective showing a protective and positional stabilization pad attached to the belts of the sports performance enhancement system.
Figure 31:
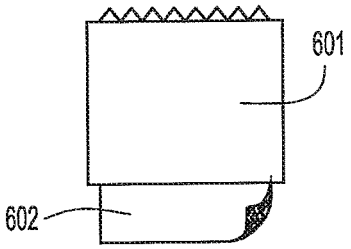
FIG. 31 is a view in elevation of the pad of FIG. 30.

An alternative belt configuration for the system includes cushioning pads or inserts 601 as illustrated in FIGS. 30 and 31 of the accompanying drawings. The cushioning (e.g., plastic foam) inserts are located at one or more locations along the belt 510 and inserted either between the inner and outer sections of the belt behind the inner part of the belt, or in front of the outer section of the belt. The foam inserts can be inserted in the front, rear, and/or sides of the belt, and are used to provide additional cushioning, comfort and spacing between the user's body and the resistance bands as the bands extend down to the lower connection points. The inserts can be made from any cushioning material and in any shape or density to provide the best and most suitable option for the user's comfort. As shown in FIG. 30, cushioning insert 601 may be stitched to the belt to assure a reliable connection. As best shown in FIG. 31, a tab may be provided at the bottom of the cushioning pad and includes a Velcro "hook" or rough surface material permitting it to engage the soft "loop" or smooth surface material comprising the back side of the belt at the pad location. If the cushioning pad were not properly secured to the belt, the pad may move during a workout by the user. Providing the tab with a rough hook surface will stop the piece from moving.

Figure 35A:
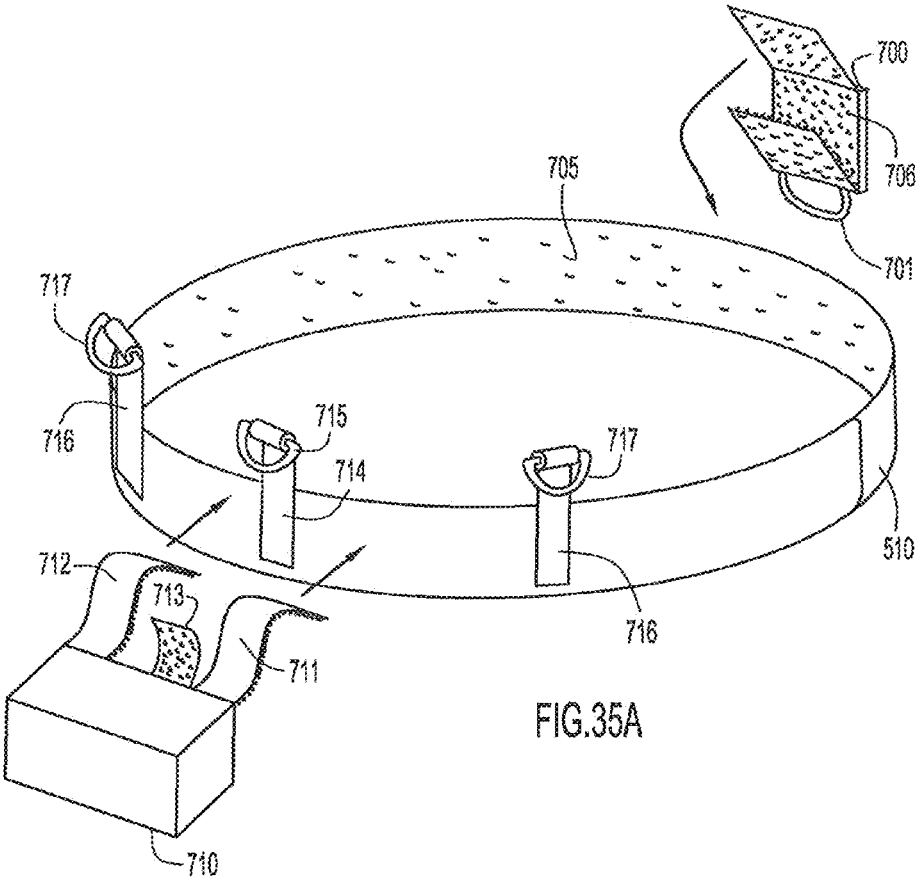
FIG. 35A is a view in perspective of the belt of FIG. 34 diagrammatically illustrating a manner of attaching a protective pad and a rear connection ring to the belt.
Figure 35B:
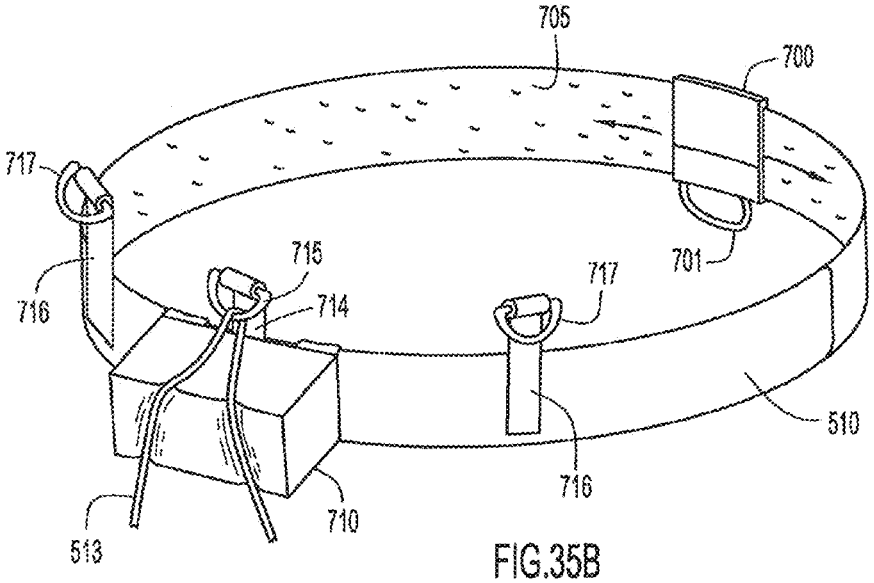
FIG. 35B is a view in perspective of the belt of FIG. 34 illustrating the protective pad and the rear connection ring attached to the belt.

Still another alternative embodiment of the belt is illustrated in FIGS. 35A and 35B to which reference is now made. The structure of belt 510 is substantially similar to belt 4 with some additional features. There are three front band connection rings secured to belt 510 in a manner such that the rings are supported above the top edge of the belt. Specifically, a center ring 715 is supported by support member 714 at the center of the front of the belt. Left and right side rings 717 are spaced on either side of center ring 715 and supported by respective support members 716. Support members 714 and 716 may be strips of material that are secured to the outer surface of the belt and extend across the belt width to a height slightly above the upper belt edge. Alternatively, for an even stronger attachment to the belt, the support members may be stitched or otherwise secured in place between the inner and outer layer of the belt. The upper ends of the support members are looped to surround the straight sides of respective D-rings 715, 717 so that the rings are free to pivot in the loop about their own axes which are oriented horizontally when the belt is worn. This location of the rings above belt 510 serves to position resistance bands, when they are connected to the rings, away from the user's body.

To space the bands even further from the user's body, particularly the user's groin area, a protective pad 710 may be selectively attachable to the belt in front of and below center connection ring 715. Pad 710 is made from a plastic foam or other cushioning material and has two spaced top connecting straps 711, 712 secured to and extending proximally from opposite ends of the upper edge of the proximal side of pad 710. A bottom connecting strap 713 extends proximally from the center of the lower edge of the proximal side of the pad. The inner surfaces of straps 711, 712 and 713 are provided with hook attachment material suitable to engage the loop attachment material that is disposed on the inner surface of belt 510. The spacing between the two top connecting straps 711 and 712 is wider than the width of support member 714 and its supported connection ring 715 so that straps 711, 712 do not interfere with ring 714 and any resistance band connected to or passing through that ring. When straps 711, 712 and 713 are engaged with the inner belt surface, pad 710 projects forwardly of the front center of belt below connection ring 715 to project the resistance band forward from the belt and the user's body. The thickness of the pad is typically approximately two inches but can be anywhere in the range of about one to three inches as needed to effect the desired forward projection of the resistance band. Although illustrated such that the pad, when attached to the belt, has its upper surface substantially coplanar with the upper edge of the belt, for some embodiments it may be desirable to extend the upper surface of the pad above the belt upper edge to achieve even greater spacing of the resistance bands from the user's body.

The back ring 701 for belt 510 is secured to a removable and positionally adjustable attachment panel unit 700. Panel 700 includes three sections (upper, middle and lower) that are mutually foldable onto one another and has an interior surface provided with hook attachment material suitable to engage the loop attachment material that is disposed on the inner surface of belt 510. The outer surface of at least the lower panel is provided with loop attachment material suitable to engage the hook attachment material that is disposed on the inner surface of the upper section when it is folded over onto the lower section with the belt 510 disposed between the lower and middle sections. Back connection ring 701 projects from the outside surface of panel unit 700 at the fold juncture between the middle and lower panel sections. The back connection ring may be a D-ring, O-ring, or any other type of ring, and is engaged by unit 700 to be pivotable about the axis of its straight leg which is oriented horizontally when the unit is secured to the belt. In this position the back connection ring 701 projects downwardly from the belt. The removable and adjustably positionable panel unit 700 permits the user of the belt, after the belt is tightened or loosened to accommodate the user's waist size, to install the back ring at the center of his/her back, irrespective of the user's waist size.

While the belts 4, 510 in various embodiments herein have been shown and described above, it will be recognized that various adaptations and configurations for the belt are possible. For example, while the figures generally only disclose a few selected locations for the connection rings 43, 44, 701, 715 and 717 numerous other connection ring locations are possible, including any of various locations deemed to be advantageous for a particular type of exercise for the user. Moreover, while the connection rings have been described above as being fixed in relation to a specific mounting location on the belt, it will be recognized that the mounting locations may also be moveable, such that the mounting locations may slide along the belt to any of a number of different locations (which different locations may be defined by a degree between 0° and 360° around the circumference of the belt. Accordingly, the belt with multiple connection rings and multiple locations for such connection rings may provide multiple configurations for the bands extending between the limbs of the user and the belt.

In addition to the above, it will also be recognized that the connection rings described herein may be provided in any number of forms and that various adaptations and configurations of the connection rings are possible. For example, all of the connection rings disclosed herein may be comprised of any of various types of material, such as various metals, textiles or fabrics, plastics, or any of various other types of materials or combinations thereof. Accordingly, while connection rings in some embodiments may be relatively hard, stiff or rigid, connection rings in other embodiments may be relatively soft, flexible or elastic. Moreover, the term "connection rings" as described herein is not limited to a particular shape of ring and may be provided in any number of different forms, such as O-rings, D-rings, or any of various other rings that substantially enclose a space either alone or in combination with another component. For example, an oval-shaped member (like a chain link) with an opening may be a connection ring if used in association with another component that closes the opening or is sufficiently large such that it cannot pass through the opening.

Shoe

Figure 9:
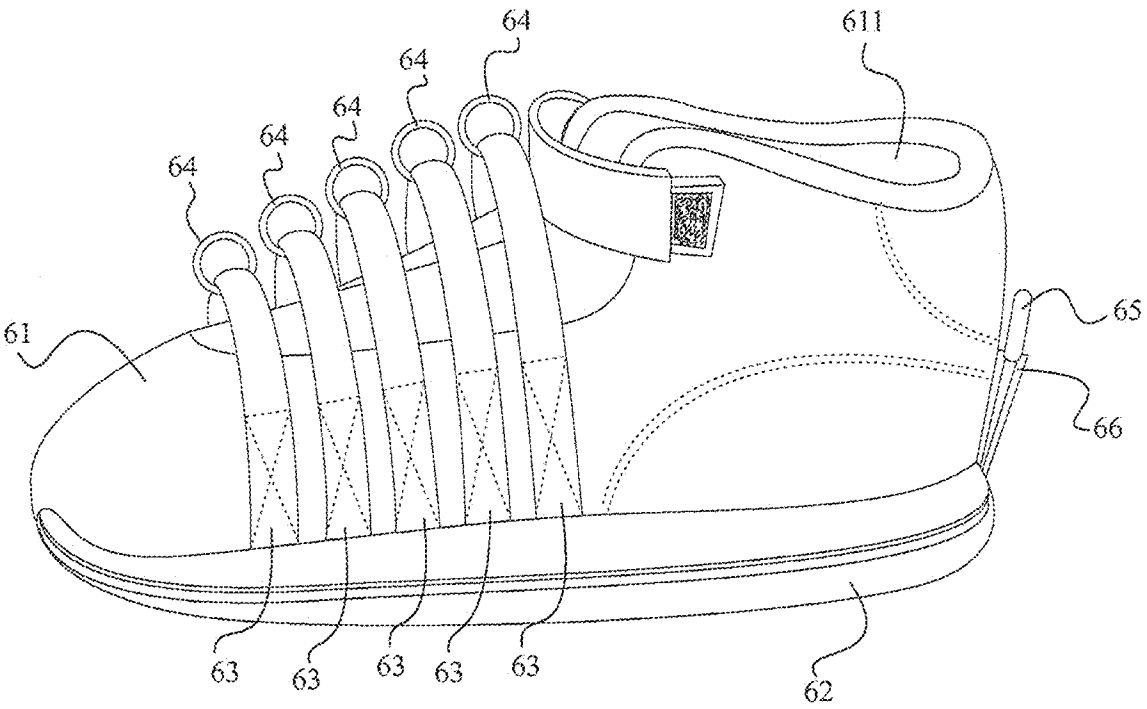
FIG. 9 is a side view in perspective of a shoe that can be worn in connection with a sports performance enhancement system.
Figure 10:
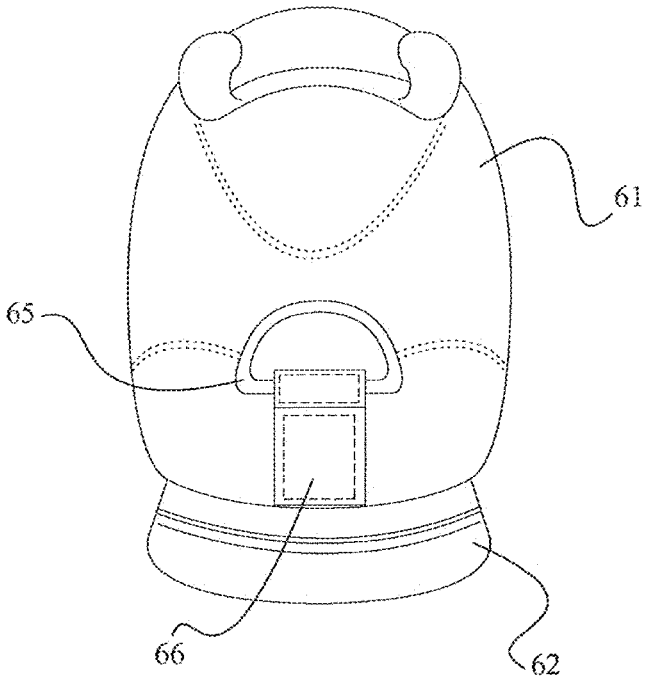
FIG. 10 is a rear view of the shoe of FIG. 9.

With reference to FIGS. 9 and 10, there is illustrated a shoe which may be either of the shoes 5 or 6 illustrated in FIG. 17. The shoe may be any athletic-type shoe appropriate for the desired conditioning activity including, but not limited to, a general cross-training shoe, or an athletic shoe, including a cleated shoe, made specifically for any particular sport. The shoe comprises an upper section 61, a sole 62, a plurality of shoe straps 63, a plurality of connection O-rings 64, a rear ring 65, and a ring attachment member 66. The upper 61 includes a heel opening 611 through which a user can insert his/her foot so that the shoe can be attached to (i.e., worn on) the foot. The shoe straps 63 may be ballistic nylon or similarly strong and inelastic material and are positioned in spaced relation in front of the heel opening 611 and rearwardly of the front tip of the shoe above the user's instep. In this embodiment each of the straps 63 is a single continuous loop which is positioned around and connected to the upper section 61, by stitching, adhesive, or the like, proximate (i.e., immediately above) the junction between the shoe upper 61 and sole 62. Each shoe strap 63 is stitched to the upper section 61 left side and right side in the illustrated embodiment, but may alternatively be secured to the sole or secured between an insole and outsole comprising sole 62. Connection rings 64 are positioned to encircle respective shoe straps 63. The straps 63 are provided with sufficient slack to leave enough space between the strap and the shoe upper 61 to enable connection rings 64 to freely move along the straps 63 between the stitched ends of the straps on the left and right side of upper 61. The ring attachment member 66 is positioned behind the heel opening 611, and in at least one embodiment on the outer rear surface of the shoe, and perpendicularly positioned relative to the plurality of straps 63. The ring attachment 66 bottom end is connected to the upper section 61 back side and bottom side, and the rear ring 65 is pivotably connected to the ring attachment member 66 top end. The sole 62 is connected to the bottom side of the upper section 61 along a junction line. The sole 62 provides additional support to the plurality of straps 63 and the ring attachment member 66 so that the plurality of shoe straps 63 and the ring attachment member 66 are secured within the shoe.

Additionally, the plurality of straps 63 can also be attached to the shoes 5 and 6 by implementing a male/female strap clip system. The male/female strap clip system allows the plurality of shoe straps 63 to attach with the shoe, and the plurality of shoe straps 63 would not be in the form of a continuous loop. If the shoe has the male/female strap clip system, male strap clips connect with each of straps 63, and a plurality of female strap clips connect with shoe. The user can simply insert the male strap clips into the plurality of female strap clips, securing the plurality of shoe straps 63 to the shoe 6. The male/female strap clip system also allows the user to adjust the lengths of the straps 63.

Additionally, the plurality of shoe straps 63 can be attached to the left shoe 5 and the right shoe 6 by a plurality of channel connectors. The plurality of channel connectors is positioned between the upper section 61 and the sole 62. Each of the plurality of channel connectors comprises an inside channel, an outside channel, and a connector segment. The inside and outside channels are perpendicularly connected to the connector segment, and only at the connector segment positions under the upper section 61. Each of the plurality of shoe straps 63 is adjustably attached with the inside channel and the outside channel, allowing users to interchange the plurality of shoe straps 63 according to different exercises.

Figure 32:
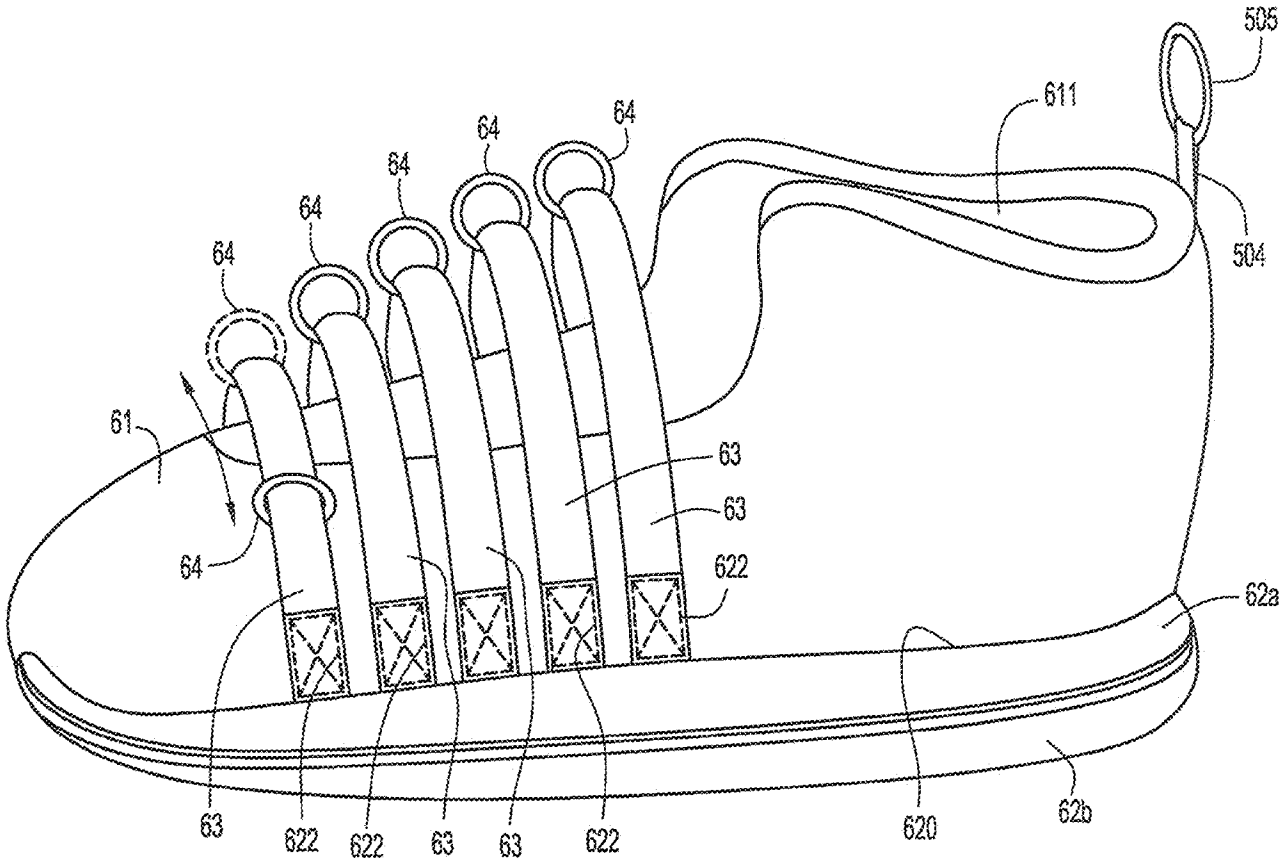
FIG. 32 is a side view in perspective of another shoe that can be worn in connection with the sports performance enhancement system.
Figure 33B:
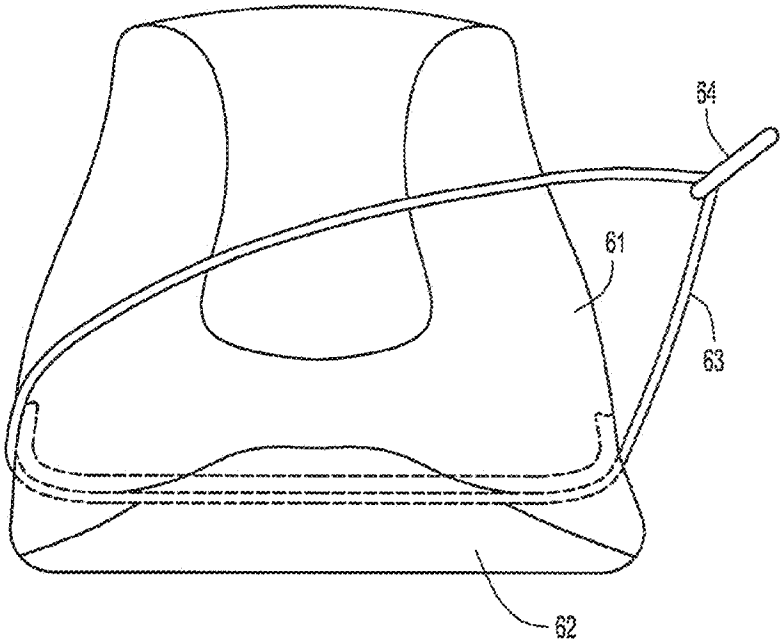
FIG. 33B is a front view on elevation of the shoe of FIG. 32 showing a strap and connection ring in two of the possible applied force positions.
Figure 33A:
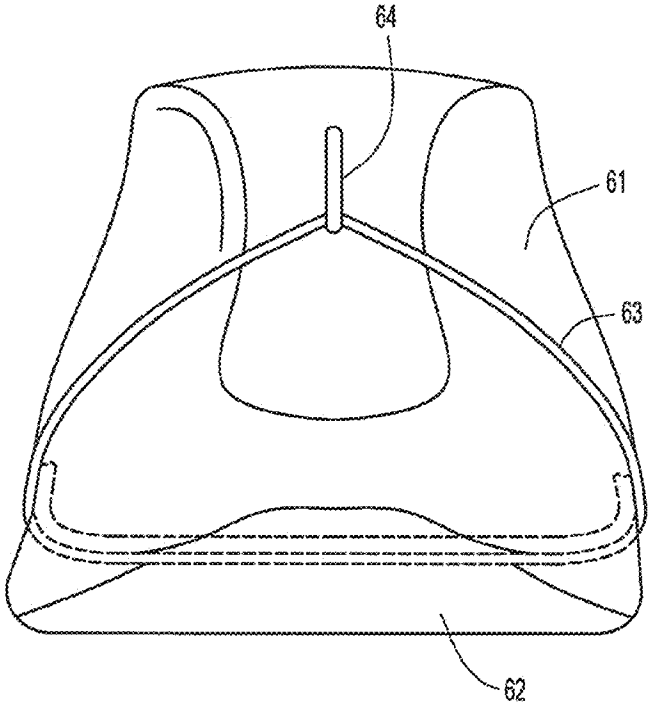
FIG. 33A is a front view on elevation of the shoe of FIG. 32 showing a strap and connection ring in a force-neutral position.

Referring to FIGS. 32, 33A and 33B, another embodiment of the shoe 5 or 6 is illustrated. The shoe may be any athletic-type shoe appropriate for the desired conditioning activity. The shoe comprises a shoe body having a forward portion and a rearward portion, an upper section 61 and a sole including conventional insole 62*a* and outsole 62*b* joined to the shoe upper along a junction 620 between them. A plurality of straps 63 is provided, each strap extending over the forward portion of the shoe between two locations on junction 620 on opposite sides of the shoe upper 61. The straps are essentially parallel to and spaced rearwardly from one another along said shoe body. The straps are made of a strong material such as ballistic nylon or similar material and have sufficient slack so as to be loosely spaced above the shoe upper. A corresponding plurality of connection rings 64 is disposed about and freely movable along respective straps 63. Each ring 64 and the strap 63 it surrounds are configured and constructed to be connected, via the ring, to an elastic resistance band 513 (FIG. 34) such that, when the connected ring is pulled by a force applied through the elastic resistance band, the ring is free to both traverse the strap 63 and pull the strap in the direction of band. The slack in strap 63 is sufficient to permit the ring to be pulled with the second strap transversely outwardly of the shoe beyond the junction between the shoe upper 61 and the sole 621, 62*b*.

In the illustrated embodiment each strap 63 is a continuous loop extending beneath the insole 62*a* and the outsole 62*b* and above the shoe upper 61. However, the strap need not be continuous, a significant feature being its transversely spaced connections 622 to opposite sides of upper 61 at or immediately above the junction 620 by stitching, adhesive or other means. These transversely spaced connections 622 permit the band to be pulled transversely outwardly of the shoe as described above and illustrated in FIG. 33B. Thus, each strap can have a finite length, terminating at junction 620, and still function as described.

Whether or not the straps are continuous, because of the spaced connection locations 622 on opposite sides of the shoe, the strap directs the tension force in the resistance band in a balanced manner to both sides of the foot, uniformly distributing the force and avoiding torque that is produced in prior art systems where the force is applied in an unbalanced manner, primarily to one side of the foot. Such torque tends to turn the user's foot in a roll direction which can cause serious injury. In addition, uneven force distribution results in inefficient transmission of the tension force and requires more tension to accomplish a given exercise.

The stitching of the straps 63 to upper section 61 at connections 622 is advantageously of the Box X type which is known to have particular strength, but other strong stitching may be utilized.

Another feature of note in the shoe of FIG. 32 is the provision of plural straps 63 at different locations lengthwise of the shoe and the user's foot, thereby providing the user with options as to which strap and ring to use for a particular exercise. In this regard, at least the forwardmost strap is located forward of the arch portion of the shoe sole and the user's foot, approximately at the balls of the user's foot. Resistance band tension applied at this location is ideal for training for straight ahead running and similar activities. The rearwardmost strap is located slightly forward of the shoe opening 611 corresponding to a location above the rearward part of the user's instep. Resistance band tension applied at this location is ideal for training for lateral movement and sudden directional changes. Two or more additional straps are located over the instep intermediate the forward and rearward straps and can be selected for combined training and/or user comfort at various exercise sessions.

Figure 34:
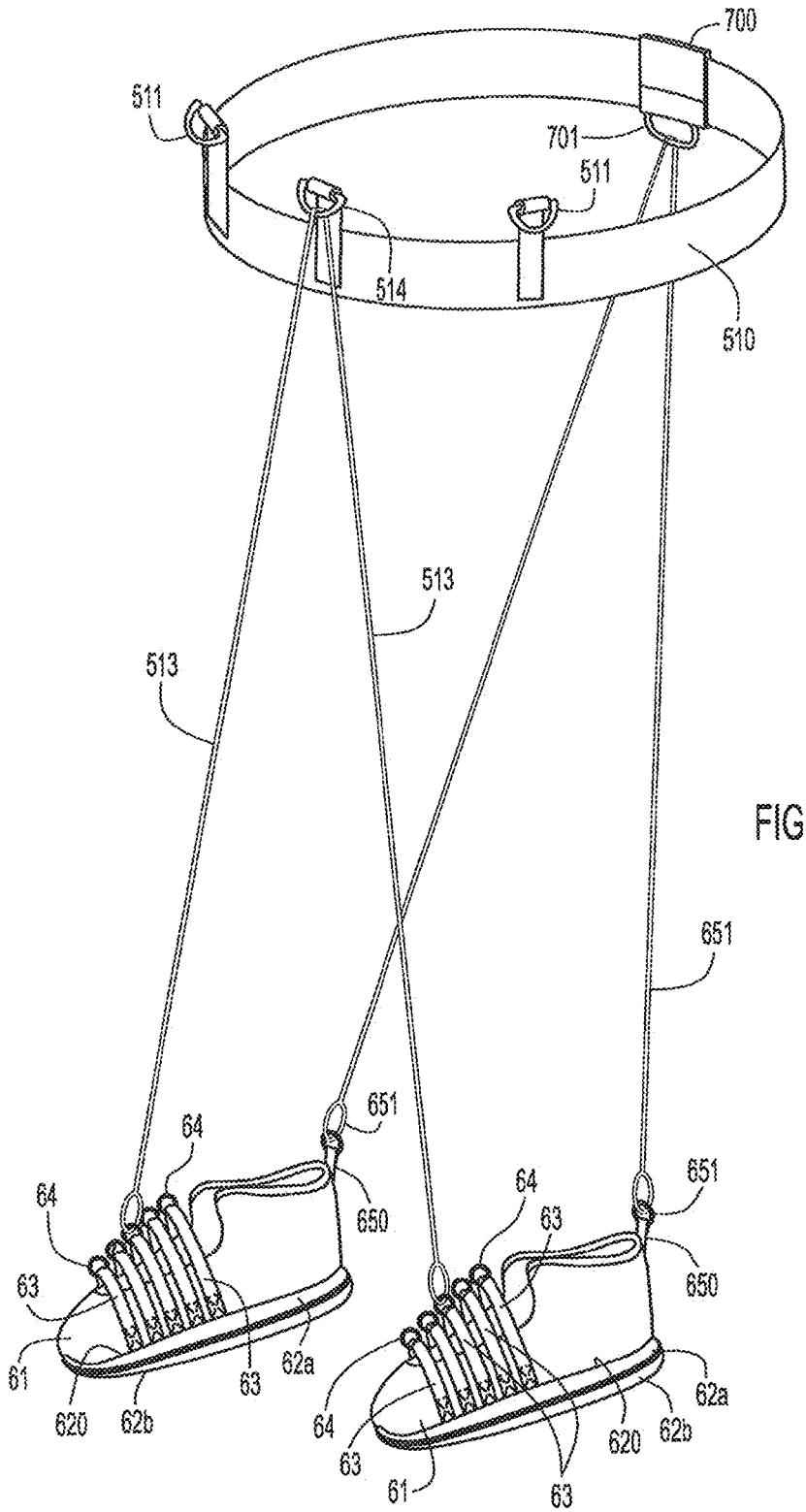
FIG. 34 is a view in perspective showing two of the shoes of FIG. 32 and a belt of the sports performance enhancement system connected via elastic resistance bands.

As illustrated if FIG. 34, each shoe may also include a rear tab 650 extending upward along the back of the shoe to a location above heel opening 611. Tab 650 retains a rear ring 651 at its upper end, which is adapted to engage another resistance band 651.

FIG. 34 also illustrates a system embodiment of the sports performance enhancement system without a vest, wherein the only item or garment worn on the user's torso is belt 510. The arrangement, as shown, permits exercise of the user's feet and legs. A front resistance band 513 extends between a selected connecting ring 64 on the left shoe and a selected connecting ring 64 on the right shoe through the front center belt ring 514 extending upwardly from the belt, such that the front resistance band 513 is in an inverted V-shape. A rear resistance band 651 extends between the rear ring 651 on each shoe through the back centered ring 701 projecting downwardly from the belt, such that the rear resistance band 651 is in an inverted V-shape. The user can connect the ends of front band 513 to any of the plural connection rings 64 on either shoe, depending on the particular intended exercise and the user's subjective "feel" or comfort. In at least one embodiment, the user can connect the ends of front band 513 to any of the plural connection rings 64 on types of footwear other than a shoe, such as a foot bed or a sock, as described in further detail below with reference to FIGS. 20-21, 26-29, and 36-43. Furthermore, in at least one embodiment as described below with reference to FIGS. 23A and 23B, the single front band 513 may be replaced by two or more front bands. Similarly, the single rear band 651 may be replaced by two or more rear bands, depending on the particular intended exercise and the user's subjective "feel" or comfort.

Hand Member

Figure 3:
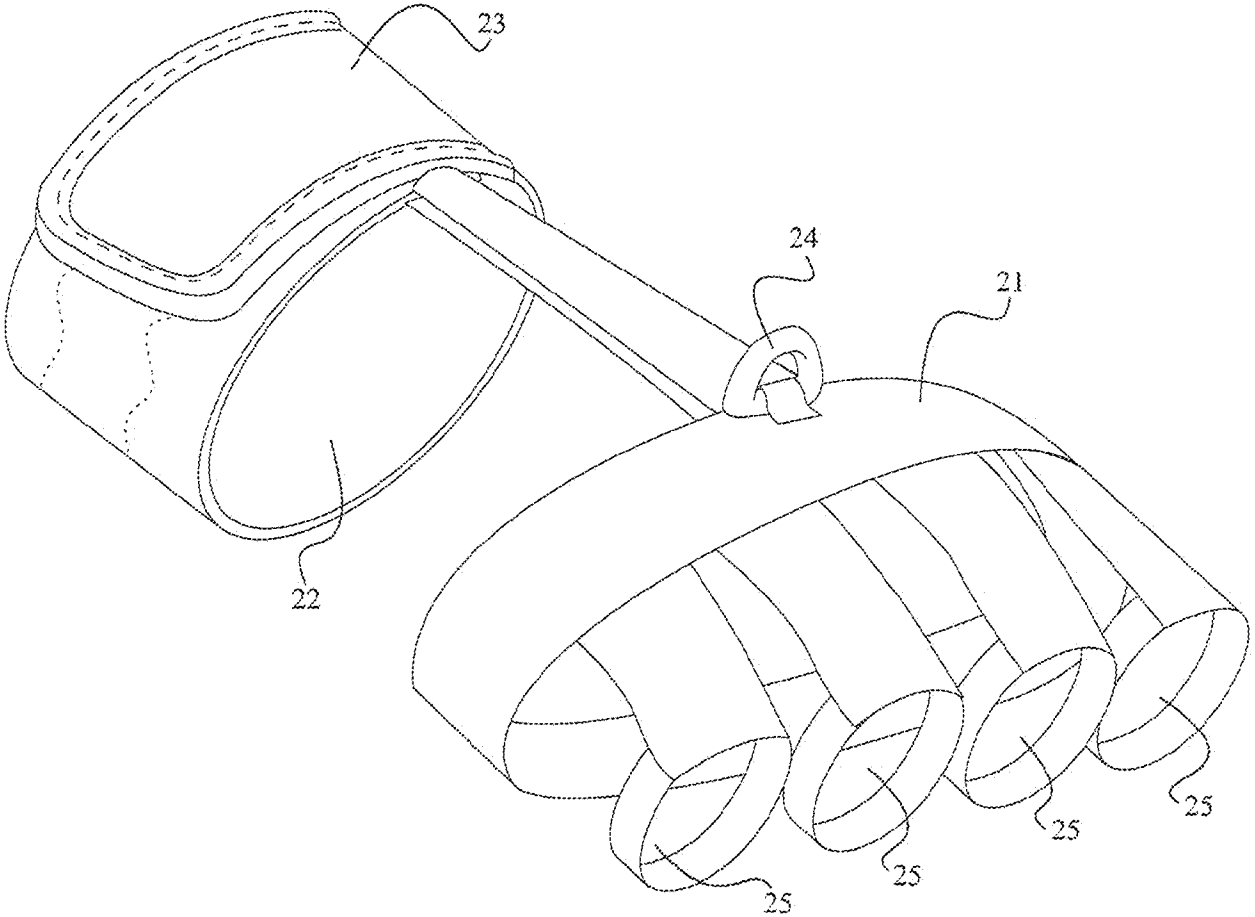
FIG. 3 is a front view in perspective of one embodiment of a glove that can be worn in connection with a sports performance enhancement system.

With reference now to FIG. 3, the physical training system is configured with a plurality of hand members including a left glove 1 and a right glove 2. In a first embodiment, each glove 1, 2 comprises a glove support structure 21, a wrist opening 22, a wristband 23, a glove D-ring 24, and a plurality of finger openings 25. The wristband 23 is connected to glove support structure 21 from one end, and the plurality of finger openings 25 is connected to the glove support structure 21 opposite the wristband 23. The glove support structure 21 is made from many individual straps and comprises the shape of a human hand. The wrist opening 22 is positioned within the wristband 23. When a user inserts his hand through the wrist opening 22 into the glove support structure 21, the user's fingers extend through the plurality of finger openings 25. The wristband 23 allows the user to adjust the comfort fit of the glove. The wristband 23 comprises a first end 231, a second end 232, an adjustable wrist strap 233, glove loop fastener material 234, and glove hook fastener material 235. The adjustable wrist strap 233 is connected to wristband 23 from the first end 231 and positioned on the outside surface of the wristband 23. The glove hook fastener material 235 is connected to the second end 232 from the outside surface of the wristband 23. The glove loop fastener material 234 is positioned between adjustable wrist strap 233 and glove hook fastener material 235, and glove loop fastener material 234 is connected to adjustable wrist strap 233. Since the first end 231 and second end 232 are attached together by glove hook fastener material 235 and glove loop fastener 234, users can adjust the circumference of the wristband 23 by means of the adjustable wrist strap 233. The glove D-ring 24 is movably connected to the glove support structure 21. The glove D-ring 24 is positioned adjacent the plurality of finger openings 25 and positioned on the glove support structure 21 top side, wherein the top side is positioned adjacent the hand knuckles and the wrist.

Figure 4:
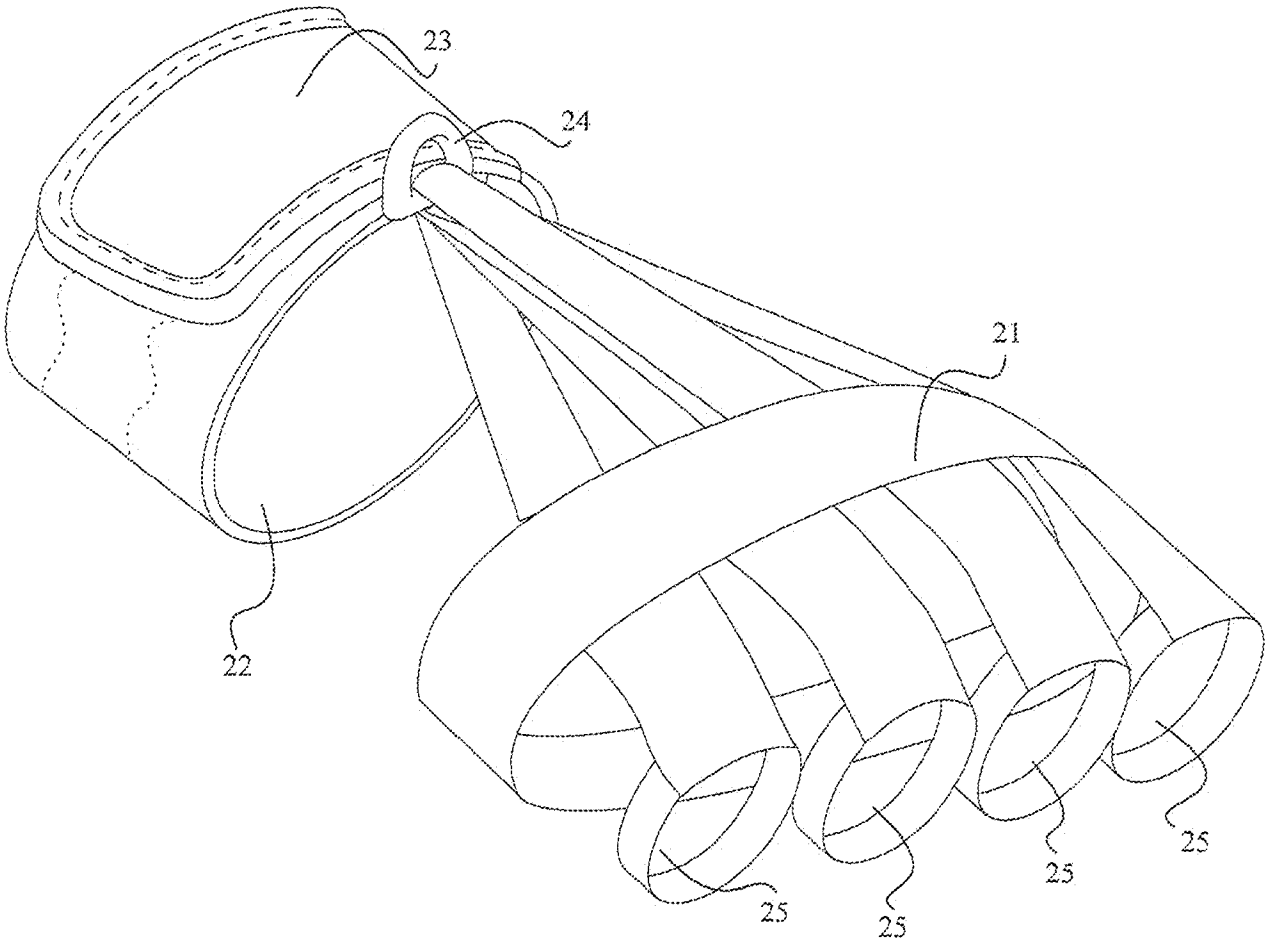
FIG. 4 is a front view in perspective of another embodiment of a glove that can be worn in connection with a sports performance enhancement system.

In reference to FIG. 4, the left glove 1 and right glove 2 in the second embodiment each comprises the glove support structure 21, wrist opening 22, wristband 23, glove D-ring 24, and the plurality of finger openings 25. The wristband 23 is connected to glove support structure 21 from one end, and the plurality of finger openings 25 is connected to glove support structure 21 opposite the wristband 23. The glove support structure 21 is made from many individual straps and comprises the shape of a human hand. The wrist opening 22 is positioned within the wristband 23. When a user inserts a hand through wrist opening 22 into glove support structure 21, the user's fingers extend through the plurality of finger openings 25. The wristband 23 allows the user to adjust the comfort fit of the glove. The wristband 23 comprises the first end 231, the second end 232, adjustable wrist strap 233, glove loop fastener 234, and glove hook fastener 235. The adjustable wrist strap 233 is connected to wristband 23 from the first end 231 and positioned on the outside surface of the wristband 23. The glove hook fastener 235 is connected to the second end 232 from the outside surface of the wristband 23. The glove loop fastener material 234 is positioned between the adjustable wrist strap 233 and the glove hook fastener material 235, and the glove loop fastener material 234 is connected to the adjustable wrist strap 233. Since the first end 231 and the second end 232 are attached together by the glove hook fastener 235 and the glove loop fastener 234, users can adjust the circumference of the wristband 23 by the adjustable wrist strap 233. The glove D-ring 24 is pivotably connected to the glove support structure 21. The glove D-ring 24 is positioned adjacent the wristband 23 and positioned on the glove support structure 21 top side, wherein the top side is positioned adjacent the hand knuckles and the wrist.

Figure 5:
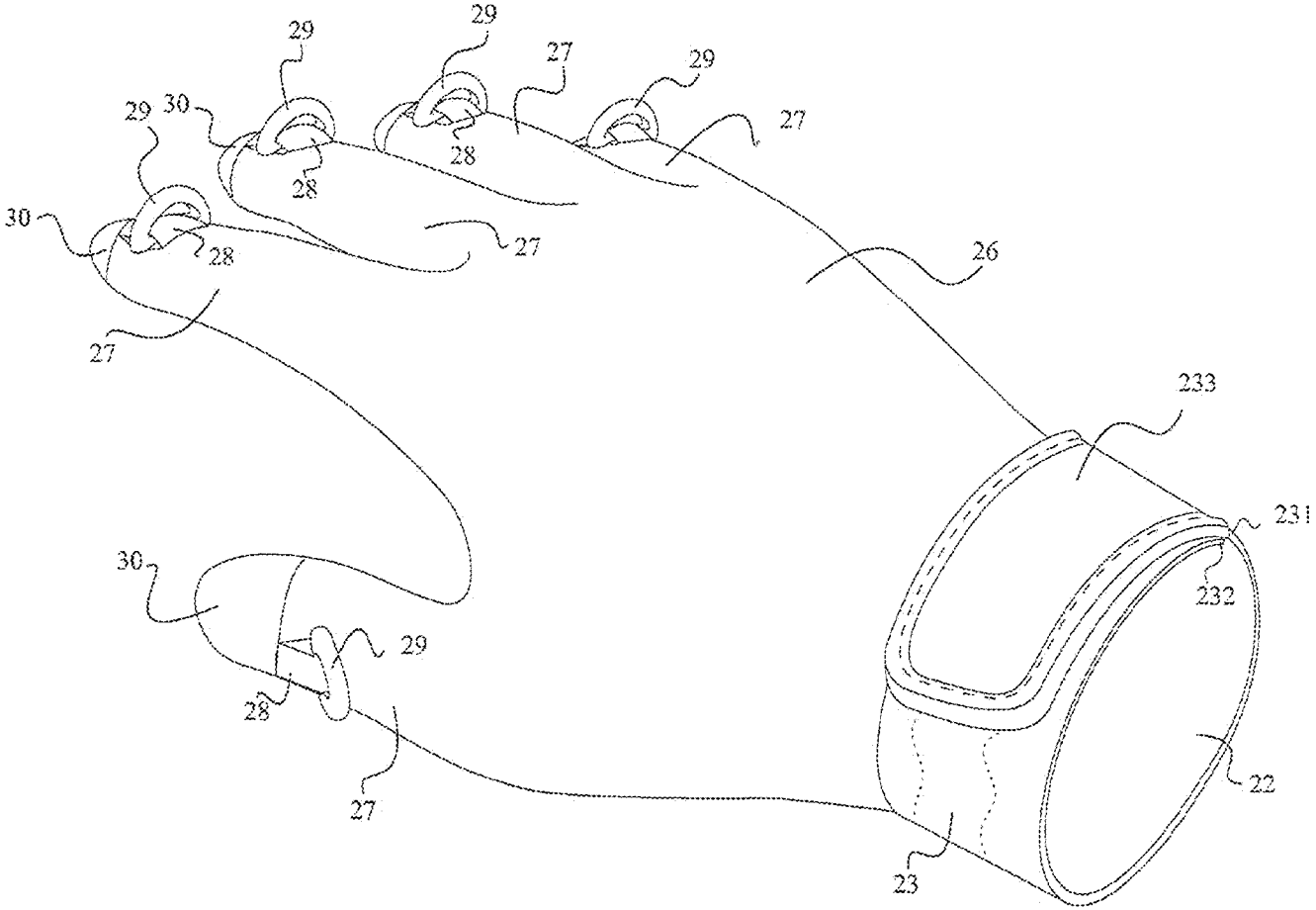
FIG. 5 is a rear view in perspective of yet another embodiment of a glove that can be worn in connection with a sports performance enhancement system.
Figure 6:
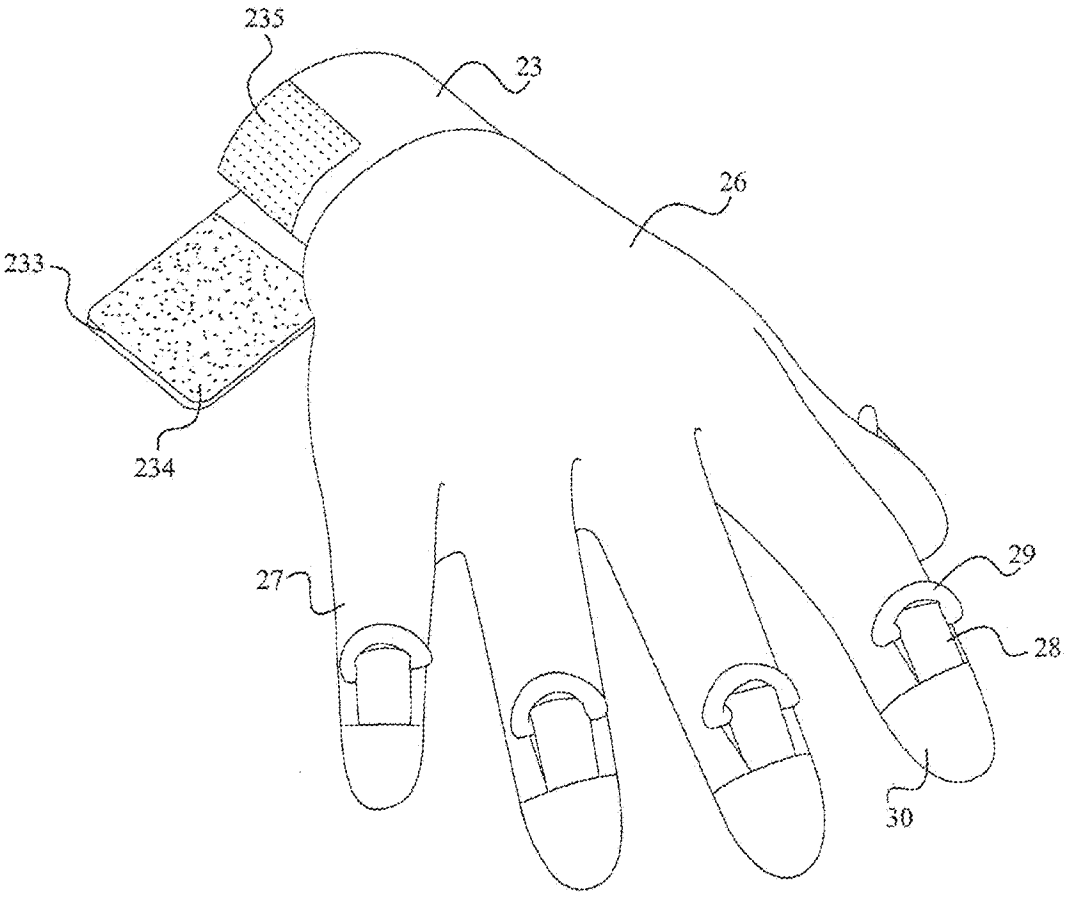
FIG. 6 is a front view in perspective of the glove in FIG. 5.

Referring to FIGS. 5 and 6, left glove 1 and right glove 2 in the third embodiment each comprises an inner glove 26, a plurality of fingertip connectors 28, a plurality of glove D-rings 29, and a fingertip connector cover 30. The inner glove 26 comprises the wrist opening 22, a plurality of finger sleeves 27, and wristband 23. The wristband 23 is connected to inner glove 26 from one end, and the plurality of finger sleeves 27 is positioned with inner glove 26 opposite from wristband 23. The inner glove 26 is made out of high strength stretchable fabric, and comprises the shape of a human hand. The wrist opening 22 is positioned within the wristband 23. When a user inserts a hand through the wrist opening 22 into the inner glove 26, the user's fingers traverse into the plurality of finger sleeves 27. The wristband 23 allows the user to adjust the comfort fit of the glove. The wristband 23 comprises first end 231, second end 232, adjustable wrist strap 233, glove loop fastener material 234, and glove hook fastener material 235. The adjustable wrist strap 233 is connected to the wristband 23 from the first end 231 and positioned on the outside surface of wristband 23. The glove hook fastener material 235 is connected to second end 232 from the outside surface of wristband 23. The glove loop fastener material 234 is positioned between adjustable wrist strap 233 and glove hook fastener material 235, and glove loop fastener material 234 is connected to adjustable wrist strap 233. Since the first end 231 and the second end 232 are attached together by glove hook fastener material 235 and glove loop fastener material 234, users can adjust the circumference of the wristband 23 by means of adjustable wrist strap 233. The plurality of fingertip connectors 28 is firmly connected with the plurality of finger sleeves 27 around the fingernails, and each of the plurality of glove D-rings 29 is pivotably connected with the plurality of fingertip connectors 28 from the free end. In the third embodiment, the plurality of glove D-rings 29 is positioned adjacent the fingernails of the user. The fingertip connector cover 30 is positioned over the plurality of fingertip connectors 28 and connected to the inner glove 26.

Figure 7:
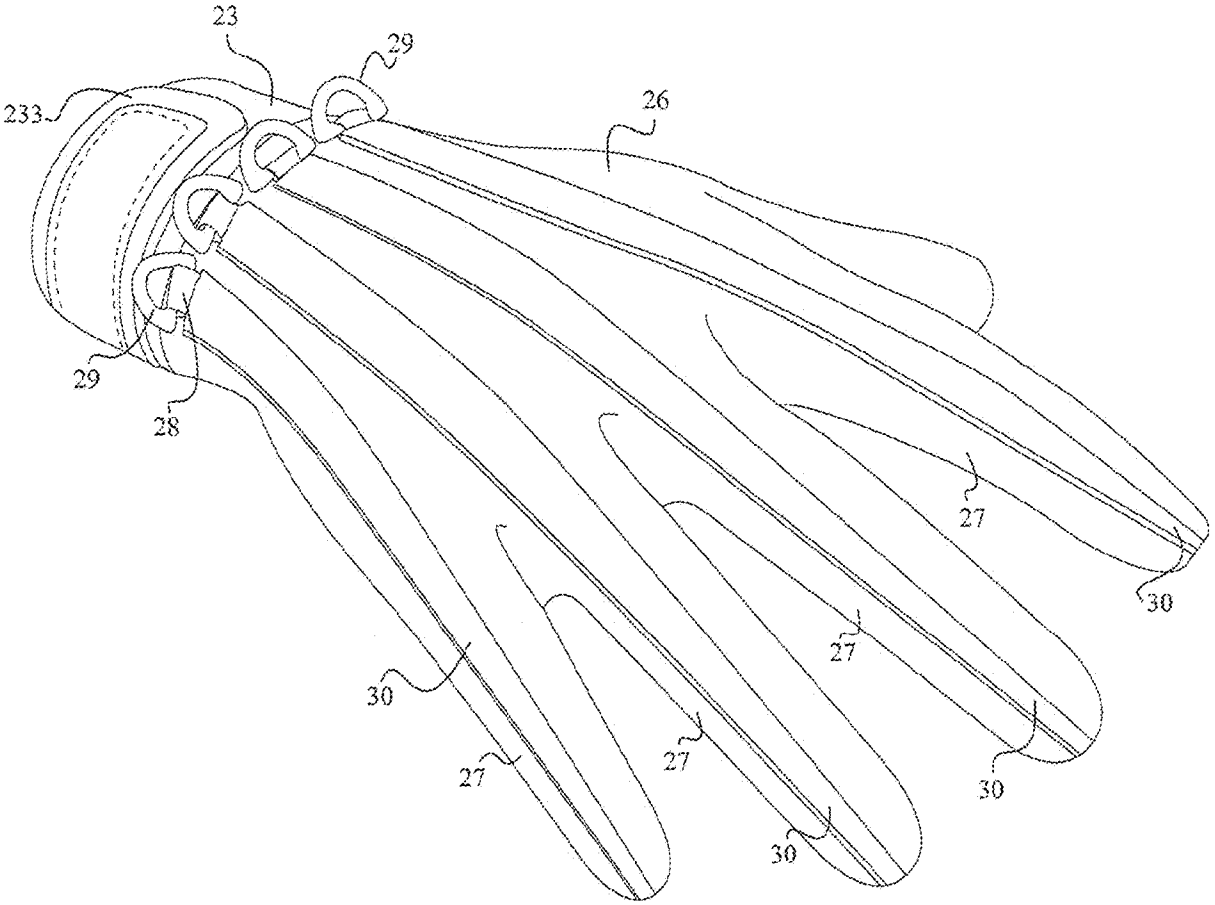
FIG. 7 is a front view in perspective of yet another embodiment of a glove that can be worn in connection with a sports performance enhancement system.
Figure 8:
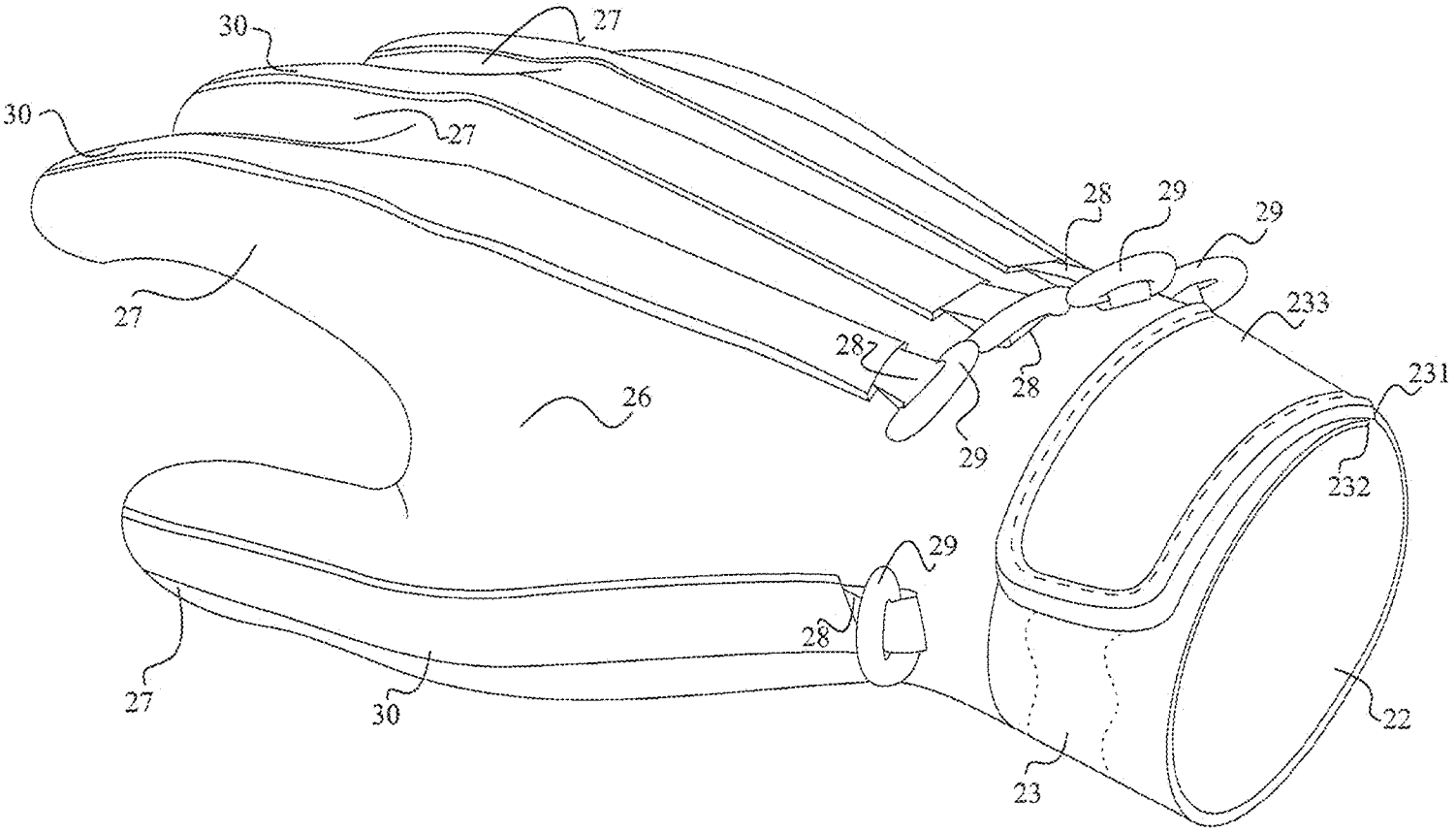
FIG. 8 is a rear view in perspective of the glove of FIG. 7.

In reference to FIGS. 7 and 8, left glove 1 and the right glove 2 in the fourth embodiment each comprises the inner glove 26, the plurality of fingertip connectors 28, the plurality of glove D-rings 29, and the fingertip connector cover 30. The inner glove 26 comprises wrist opening 22, the plurality of finger sleeves 27, and wristband 23. The wristband 23 is connected to inner glove 26 from one end, and the plurality of finger sleeves 27 is positioned with inner glove 26 opposite wristband 23. The inner glove 26 is made out of high strength stretchable fabric, and comprises the shape of a human hand. The wrist opening 22 is positioned within the wristband 23. When a user inserts a hand through wrist opening 22 into inner glove 26, the user's fingers traverse into the plurality of finger sleeves 27. The wristband 23 allows the user to adjust the comfort fit of the glove. The wristband 23 comprises the first end 231, the second end 232, adjustable wrist strap 233, glove loop fastener material 234, and glove hook fastener material 235. The adjustable wrist strap 233 is connected to wristband 23 from first end 231 and positioned on the outside surface of the wristband 23. The glove hook fastener material 235 is connected to the second end 232 from the outside surface of the wristband 23. The glove loop fastener material 234 is positioned between adjustable wrist strap 233 and glove hook fastener material 235, and glove loop fastener material 234 is connected to adjustable wrist strap 233. Since the first end 231 and second end 232 are attached together by the glove hook fastener material 235 and the glove loop fastener material 234, the user can adjust the circumference of the wristband 23 by means of adjustable wrist strap 233. The plurality of fingertip connectors 28 is firmly connected with the plurality of finger sleeves 27 around the finger nails, but extends toward the wrist of the user, and the plurality of glove D-rings 29 is pivotably connected with the plurality of fingertip connectors 28 from the free end. In the fourth embodiment, the plurality of glove D-rings 29 is positioned adjacent the wrist of the user. The fingertip connector cover 30 is positioned over the plurality of fingertip connectors 28 and connected to the inner glove 26. Since fingertip connector cover 30 is not connected to the plurality of fingertip connectors 28, the plurality of fingertip connectors 28 easily moves inside the connector cover while keeping the plurality of fingertip connectors 28 inline.

Figure 47:
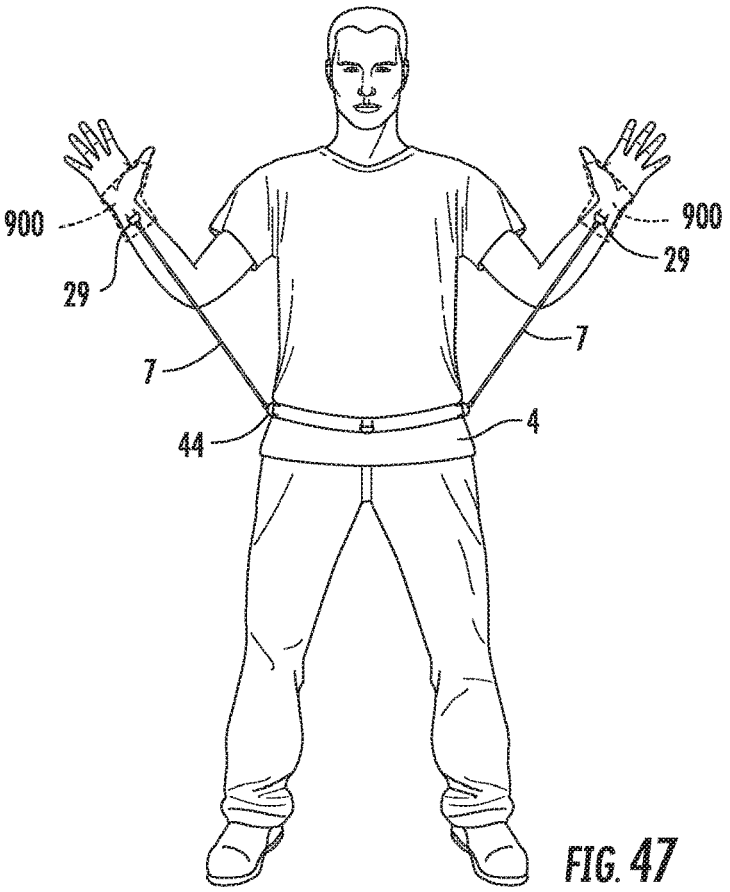
FIG. 47 is a front view of another embodiment of a sports performance enhancement system including a wrist brace being worn by a user.

With reference now to FIG. 47, in at least one embodiment, the physical training system includes a torso member connected to a hand member with elastic resistance bands 7. The torso member is provided in the form of a belt 4, and a hand member is provided in the form of a wrist brace 900. A plurality of connection rings 44 are attached to the belt 4, and at least one connection ring 29 is attached to each wrist brace 900. A resistance band 7 extends between one of the connection rings 44 on the belt 4 and one of the connection rings 29 on a wrist brace 900.

Figure 48:
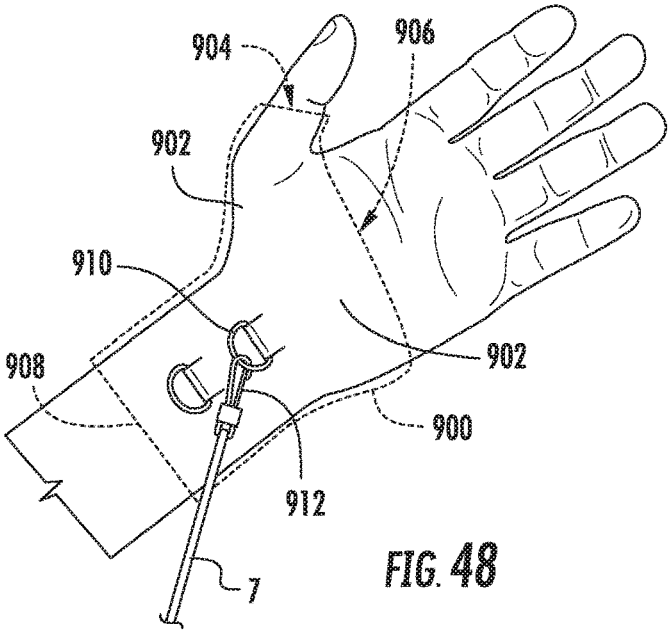
FIG. 48 is a palmar plan view of the wrist brace of FIG. 47.

FIG. 48 shows an enlarged version of the wrist brace 900 of FIG. 48. An outline of the wrist brace 900 is shown in dotted lines to illustrate the position of the wrist brace relative to the and of the user. The wrist brace 900 includes a flexible panel 902 defining a thumb opening 904, finger openings 906, and a wrist opening 908. The flexible panel 902 may be comprised of any suitable material such as elastane, neoprene, or any of various other materials. A wrist strap 910 is connected to the fabric panel with a connection ring 912 disposed on the strap 910. The elastic resistance band 7 is connected to the wrist brace 900 via the wrist strap 908 and connection ring 910.

While the hand member is described above in the form of a wrist brace 900, it will be appreciated that the hand member may also be provided in other forms. For example, the hand member may be a glove or glove-like member, such as that shown in FIGS. 3-8. In at least one embodiment, the hand member may be provided in the form of a hand panel, such as that shown in FIGS. 49 and 50.

Figure 49:
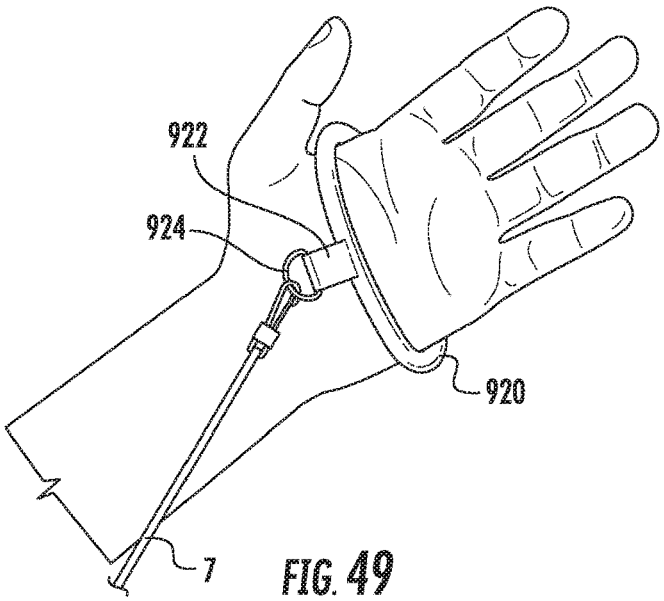
FIG. 49 is a palmer plan view of a hand strap as an alternative embodiment of the wrist brace of FIG. 48.

In the embodiment of FIG. 49, the hand panel is a palm panel 920 provided as a loop of material configured to receive the palm of the user's hand. The loop of material may be continuous and non-adjustable or may be provided with two ends that may be adjusted using some mechanism, such as a buckle or a hook- and loop connection arrangement. The palm panel 920 may be a flexible member comprised of a material that will be comfortable for the user to hold in his or her hand with a force applied thereto. For example, the palm panel 920 may be comprised of neoprene, nylon, cotton, or similar material. In at least one embodiment, the palm panel 920 is comprised of a synthetic rubber or other resilient polymer material. A flexible strap 922 is connected to the palm panel 920. The flexible strap 922 may be comprised of a nylon or other durable material. A connection ring 924 is disposed in the flexible strap 922 and configured to receive one of the connection bands 7, thus coupling the connection band to the palm panel 920. With this arrangement, the user's hands remain substantially unencumbered during training activities and able to perform routine motions, such as catching a ball.

Figure 50:
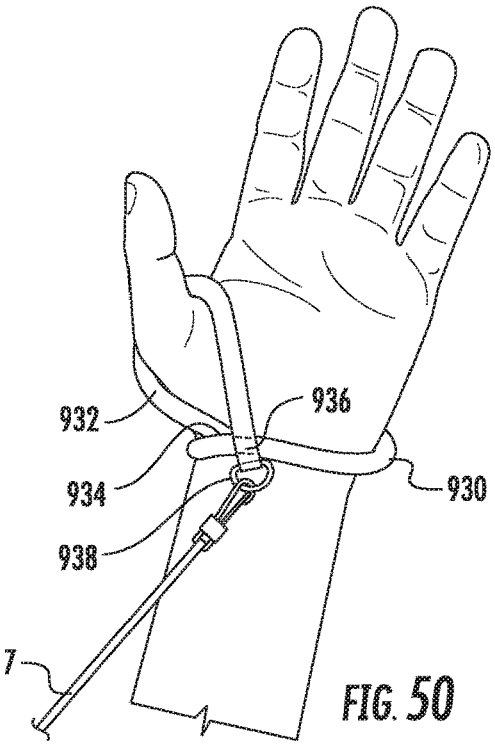
FIG. 50 is a palmer plan view of an alternative embodiment of the hand strap of FIG. 49.

With reference to FIG. 50, in at least one embodiment, the hand panel includes a wrist panel 930 and thumb panel 932. Each of the wrist panel 930 and the thumb panel 932 are provided as a loop of material connected at a junction 934. The wrist panel 930 is configured to extend around a user's wrist and the thumb panel 932 is configured to extend around the user's thumb and thumb pad of the user's hand. The loops of material for the wrist panel 930 and the thumb panel 932 may be continuous and non-adjustable or may be provided with two ends that may be adjusted using some mechanism, such as a buckle or a hook- and loop connection arrangement. The wrist panel 930 and thumb panel 932 may be a flexible member comprised of a material that will be comfortable for the user to hold in his or her hand with a force applied thereto. For example, the wrist panel 930 and thumb panel 932 may be comprised of neoprene, nylon, cotton, or similar material. In at least one embodiment, the wrist panel 930 and thumb panel 932 are comprised of a synthetic rubber or other resilient polymer material. A flexible strap 936 is connected to the junction 934 of the wrist panel 930 and thumb panel 932. The flexible strap 936 may be comprised of a nylon or other durable material. A connection ring 938 is disposed in the flexible strap 936 and configured to receive one of the connection bands 7, thus coupling the connection band to the hand panel. With the hand panel arrangements of FIGS. 49-50, the user's hands remain substantially unencumbered during training activities and able to perform routine motions, such as catching a ball.

Bands

Figure 11:
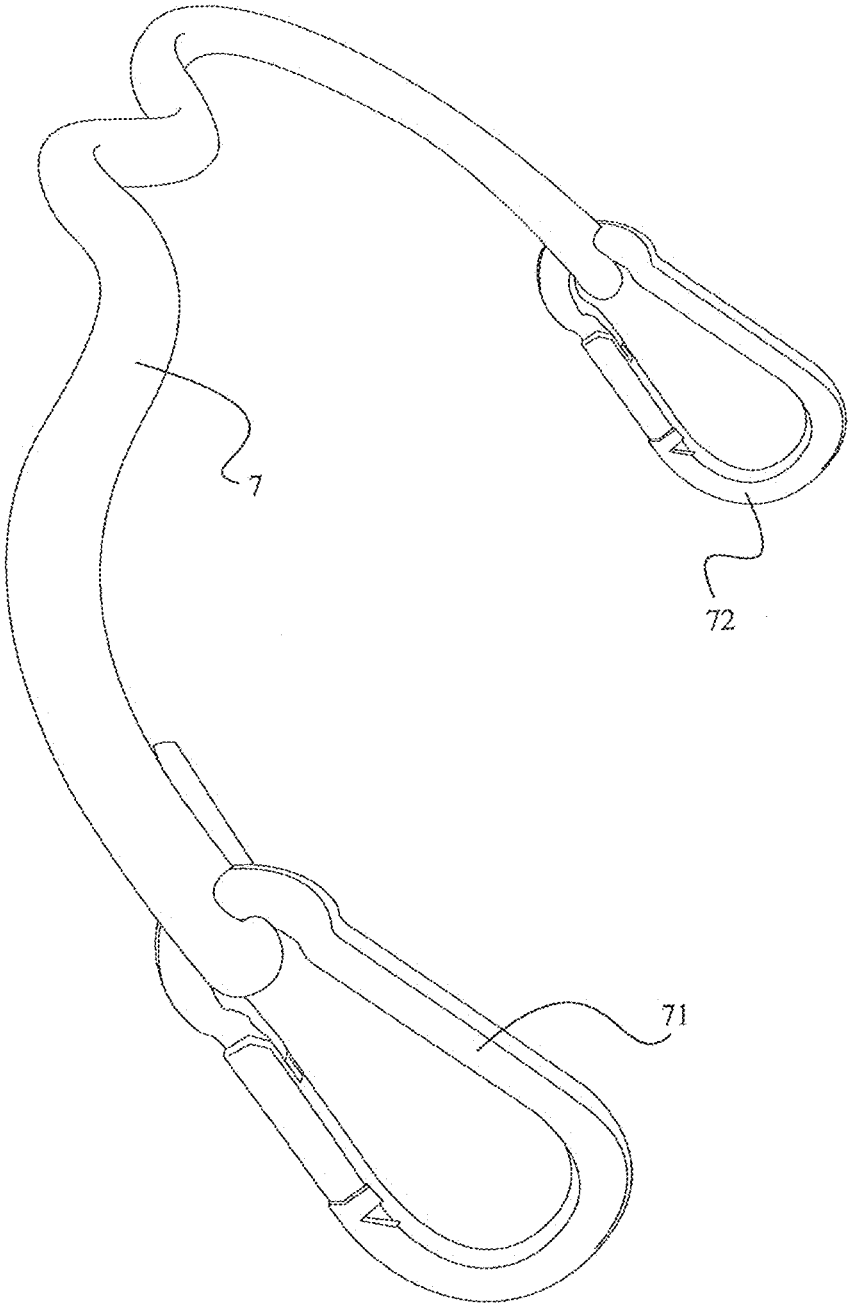
FIG. 11 is a view in perspective of a resistance band employed in a sports performance enhancement system.

Referring to FIG. 11, each of the plurality of resistance bands 7 comprises a first a second attachment clips 71 and 72. The first attachment clip 71 is connected to each of the plurality of resistance bands 7 from one end, and the second attachment clip 72 is connected to the each of the plurality of resistance bands 7 from the opposite end. The connections between the resistance bands 7 and their attachment clips 71, 72 may be a 360° rotatable swivel attachment or fixed attachments. The resistance bands 7 are made from elastically expandable materials such as rubber or a similarly elastic polymer. In at least one embodiment, the band material and configuration are chosen such that the band is able to stretch to approximately three times its quiescent (i.e., unstressed) length. The clips 71, 72 are made from lightweight and high strength metal or plastic materials. Attachment clips 71 and 72 have a movable (e.g., pivotable) rod, and may be biased to a closed position, which can be controlled by the user so that the plurality of resistance bands 7 can be attached to other system components, such as the glove 1, 2, belt 4, vest 3, left shoe 5, and right shoe 6. Thus, as illustrated in various embodiments described herein, the resistance bands 7 connect a torso member (e.g., a vest or a belt) to one of the limb members (e.g., gloves or an article of footwear).

In the embodiment of FIG. 17-19, the physical training system is shown with the gloves 1, 2 are attached to the vest 3 by the plurality of resistance bands 7. The first attachment clips 71 are attached to the glove D-ring 24 in the first and second embodiments or to the plurality of glove D-rings 29 in the third and fourth embodiments, and the second attachment clips 72 are attached to the plurality of vest rings 33. Additionally, the second attachment clips 72 can be attached to the plurality of vertical rings 43, the plurality of horizontal rings 44, the plurality of O-rings 64, and shoe D-ring 65. In the illustrated embodiment, shoes 5 and 6 are attached to the belt 4 by the plurality of resistance bands 7. The first attachment clips 71 are attached to the plurality of O-rings 64 and the shoe D-ring 65, and the second attachment clips 72 are respectively attached to the plurality of vertical rings 43 and the plurality of horizontal rings 44. Additionally, the second attachment clips 72 can be attached to the vest rings 33 and the glove D-ring 24 or the glove D-rings 29. Additionally, vest 3 can be attached to belt 4 by the plurality of resistance bands. The first attachment clips 71 are attached to the plurality of vest rings 33, and the second attachment clips 72 are attached to the vertical rings 43 and/or to the horizontal rings 44.

Since the attachment between the gloves 1, 2, belt 4, vest 3, left shoe 5, and right shoe 6 are implemented from the plurality of resistance bands 7, users can perform a variety of exercises while keeping their hands free from the tensioned system components of the sports performance enhancement system. The resistance level between each component attachment may be changed by the plurality of resistance bands 7. The plurality of resistance bands 7 may comprise different resistance level bands such as, soft bands, moderate bands, or hard bands, each providing a different degree of tension. Since more than one resistance band can be attached between the components, users can also attached multiple resistance bands in parallel for additional resistance.

Referring again to FIGS. 9, 11, 14 and 15 and the related description thereof, the attachment clips 71 and 72 of the resistance bands 7 may attach to the plurality of vertical rings 43 and the plurality of horizontal rings 44 on the front of the belt 4, the plurality of O-rings 64 and the shoe D-ring 65 through one of the following manners:

One resistance band 7 can be connected with attachment clip 71 to the plurality of O-rings 64 on the left shoe, and then run up and through the plurality of vertical rings 43 and back down to the right shoe, attaching with the second attachment clip 72 to one of the plurality of O-rings 64.

Alternatively, one resistance band 7 may attach to the plurality of vertical rings 43 with the clips 71 and the other end of the same resistance band 7 may attach to the right shoe using the second attachments 72 on one of the plurality of O-rings 64. Another resistance band 7 of the same length would then attach to the plurality of vertical rings 43 with the first attachment clips 71 and the other end of the same resistance band 7 would attach to the left shoe using the second attachments 72 on one of the plurality of O-rings 64.

As yet another alternative, one resistance band 7 may attach to the horizontal rings 44 on the right side with the first attachment clips 71 and the other end of the same resistance band 7 would attach to the right shoe using the second attachments 72 on one of the plurality of O-rings 64. Another resistance band 7 of the same length would attach to the horizontal rings 44 on the left side with the first attachment clips 71 and the other end of the same resistance band 7 would attach to the left shoe using the second attachments 72 on one of the plurality of O-rings 64.

The resistance bands 7 may attach with the attachment clips 71 and 72 to the plurality of horizontal rings on the back of the belt 4 or to the plurality of vertical rings 48 on the back of the belt, and the shoe D-ring 65 through one of the following manners:

One resistance band 7 may be connected with the first attachment clip 71 to the shoe D-ring 65 on the left shoe, and then running up and through plurality of vertical rings 48 and back down to the right shoe, attaching with the second attachment clip 72 to the shoe D-ring.

Alternatively, one resistance band 7 may attach to the plurality of vertical rings 48 with the first attachment clips 71 and the other end of the same resistance band 7 would attach to the left shoe using the second attachments 72 on the shoe D-ring 65, and another resistance band 7 of the same length would attach to the plurality of vertical rings 48 with the first attachment clips 71 and the other end of the same resistance band 7 would attach to the right shoe using the second attachments 72 on the shoe D-ring 65.

As a further alternative, one resistance band 7 may attach to the horizontal rings on the right-rear side of the belt 4 with the first attachment clips 71 and the other end of the same resistance band 7 attaches to the right shoe using the second attachments 72 on the shoe D-ring 65. Another resistance band 7 of the same length attaches to the horizontal rings on the left-rear side of the belt 4 with the first attachment clips 71 and the other end of the same resistance band 7 attaches to the left shoe using the second attachments 72 on the shoe D-ring 65.

Exemplary embodiments of multiple band attachment configurations may be seen in FIGS. 17-19 and 23A-25 of the accompanying drawings. The inverted "V" shape of bands shown in several of these embodiments is created by the single front and back band configuration. This inverted "V" shape provides at least two advantages:

First, the single band inverted "V" configuration meets approximately at the navel position on the front and in the center of the lower back on the back, and attaches in the middle of the upper foot on the front and the middle of the rear of the shoe on the back. The shape of the band in this configuration closely mimics the lower-body's natural physiology. Therefore, when this system is being used, the user's natural body movements are not inhibited by the bands.

Second, because the top of the inverted "V" configuration on the front is located approximately at the navel and then the resistance bands extend down to approximately the center of the foot, the resistance bands remain inwardly disposed along the user's legs and knees during use. This is a significant element of this embodiment of the system because it allows the user's legs to move freely in any direction, even at top speed, without the bands inhibiting movement by contacting the knee or crossing over to the outside of the knee. Without this unique feature, natural and full speed movement would be disrupted.

Figure 23A:
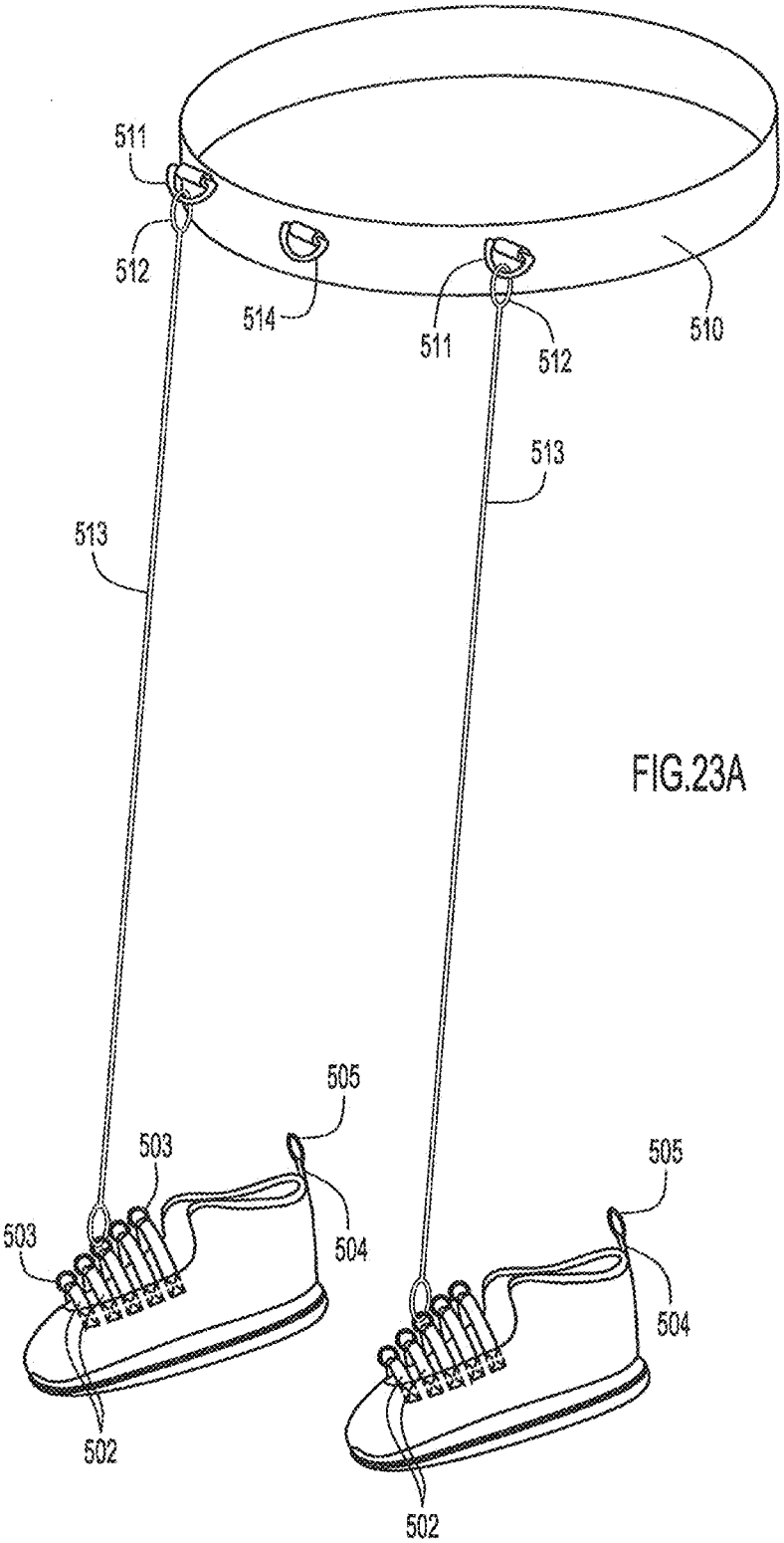
FIG. 23A is a front view in perspective of another embodiment of a belt that can be worn in connection with the sports performance enhancement system showing a first attachment arrangement of resistance bands to a shoe or shoe bed insert.

Notwithstanding the advantages presented by the inverted "V" shape created by the single front and back band configuration, it will be recognized that other band configurations are also advantageous. For example, the inverted "V" shape created by dual front bands, as shown in FIG. 23A, (or dual back bands). The dual band configuration also has advantages including the advantage of limiting wear on the band as it slips in the ring.

As noted, the resistance bands 7, for use in both front and back in the system, may be provided in at least three different lengths at each resistance tension, depending on the user's height. Having three lengths of bands at each tension level accommodates short, medium and tall users of the device. In this regard, users have different lengths to choose from. If there were only one length, which for example, was made for a person of average height, then the system would work optimally for an average height person, but not for a short or tall person. For a short person there would be too much slack in the bands, reducing the amount of resistance throughout the full range of motion, limiting the effectiveness of the system. The additional slack could also prove troublesome if the extra slack caused the bands to interfere with the natural motion of the legs. For a tall person, there would be too much tension in the bands in a stationary position, as well as throughout the full range of motion. This situation could cause excessive resistance, especially at full extension, limiting the user's full range of motion and adversely affecting proper technique. Since the bands should not be stretched more than three times their original length without the risk of breaking, a single band length increases the risk of band breakage in taller people. When sold to consumers the product may be provided with a single band of a respective specified length for short, tall or average size persons; alternatively, it may be sold in a kit with different lengths bands.

In addition to multiple band lengths for people of different heights, there may also be different band lengths for the front and rear sides side of the system, as indicated in the following table.

TABLE 1

| HEIGHT RANGE OF USER | FRONT BAND LENGTH (+/−15%) | REAR BAND LENGTH (+/−15%) |
|---|---|---|
| 5' to 5.5' | 20 inches | 26 inches |
| 5.5' to 6' | 24 inches | 30 inches |
| 6' to 6.5' | 28 inches | 34 inches |
| 6.5' to 7' | 32 inches | 38 inches |

The front and rear bands have different lengths for several reasons, but primarily the because during running strides or other leg extension exercises the maximum distance between the rear belt ring and the rear shoe connection ring is greater that the distance between the front belt connection ring and the front shoe connection rings. Thus, the rear bands should be slightly longer than the front bands. The bands are provided in a set of front and rear bands for the end user based on his/her height. While exemplary lengths for the resistance bands are provided above, it will be recognized that the bands may be provided in any of various lengths and sizes. The length of a band may depend on any of various factors, such as, height of the wearer, inseam of the wearer, the components connected by the band, the rings connected by a band and the location of such rings on the system, the number of bands hooked to a given ring, the elasticity of the band, as well as any number of additional factors.

While the embodiments herein illustrate several exemplary configurations for the bands, it will be recognized that numerous additional configurations are possible. For example, with reference to FIG. 17, in at least one alternative embodiment an elastic resistance band may be connected between the left shoe 5 and the right shoe 6 without engaging the torso member (or with reference to FIG. 23B, an additional band 513 may be provided directly between the connection rings 503 on the straps 502 of the two shoes). The length of this elastic resistance band extending between two articles of footwear may be significantly shorter than the bands that connect each article of footwear to the torso member. Such a band connecting two articles of footwear without engaging a torso member may provide advantageous training exercises for the user depending on the muscles to be targeted during a training regime.

While all of the elastic resistance bands in the foregoing embodiments connect two or more components worn by the user, in at least one embodiment, the elastic resistance bands connect a single component worn by the user to a fixed location such as a post or a wall. For example, in at least one embodiment of the physical training system, the user connects one end of a band to a connection ring fixed to a location on a wall or floor, and connects another end of the band to his or her body via a limb accessory (e.g., an article of footwear, glove, etc.) or a torso member (e.g., a vest, belt, etc.). In this manner, the user may perform exercises by moving his or her body relative to the fixed location, and thereby targeting specific muscles for exercise that are more difficult to target when the bands are connected only to components worn on the body (e.g., targeting an abductor muscle may be easier with one end of the band fixed to a wall).

Articles of Footwear in Alternative Embodiments

Instead of the specially designed shoe illustrated in FIGS. 9 and 10, the physical training system may be designed with alternative embodiments of article of footwear other than a shoe. While many of these embodiments of an article of footwear may be configured for use with a shoe, not all embodiments require the use of a shoe. Examples of these alternative embodiments of the article of footwear are disclosed below with reference to FIGS. 20-21, 26-29 and 36-46.

Shoe Bed Insert Embodiment

In at least one embodiment, the article of footwear comprises a shoe bed insert (which may also be referred to herein as a "foot bed insert"). The shoe bed insert permits the sports performance enhancement system to be utilized with substantially any conventional shoe. Specifically referring to FIGS. 20 and 21, a shoe-bed insert 501 comprises any number of types of removable shoe beds or sole inserts which may be inserted into a shoe either on the existing shoe insole or in place of the insole. The shoe bed insert 501 may be provided in multiple sizes to, respectively, fit all shoe sizes, or in a more limited number of sizes such that the insert can be cut down by the end user to the appropriate desired size. Attached to the shoe bed is one or more transversely extending front straps 502 with attachment points on the side of or beneath the shoe bed unit. As described above in connection with the straps on the shoes, the straps 502 may be continuous loops embedded in the insert 501. Encircling each front strap 502 is a respective ring 503 through which the front straps extend. The rings 503 may be connected to the strap to merely wobble freely from side to side at one location on their respective straps 2, but in at least one embodiment are free to traverse the straps along substantially the entire width of the user's foot in the same manner described above for rings 64 and straps 63 a shoe. On the heel of the shoe bed insert there is attached a rear strap 504 which extends upward along the center of the back of the insert 501 to approximately the top of the shoe opening into which the foot bed is inserted. Attached to rear strap 504, in at least one embodiment at the distal end of the strap, is a rear ring 505. In this configuration the shoe bed 502, front straps 502, rings 503, rear strap 504 and rear ring 505 are inserted into the shoe with the tongue of the shoe positioned above the shoe bed and below the front straps, allowing the shoe bed insert to rest appropriately inside the shoe. The front straps 502 and rings 503 are located between the shoelaces and extend above the shoe and rear strap 504, whereby ring 505 protrudes out from the top of the back of the shoe.

The foot bed insert with straps and rings allows the user to take advantage of the system using his/her own shoes as opposed to the specially configured shoe of FIG. 9. The strap and ring configurations remain similar to those on the shoes and provide the same benefits. Those benefits include, but are not limited to:

Engagement of the foot in the system—By attaching the resistance bands to the foot, the foot joints and muscles, crucial components of any sport-specific movements, speed and agility, are incorporated into the resistance workout.

By having an attachment point over the longitudinal center line of the foot, as opposed to on the interior or exterior of the foot, the insert keeps the resistance bands/straps from unnaturally pulling the foot to the inside or outside, respectively. Instead, the center attachment point allows resistance to be provided in an anatomically correct manner, allowing the user to maintain proper technique during workouts.

By allowing the rings to move freely from side to side over the straps, the user may move freely and naturally without disproportionate resistance being applied to the foot. The freely moving rings allow uniform and directionally natural resistance to be applied to the foot throughout a full range of movement, maximizing the effectiveness of sport-specific neuromuscular conditioning.

Figure 23B:
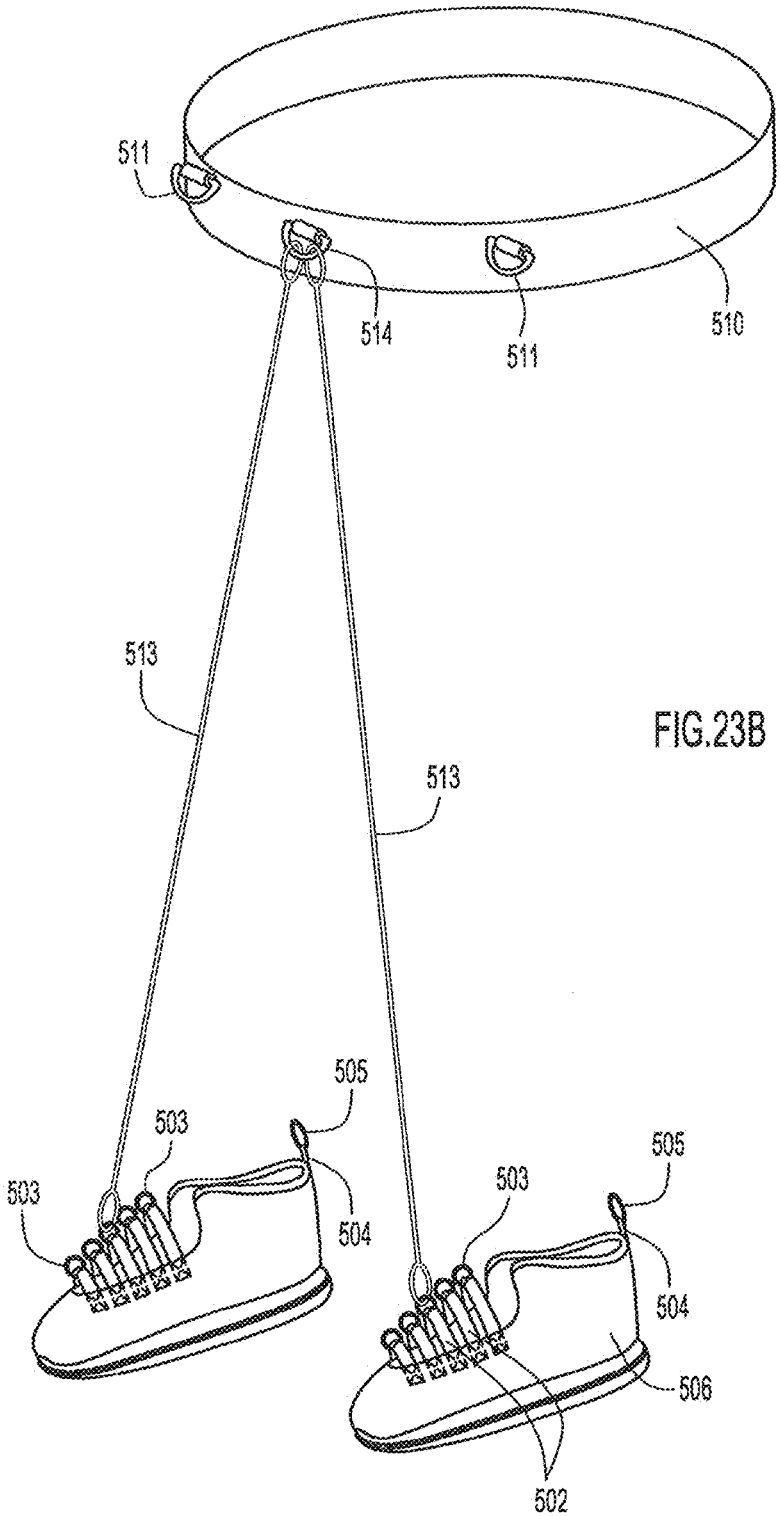
FIG. 23B is a front view in perspective of another embodiment of a belt that can be worn in connection with the sports performance enhancement system showing a second attachment arrangement of resistance bands to a shoe or shoe bed insert.

As shown in FIGS. 23A and 23B, resilient resistance bands 513 can be attached between respective shoes or inserts and the system belt, either at a common ring centered on the belt or at respective rings on each side of center. Referring specifically to FIG. 23A, there is illustrated a belt 510 similar in structure and function to belt 4 described in relation to the system of FIG. 18 and more specifically in relation to FIGS. 13 and 14. Belt 504 has attached thereto a center ring 514 disposed at the front of the belt and two side rings 511 disposed on opposite sides of ring 514. In various embodiments, each of rings 511 and 514 is a D-ring mounted on the belt so as to be freely pivotable about respective horizontal axes (i.e., axes parallel to the belt length). However, it will be recognized that the rings may also be provided in other forms, such as O-rings or any of various other types of rings. A pair of longitudinally elastic resistance bands 513 is shown in FIG. 23A secured between respective side rings 511 and a selected ring 503 on a respective shoe or foot bed insert 506. The attachment means 512 at the ends of the resistance bands may be any conventional means such as clips 71, 72 described in relation to FIG. 11. Alternatively, and referring to FIG. 23B, the bands 513 may both be attached to the center ring 514. As a further alternative, it is to be understood that the side rings 511 may be positioned very close to or at the center of the belt so that the resistance bands can extend from the belt center but from separated rings.

There are further advantages to the foot bed insert. By attaching the front straps to a foot bed insert positioned underneath the foot (as opposed to an attachment which is not secured to an element underneath the foot), the integration of the foot into the resistance system is maximized, providing for a very efficient workout. By connecting the straps to an element underneath the foot, the foot and leg muscles are subjected to resistance, both when the foot is lifted off the ground and when the foot is placed back down on the ground, in a most efficient manner because constant pressure is being applied beneath the foot.

Figure 24:
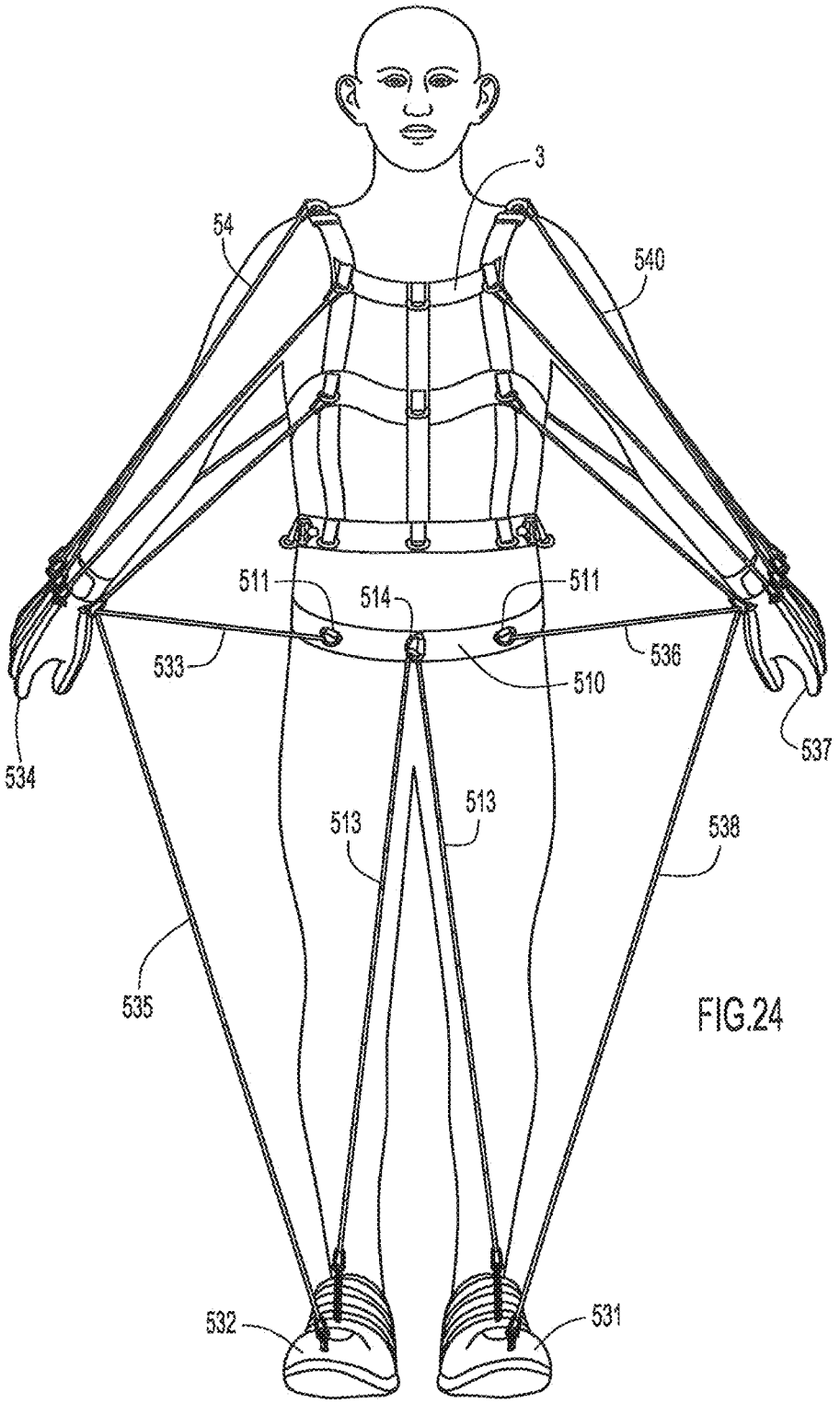
FIG. 24 is a front view of another embodiment of the sports performance enhancement system being worn by a user.
Figure 25:
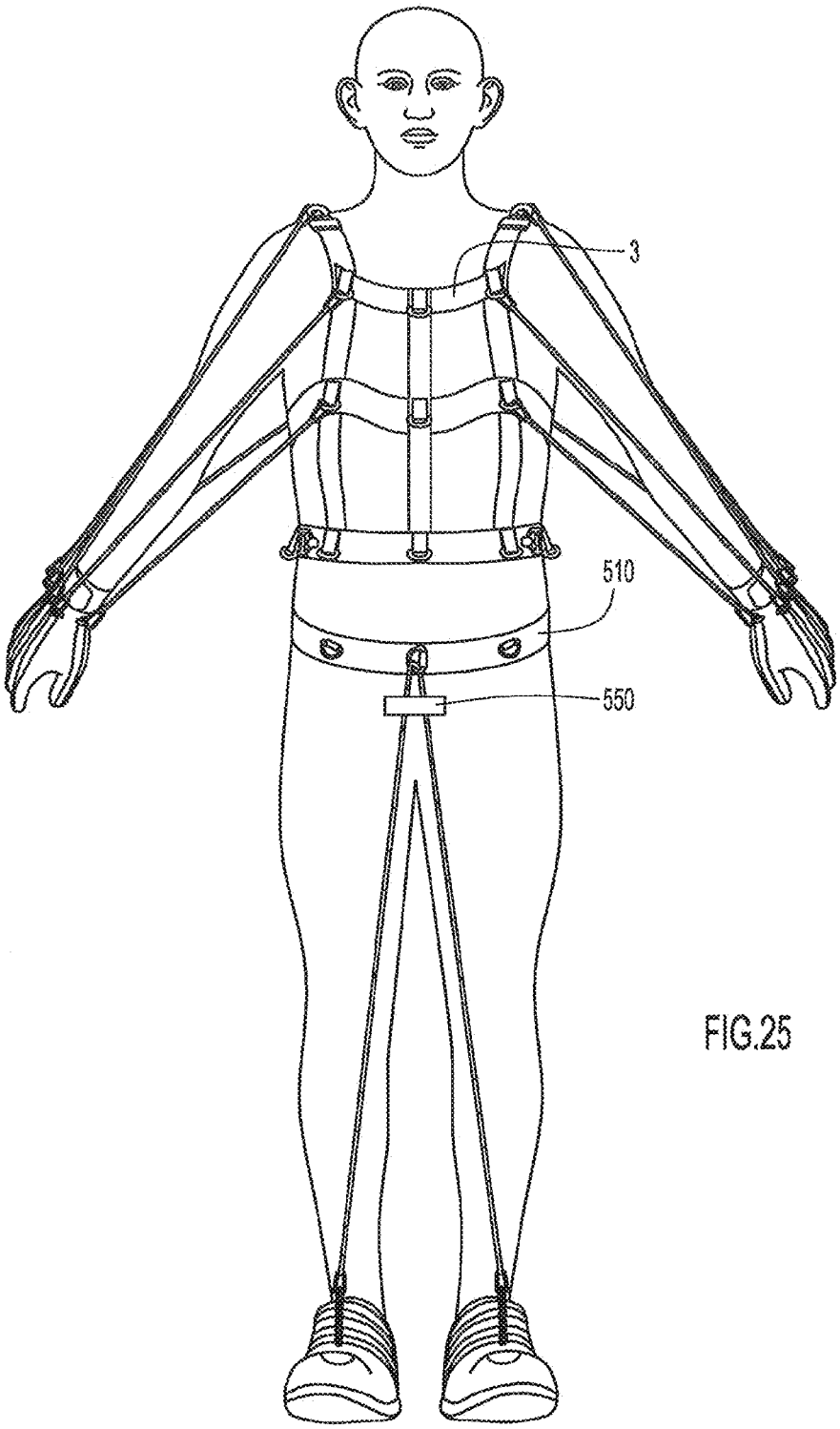
FIG. 25 is a front view of the system of FIG. 24 with the addition of a band stabilizing member.

Referring to FIG. 24, the belt 510 in FIG. 23B is shown incorporated into the sports performance enhancement system whereby resistance bands 513 extend between the center ring 514 on the belt to selected rings on either a shoe or a foot bed insert 531, 532, as desired by the user. The side rings 511 are connected by respective resistance bands 533, 536 to respective gloves 534, 537 which may take the form of any of the glove embodiments described and illustrated herein. The belt thusly serves as the anchor for resistance bands connected to each of the hands and feet of the user. This is in addition, of course, to the anchoring function served by vest 539 which, as illustrated in FIG. 24, is connected at various levels of the vest to the gloves 534, 537 via several additional resistance bands 540, 541, etc.

Figure 22:
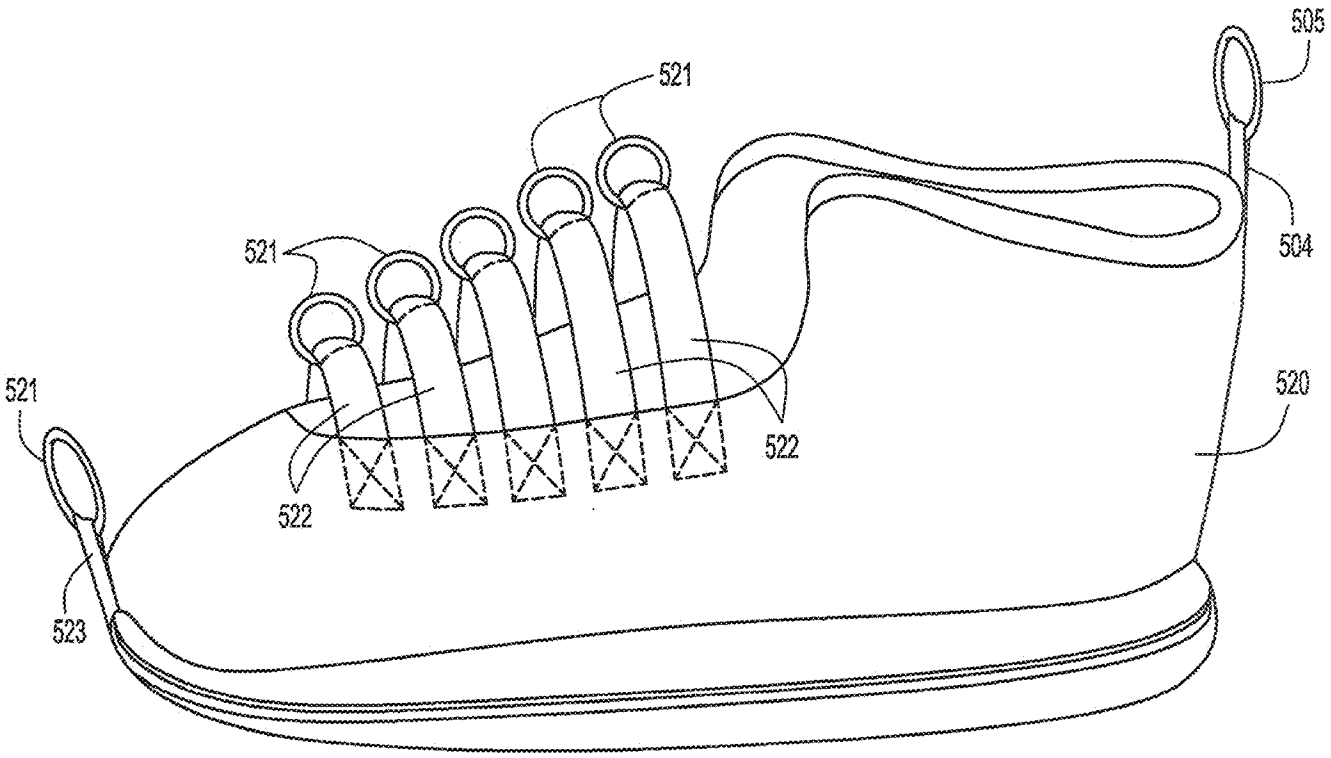
FIG. 22 is a view in perspective of another embodiment of a shoe that can be worn in connection with the sports performance enhancement system.

In the embodiments described above, the rings on the front straps of the shoes or foot bed inserts may not be affixed to the straps; that is, the rings may slide loosely along the straps. This allows for excellent resistance, assuring that the resistance bands self-adjust positionally with the direction of the tension force applied through the resistance band, and are properly positioned and engaged during the entire exercise session. However, it is also possible to secure the straps to the rings to preclude relative movement therebetween and still provide for advantageous resistance effects. Specifically, and referring to FIG. 22 of the accompanying drawings, the rings 521 can be fixed to any one or more points of each strap 522 by stitching, industrial strength glue, etc. In addition, or alternatively, the front portion of the shoes may have one or more tabs 523 affixed thereto with one or more rings 521 secured to the tabs. This provides for improved force concentration on the front part of the shoe. When an athlete trains with this configuration he/she will have resistance concentrated on the front part of his/her feet. When running at full speed, orientation of the front portion of the foot at ground contact is significant, and this embodiment provides a more specific way to train for this type of action. It should be understood that this affixed ring embodiment may apply to all types of footwear articles described herein, including but not limited to shoes, socks, and foot bed inserts, including the over-the-shoe-sock with mesh bottom embodiment and related embodiments.

Sock Embodiment

Figure 26:
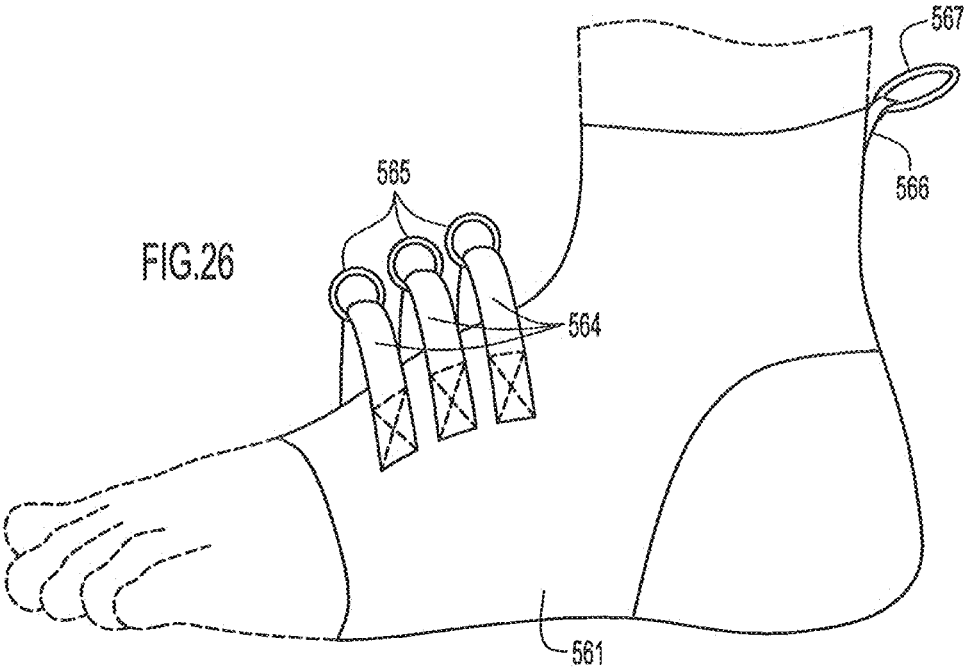
FIG. 26 is a side view in perspective of a sock including an ankle brace that can be worn in connection with a sports performance enhancement system.
Figure 27:
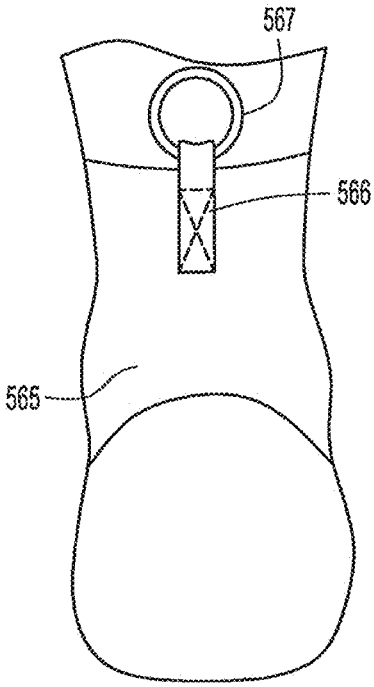
FIG. 27 is rear view of the sock and ankle brace of FIG. 26.
Figure 28:
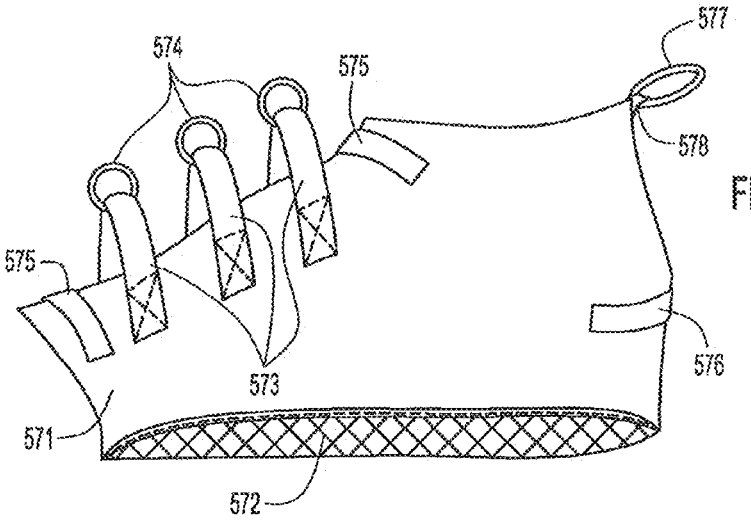
FIG. 28 is a side view of a sock adapted to be worn over a cleated shoe in the sports performance enhancement system.
Figure 29:
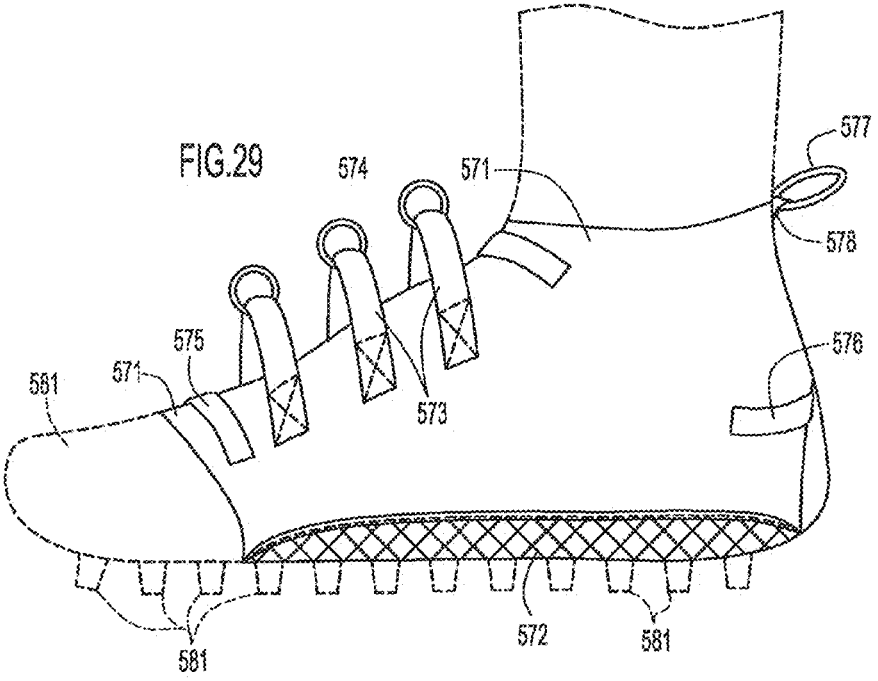
FIG. 29 is side view of the sock of FIG. 28 as worn over a cleated shoe.

Referring to FIGS. 26 and 27 of the accompanying drawings, an article of footwear is provided in the form of a sock 561 including various components attached thereto. The term "sock" as used herein refers to an article of footwear substantially comprised of a flexible material configured to receive and cover at least a portion of a foot of a wearer, the article of footwear not including an outsole. It will be recognized that a sock may be worn with or without a shoe, and if worn with a shoe, may be worn inside of the shoe (with the shoe substantially covering the sock) or outside of the shoe (with the sock substantially covering the shoe). A sock may be provided in any of various forms, and may cover any of various portions of the human foot. For example, a sock may be provided as a fabric article to be worn inside of a shoe or may include different or additional functions, such as serving as an ankle brace. A sock may cover the entire human foot, or may only cover selective portions of the human foot such as a region extending from the ankle to the plantar side of the human foot without covering the toes or heel of the foot. A sock may be configured to closely adhere to portions of the human foot and conform thereto (e.g., as shown in FIGS. 26-27 and 36-37) or only loosely extend over portions of the human foot without conforming to the shape of the human foot (e.g., as shown in FIGS. 28-29 with the sock covering a shoe). A sock may be comprised of any of various materials including natural and synthetic materials and resilient or non-resilient materials. Examples of such materials include cotton, polyester, nylon, elastane, neoprene, polymers, leather, and any of various other materials. While a sock does not include an outsole, the sock may include various materials on the plantar side of the sock that may contact the ground when the user is not wearing a shoe and provide advantageous features for the wearer depending on the intended use of the sock, such as portions of resilient material that provide gripping features or other advantageous features for the sock.

With reference now to the embodiment of FIGS. 26 and 27, the sock 561 has front and rear openings and a top opening. The article of footwear further comprises front straps 564, front rings 565, rear strap 566, and a rear ring 567 all coupled to the sock 561. The sock 561 can be made from any type of flexible fabric or other removable material which would be placed over the foot and/or ankle. The top opening as well as the front and rear openings of the sock 561 allows for easy placement of the unit over the user's ankle such that the ankle and the rest of the leg protrude from the top opening of the sock, the user's heel protrudes from the rear opening, and the ball of user's foot protrudes from the front opening.

Attached to the sock 561 are one or more front straps 564 with attachment points on the side of or beneath the unit. Attached to each front strap are one or more rings 565 through which the front straps extend such that the rings can move freely from side to side along the straps. On the heel side of the sock is attached a rear strap 566 which extends up along the center of the back of the unit to approximately the top of the sock. Attached to the rear strap 566 are one or more rings 567. In the configuration described above, the sock 561 is placed around the foot and ankle and the user then puts on his/her own shoe. The front straps 564 and rings 565 then reside above the tongue of the shoe (if any) and extend between the shoe's laces and above the shoe. The rear strap 566 and ring 567 protrude out from the top of the back of the shoe. In order for the user to arrange the sock 561 in this manner, the tongue of the shoe is threaded through the straps with the tongue interposed between the sock 561 and the straps on the dorsal side of the sock 561.

The flexible article of footwear including a sock 561 with straps and rings allows the user to take advantage of the system using his/her own shoes as opposed to shoes specially constructed for use with the system. The strap and ring configurations remain similar to those on the shoes described above and provide the same benefits which include, but are not limited to:

Engagement of the foot in the system.

By attaching the resistance bands to the foot, the foot joints and muscles, crucial components of any sport-specific movements, speed and agility, are incorporated into the resistance workout.

By having an attachment point over the center of the foot, as opposed to on the interior or exterior of the foot, keeps the resistance from unnaturally pulling the foot to the inside or outside, respectfully. Instead, the center attachment point allows resistance to be provided in an anatomically correct manner, allowing the user to maintain proper technique during workouts.

By allowing the rings to move freely from side to side over the straps, the user may move freely and naturally without disproportionate resistance being applied to the foot. The freely moving rings allow uniform and directionally natural resistance to be applied to the foot throughout a full range of movement, maximizing the effectiveness of sport-specific neuromuscular conditioning.

Over-the-Shoe Sock Embodiment

In at least one embodiment, the flexible article of footwear may be provided as an over-the-shoe sock 571 (which may also be referred to as a "spat") as illustrated in FIGS. 28 and 29 to which reference is now made. In the disclosed embodiment, the sock has a mesh bottom 572, one or more front straps 573, one rear strap 578, one or more front secure straps 575, a rear secure strap 576, one or more securing mechanisms such as Velcro, buckles, buttons, etc., one or more rings 574, and a rear ring 577. This unit is designed to be worn and fit over any cleated shoe such as used for football, soccer, lacrosse, etc. Unit 571 is constructed in a way that the mesh bottom 572 has interstices at spaced locations that allow the cleats to protrude through. The entire system is secured by one or more securing mechanisms such as Velcro, buckles, buttons, etc., which can be at the front and/or the rear of the unit. The unit also has one or more front straps 575 and one rear strap 578. Each of the front straps is encircled by a respective ring 574; the rear strap is encircled by ring 577. The front rings 574 are not affixed to their respective rings and are, therefore, free to slide from side to side. This allows the user to have the resistance move in a lateral fashion with him/her during workouts. Rings 574, 577 can be configured in any shape to provide the best connection configuration for the entire system. In this regard, all of the connection rings used in the system may be constructed in any shape suitable for their described function; these include but are not limited to: O-rings, D-rings, regular or irregular polygonal rings, etc. Alternatively, some or all of the rings may be replaced by manually actionable clips.

The advantages of the over-the-shoe sock with mesh bottom include allowing the user to take advantage of the system using his/her own cleated shoes as opposed to the having a special cleated shoe designed for the system. The mesh bottom allows the user's cleats to protrude through the unit 571. The strap and ring configurations remain similar to those on the shoes disclosed in application above.

Sock with Mounting Pad Embodiment

Figure 36:
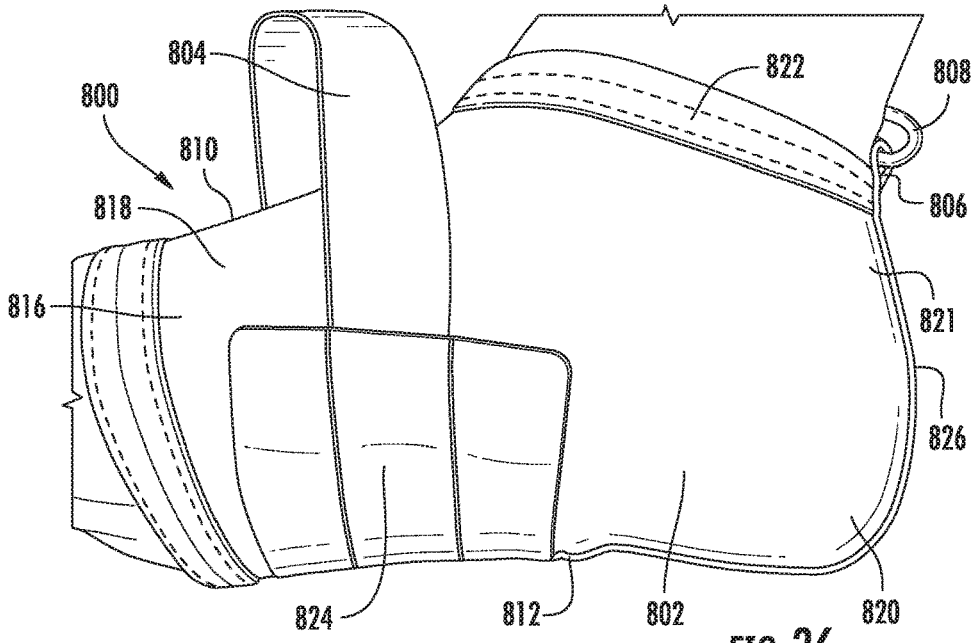
FIG. 36 is plantar side perspective view of a sock configured for use with the sports performance enhancement system of FIG. 17.
Figure 37:
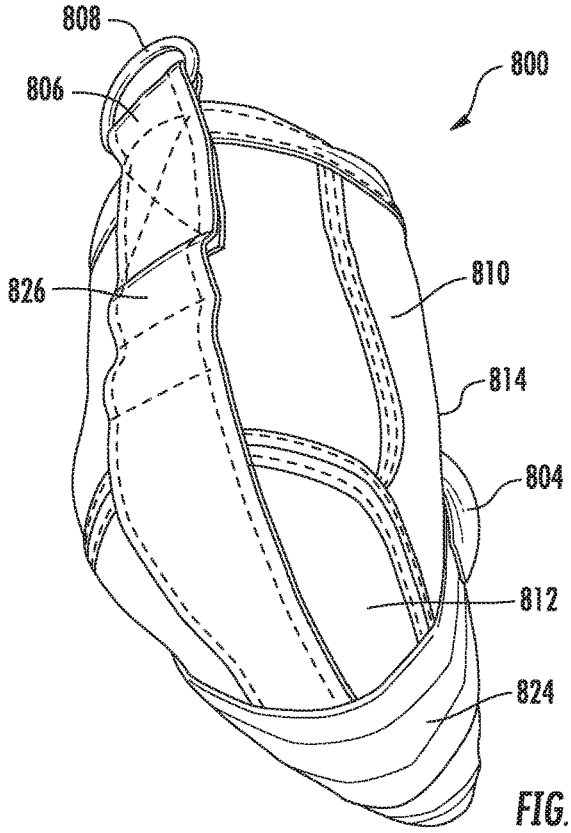
FIG. 37 is a posterior perspective view of the sock of FIG. 36.
Figure 38:
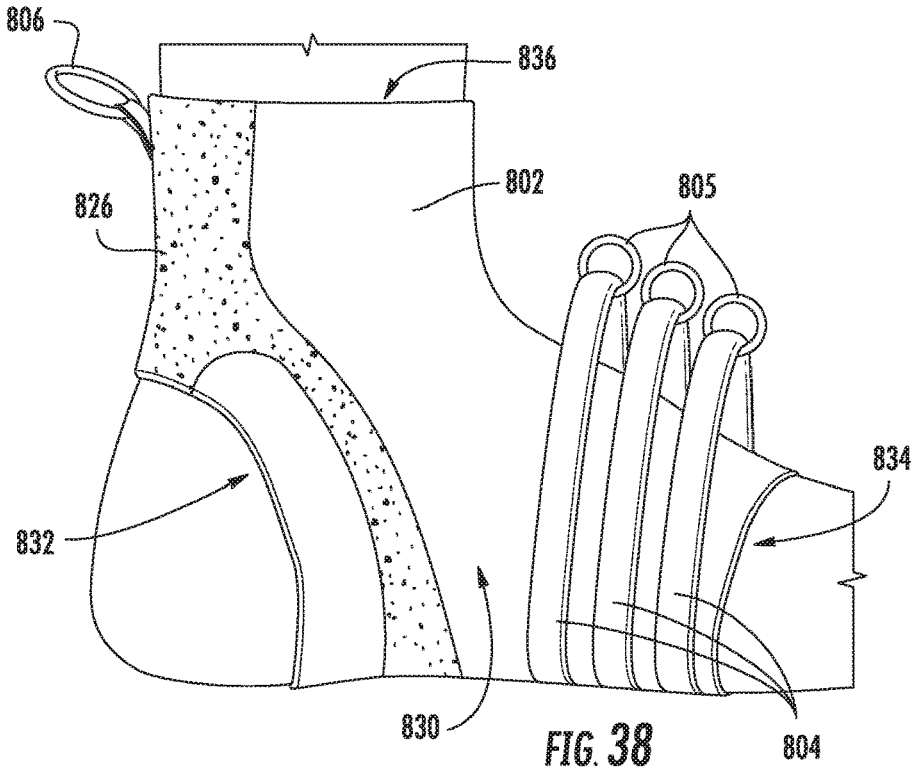
FIG. 38 is a side view of an alternative embodiment of the sock of FIG. 36.

With reference now to FIGS. 36 and 37, in at least one embodiment, the article of footwear for the physical training system is provided as an ankle sock 800 including a fabric panel 802, a first strap 804, a second strap 806, and a connection ring 808. In the embodiment of FIGS. 36 and 37, the fabric panel 802 forms a foot-receiving cavity and is configured to cover a substantial portion of the foot without covering the toes of the wearer. The fabric panel 802 includes a dorsal side 810, a plantar side 812, a lateral side 814, and a medial side 816. The fabric panel 802 further includes a midfoot region 818, a heel region 820, an Achilles region 821, and an ankle region 822. The fabric panel 802 may be comprised of any of various materials such as cotton, polyester, neoprene, elastane, and nylon, or combinations thereof. In various embodiments, the fabric panel 802 may be provided by a single panel or by a plurality of smaller panels that connected together to form the foot-receiving cavity. Various openings may be defined by the fabric panel 802, such as the toe opening and ankle opening shown in FIG. 36. In other embodiments, the fabric panel may include fewer openings (e.g., no toe opening) or additional openings (e.g., a heel opening as shown in FIG. 38).

The first strap 804 is a dorsal strap that is connected to the fabric panel 802 and extends over the dorsal side 810 of the sock 800 from the lateral side 814 to the medial side 816 of the sock. The first strap 804 has sufficient slack so as to be loosely spaced above said dorsal side 810. For example, in the embodiment of FIGS. 36 and 37, the first strap 804 has sufficient slack such that the first strap may extend between one to four inches above a longitudinal center line of the user's foot. However, in other embodiments, the strap may have sufficient slack to extend other lengths above the longitudinal center line of the user's foot.

The ends of the first strap 804 are connected to the fabric panel 802 by stitching, fusing, welding, adhesives, or any of various other means. The ends of the first strap may also be reinforced on the fabric panel 802 by a mounting member in the form of a mounting pad 824. In the embodiment of FIG. 36, the mounting pad 824 extends across the plantar side 812 of the sock 800 from the lateral side 814 to the medial side 816 of the sock. The mounting pad 824 may be comprised of any of various materials capable of reinforcing the first strap 804 to keep in place on the fabric panel 802. Examples of such materials include thermoplastic polymers, textiles, or any of various other materials. In at least one embodiment, mounting pad 824 is comprised of a vulcanized rubber or a thermoplastic material that is connected to the fabric panel 802 by fusing, melting, or otherwise heating and subsequently curing the material of the mounting pad 824. In at least one alternative embodiment, the mounting pad 824 is comprised of a durable nylon or other textile, that is stitched, adhered, or otherwise connected to the fabric panel 802. When the mounting pad 824 is connected to the fabric panel 802, the ends of the first strap 804 are positioned between the mounting pad 824 and the fabric panel 802 such that the first strap 804, fabric panel 802 and mounting pad 824 are all connected. Advantageously, when the first strap 804 is pulled in a direction away from the sock 800, the mounting pad 824 distributes the force of the pull is distributed across the entire mounting pad 824 and the user perceives the force to pull upward from the sole of his or her feet.

In at least one embodiment, a connection ring is disposed about and freely moveable along the at least one first strap 804. This arrangement is similar to the connection rings 565 shown in FIG. 26. However, in at least one alternative embodiment, the first strap 804 is void of any connection ring. In this embodiment, the elastic resistance bands (e.g., bands 513 of FIG. 23A) may include carabiner clips or other mechanisms configured to attach the bands to the first strap 804.

In at least one embodiment, the first strap 804 is not included on the fabric panel 802. In this embodiment, elastic resistance bands may be connected to the dorsal side of the foot via the shoe laces of the user. For example, the elastic resistance bands may include a carabiner clip on one end that allows the user to clip the band directly onto his or her shoe laces. Alternatively, other means may be used to connect the elastic resistance bands to the user's foot, such as threading one or more rings on to the laces of the user's shoe with one or more bands then connected to the rings on the shoe laces. In this embodiment where an elastic resistance band is coupled to the shoe laces, it may still be advantageous for the user to use the sock 800 with the second strap 806 in the Achilles region of the sock 800. With this configuration, a first elastic resistance band 513 may be connected to the shoe laces of the wearer on a dorsal side of the user's foot, and a second elastic resistance band 513 may be connected to the second strap 806 on the sock 800, thus providing a balanced arrangement with elastic resistance bands that extend from the anterior and posterior sides of the user's foot.

The second strap 806 is an Achilles strap that is connected to the fabric panel 802 in the Achilles region 821 of the sock 800. The second strap 806 forms a loop and the connection ring 808 is secured within the loop. The second strap 806 is connected to a reinforcement strip 826 that extends down from the Achilles region of the fabric panel and the heel region 820. In the embodiment of FIG. 36, the reinforcement strip 826 is of similar size as the strap 806 and extends across the closed heel of the sock 800 and all the way to the mounting pad 824. Accordingly, the reinforcement strip 826 provides further support for the second strap 806, and a force pulling on the second strap 806 is perceived by the user as a force pulling upward at least partly from the heel and sole of his or her feet.

In the embodiment of FIGS. 36 and 37, the connection ring 808 is disposed about the second strap 806. This arrangement is similar to the connection rings 565 shown in FIG. 27. However, in at least one alternative embodiment, the second strap 806 may be void of any connection ring. In this embodiment, the elastic resistance bands (e.g., bands 651 of FIG. 34) may include carabiner clips or other mechanisms configured to attach the bands to the first strap 804.

Ankle Brace Embodiment

With reference now to FIG. 38, an alternative embodiment of the sock of FIGS. 36 and 37 is shown. In the embodiment of FIG. 38, the sock 800 is provided as an ankle brace 830. The material for the ankle brace comprised of a relatively light elastic material such as elastane, a heavier foam-like material such as neoprene, or any of various other flexible materials as will be recognized by those of skill in the art. The embodiment of FIG. 38 is similar to that of FIGS. 36 and 37, but the ankle brace includes a heel opening 832 in addition to the toe 834 and leg opening 836. The ankle brace 830 includes three dorsal straps 804 extending over the dorsal side of the ankle brace. The dorsal straps 804 may be connected to a mounting pad on the plantar side of the ankle brace or may extend completely around the plantar side of the ankle brace. Each of the dorsal straps 804 includes an associated connection ring 805. The ankle brace 830 also includes an Achilles strap 806. In this embodiment, the reinforcement strip 826 extends down the Achilles region of the ankle brace to the heel opening 832, along the lateral and medial sides of the heel opening 832, and under the plantar side of the ankle brace 830 between the heel region and the midfoot region of the ankle brace. The reinforcement strip 826 in this embodiment may be comprised of a different material than the second strap 806. For example, the reinforcement strip 826 may be comprised of a vulcanized rubber or a thermoplastic polymer, thus adding additional support for forces pulling on the Achilles strap 806.

Figure 39:
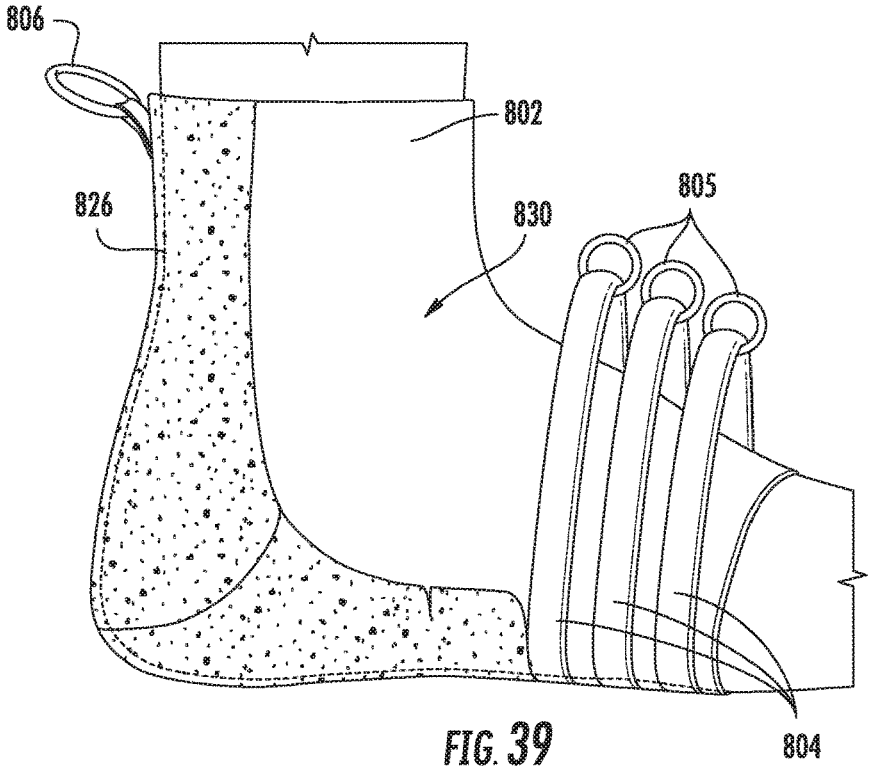
FIG. 39 is a side view of another alternative embodiment of the sock of FIG. 36

FIG. 39 shows yet another alternative embodiment of the sock of FIGS. 36 and 37. In the embodiment of FIG. 39, the sock is again provided as an ankle brace 830, similar to the arrangement of FIG. 38. However, the ankle brace 830 of FIG. 39 does not include a heel opening. Accordingly, in this embodiment, the reinforcement strip 826 extends across the heel region of the ankle brace and toward the midfoot region on the plantar side of the ankle brace. Also in this embodiment, the reinforcement strip 826 is significantly wider than the Achilles strap 806, and further distributes forces pulling on the Achilles strip toward the lateral and medial sides of the ankle brace 830.

Figure 40:
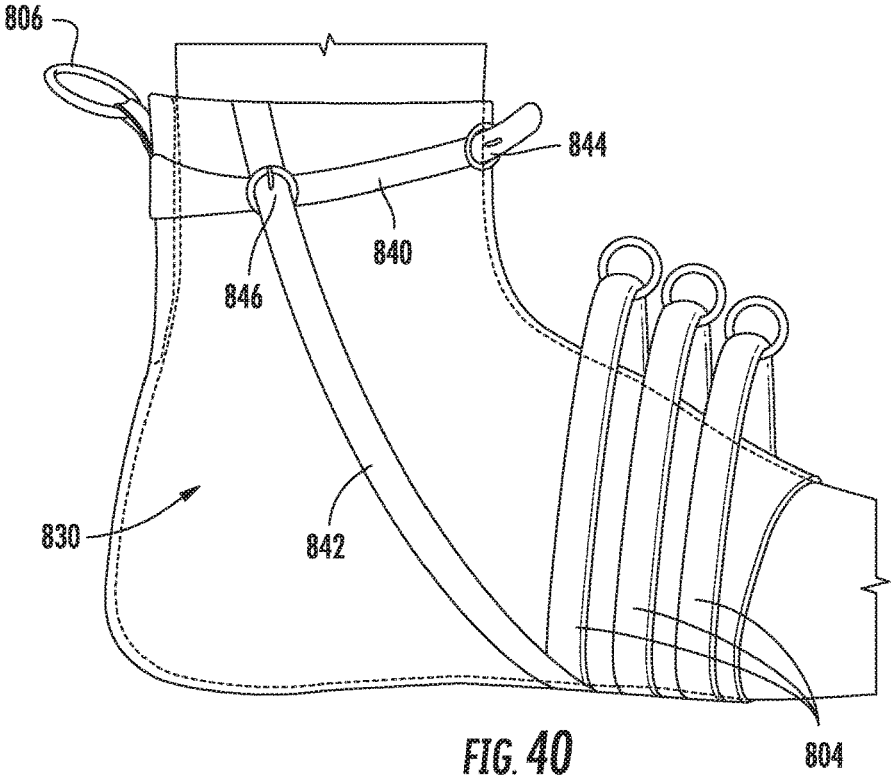
FIG. 40 is a side view of yet another alternative embodiment of the sock of FIG. 36.

FIG. 40 shows yet another alternative embodiment of the sock of FIGS. 36 and 37. In the embodiment of FIG. 39, the sock is again provided as an ankle brace 830, similar to the arrangement of FIGS. 38 and 39. However, in the embodiment of FIG. 40, the ankle brace 830 includes an ankle reinforcement strip 840 extending around the ankle portion of the sock, and a connecting reinforcement strip 842 extending between the ankle reinforcement strip 840 and one of the dorsal straps. The ankle reinforcement strip 840 extends completely around the ankle portion of the ankle brace 830, and may include a buckle or other adjustment mechanism at a front location (such as location 844) that allows the user to adjust the tightness of the ankle reinforcement strip 840. The connecting reinforcement strip 842 provides a bridge between the ankle reinforcement strip 840 and one of the dorsal straps 804, and is connected to the ankle reinforcement strap 840 at a medial side location (such as location 846). Another adjustment mechanism such as a buckle may also be provided at this location 846 where the connecting reinforcement strip 842 is joined to the ankle reinforcement strip 840. In the embodiment of FIG. 40, the connecting reinforcement strip 842 extends from the medial side location 846 and connects to the dorsal strap 804 on the plantar side of the ankle brace 830. Another connecting reinforcement strip may also be provided that connects the ankle strap 840 to the dorsal strap 804 at a lateral side location (not shown). While adjustment mechanisms have been disclosed at locations 844 and 846 in the embodiment of FIG. 40, in other embodiments, the connecting reinforcement strip 842 and ankle reinforcement strip 840 may be fixedly joined without any adjustment mechanism. The arrangement of FIG. 40 provides additional support for the wearer and further distribution of forces pulling on the Achilles strap 806.

Figure 41:
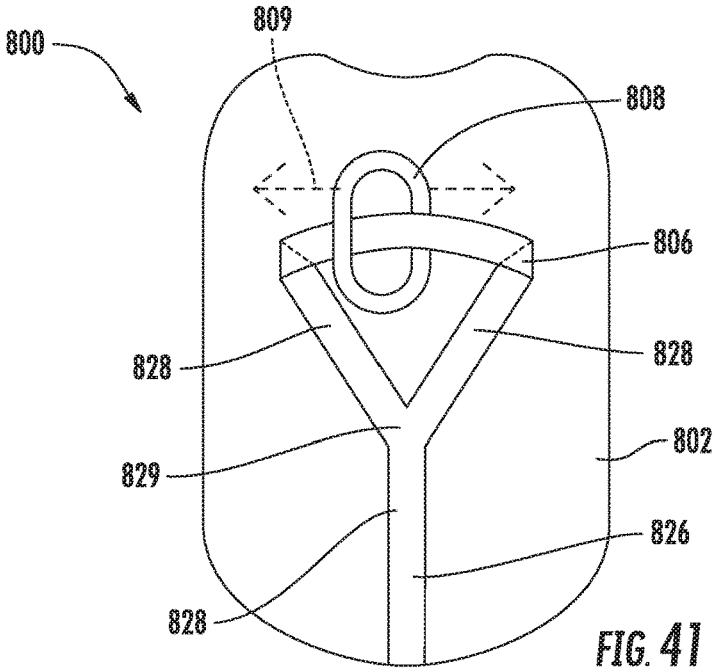
FIG. 41 is a rear view of an alternative embodiment of the Achilles strap for the sock of FIG. 36.

With reference now to FIG. 41, a rear view of the sock is shown illustrating one embodiment of the arrangement for the second strap 806 and an associated ring 808 in the Achilles region of the sock 800. In this embodiment, the strap 806 extends horizontally across the Achilles region of the sock 800 with the ends of the strap 806 connected to the fabric panel 802 and the center of the strap loosely spaced away from the Achilles region with a sufficient amount of slack in the strap such that the center of the strap is separated from the fabric panel by about an inch or less. The ring 808 is disposed about and freely moveable between the ends of the strap 806 as noted by arrow 809. A reinforcement strip 826 is provided in the Achilles region. The reinforcement strip 826 includes three legs 828 connected at an intersection 829. Two of the legs form a V-shaped portion with the leg ends of the V-shaped portion extending upward from the intersection 829 and connecting to the ends of the strap 806. Another leg extends downward from the intersection to the plantar side of the sock 800. For example, this leg may extend to the first strap 804 or the mounting pad on the plantar side of the sock 800.

Sock for Ice Skate Embodiment

Figure 42:
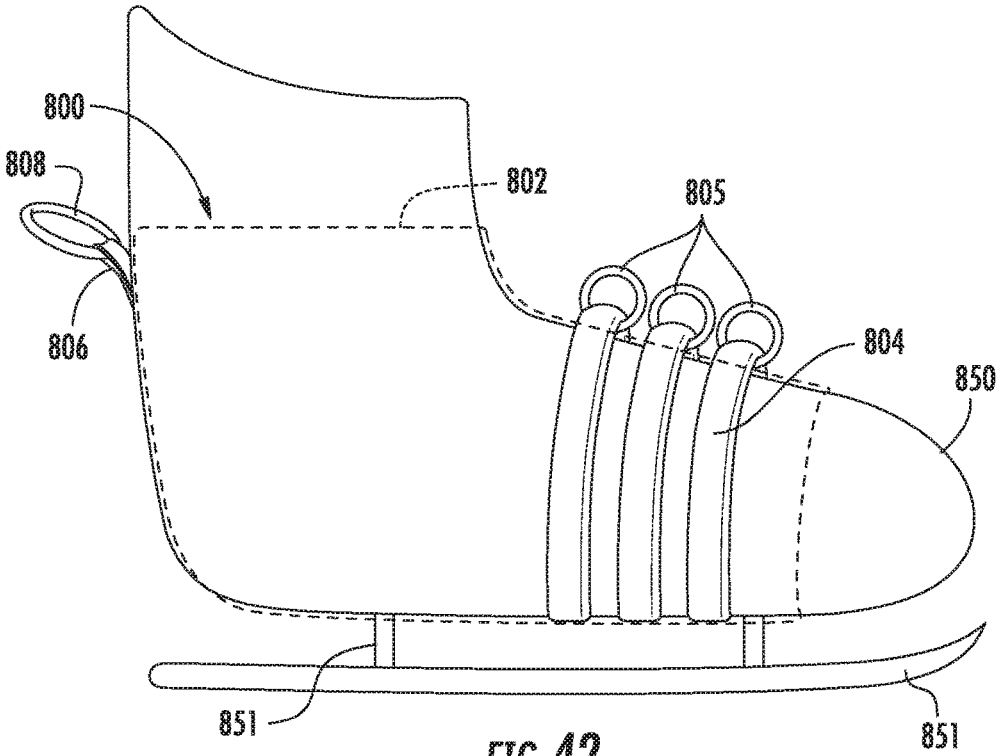
FIG. 42 is a side view of an alternative embodiment of the sock of FIG. 36 configured for use with an ice skate.

With reference now to FIG. 42, in at least one embodiment, the sock 800 is provided as a spat that is configured to fit loosely over a foot and closely engage a specialty boot or other shoe, such as an ice skate 850. In the embodiment of FIG. 42, the fabric panel 802 (illustrated in dotted lines) is comprised of an elastic material, such as elastane, that is capable of stretching over the boot portion of the ice skate 850, similar to the embodiment of FIG. 29. Instead of a mesh plantar side, the plantar side of the sock 800 in the embodiment of FIG. 42 includes a slit that allows the blade 851 and stems 852 of the ice skate 850 to be inserted there through. With the sock 800 positioned over the boot of the skate 850, the user may connect elastic resistance bands to the rings 805 associated with the dorsal straps 804 and the ring 808 associated with the Achilles strap 806. In this manner, the user may utilize the physical training system in association with the shoes and other equipment associated with the sport for which the user is training.

Figure 43:
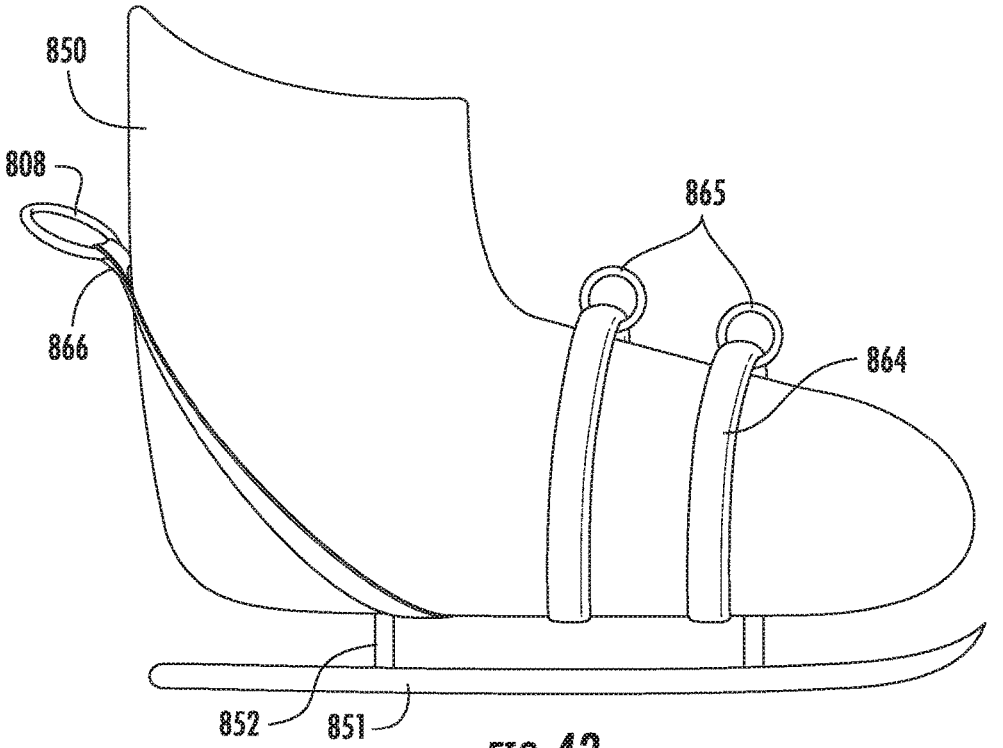
FIG. 43 is a side view of an alternative embodiment of dorsal straps and an Achilles strap configured for use with an ice skate.

With reference now to FIG. 43, in at least one embodiment, the article of footwear for the physical training system may be provided without the use of a shoe or a sock. In the embodiment of FIG. 43, fabric panels for the flexible article footwear are provided by dorsal straps 864 and an Achilles strap 866 which loop around the boot portion of the skate. These straps 864 and 866 are separate from each other and are not interconnected by an underlying fabric panel that extends over the boot as in the embodiment of FIG. 42. The straps 864 and 866 may be provided by strips of nylon, rubber, a thermoplastic polymer or other relatively durable material that wrap around the boot of the skate 850 in the manner shown in FIG. 43. Each strap 864 and 866 includes a fastening mechanism such as a buckle, a hook and loop fastener such as Velcro, or any other appropriate fastening mechanism. Rings 865 and 868 may be associated with each of the straps 864 and 866. Advantageously, the rear stem 852 of the skate 850 is used to secure the Achilles strap 866 on the skate and prevent the Achilles strap 866 from slipping over the heel when the Achilles strap 866 is connected to a band.

Releasable Strap or Ring Embodiments

Figure 44:
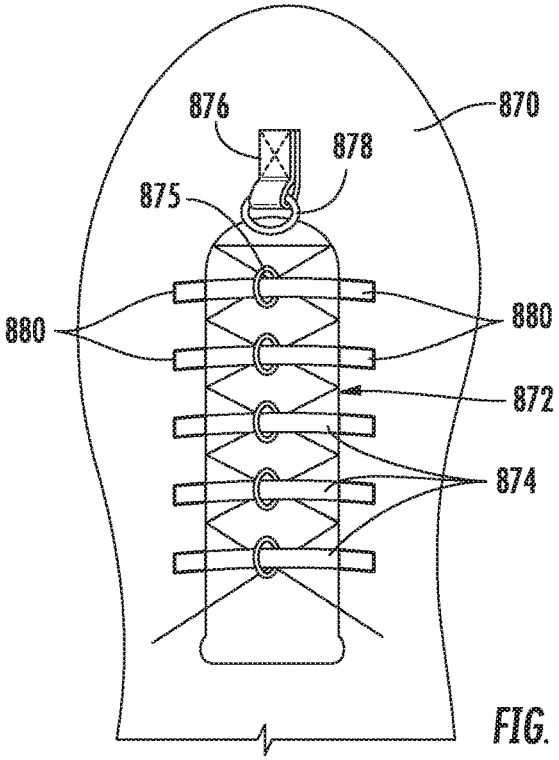
FIG. 44 is a dorsal plan view of an article of footwear configured with releasable straps for use with the sports performance enhancement system of FIG. 17.

With reference now to FIG. 44, in at least one embodiment, the straps are configured to clip-on to a conventional shoe 870. In this embodiment, the straps include dorsal straps 874 and Achilles strap (not shown) configured to be releasably attached to the shoe 870. The dorsal straps 874 include a clip member 880 on the end of each strap 874. The clip members 880 are configured to clamp on to the perimeter of a tongue opening 872 of the shoe 870 with the dorsal strap 874 extending across the tongue opening 872. The clip members 880 may be any of various types of clips, such as alligator clips or other clips configured to clamp on to the perimeter of the tongue opening 872 of the shoe 870 and hold the strap 874 firmly in place on the shoe. Connection rings 875 may be disposed upon and freely moveable with respect to the straps 874. The Achilles strap includes a similar clip member configured to clamp on to the perimeter of the foot opening of the shoe in an Achilles region, thus providing an Achilles strap for the shoe 870. In at least one embodiment, the shoe 870 may further include a toe strap 876 and an associated connection ring 878. The toe strap 876 may be fixedly connected to the shoe or releasably connected to the shoe 870 in a toe region of the shoe, near the distal perimeter of the tongue opening 872.

Figure 45:
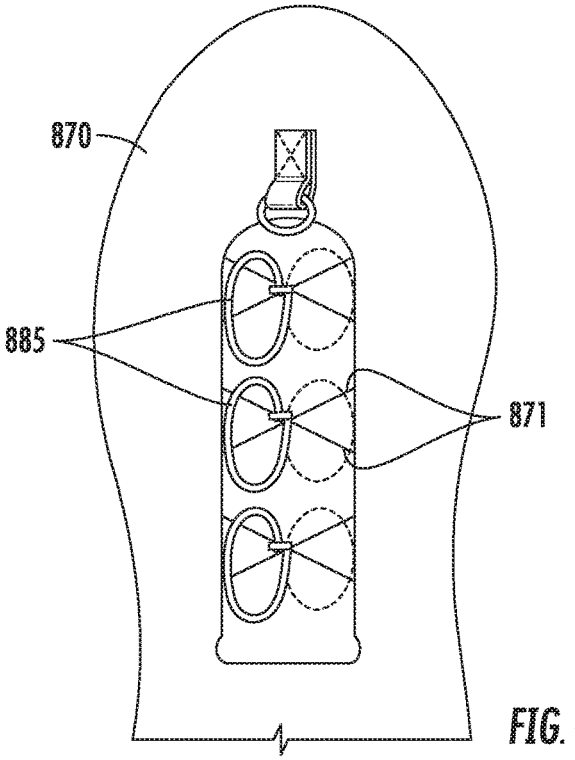
FIG. 45 is a dorsal plan view of an article of footwear configured with releasable connection rings for use with the sports performance enhancement system of FIG. 17.

With reference now to FIG. 45, in at least one alternative embodiment, the physical training system includes connection rings 885 that are configured to be coupled to the laces 871 of a user's shoe 870 without the need for a sock. In this embodiment, the connection rings 885 may be uninterrupted rings and the laces 871 may be threaded through the rings to secure the connection rings 885 to the shoe 870. The connection rings 885 are freely pivotable and slideable along the laces 871 when bands are connected to the connection rings 885 during use of the physical training system (pivoting of the connection rings 885 is illustrated by the dotted lines in FIG. 45). In at least one embodiment, the connection rings 885 may be provided by carabiner clips in lieu of uninterrupted rings, thus allowing the connection rings 885 to be inserted onto the shoe laces 871 without the need to unlace the shoe 870.

Figure 46:
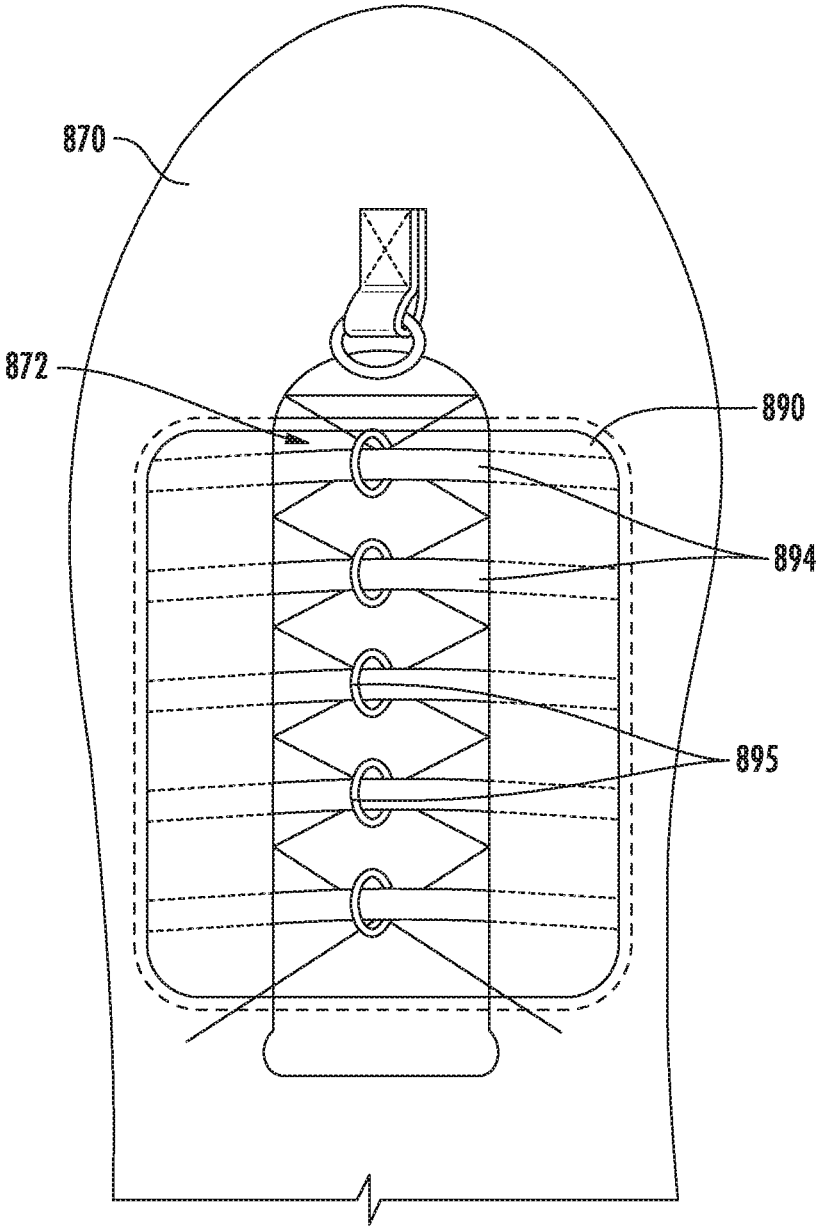
FIG. 46 is a dorsal plan view of an article of footwear including a tongue opening configured for use with the sports performance enhancement system of FIG. 17.

With reference now to FIG. 46, in at least one alternative embodiment, the physical training system includes an insert 890 configured for insertion on the dorsal side of a conventional shoe 870 in the tongue opening 872. The insert 890 includes one or more clamshell-like clips configured to clamp to opposing sides of the tongue opening 872 with the tongue of the shoe 870 positioned under the insert 890. The insert 890 further includes a plurality of dorsal straps 894 fixed thereto and extending across a dorsal side of the insert 890. Connection rings 895 are disposed about and freely moveable along the straps 894 when bands are connected to the connection rings 895 during use of the physical training system.

Side Connection Ring Embodiment

While the connection rings have been described in various embodiments above as being positioned in a central location on the dorsal side of the foot, it will be recognized that in alternative embodiments the connection rings may be positioned in other locations. For example, with reference now to FIG. 51, in at least one alternative embodiment connection rings 1010 are included on the sides of the shoes or other articles of footwear in one or more locations, thus providing additional options for attaching the resistance bands to the shoes in different configuration, depending on which muscles are being worked or which movements are part of the exercise regimen.

Figure 51:
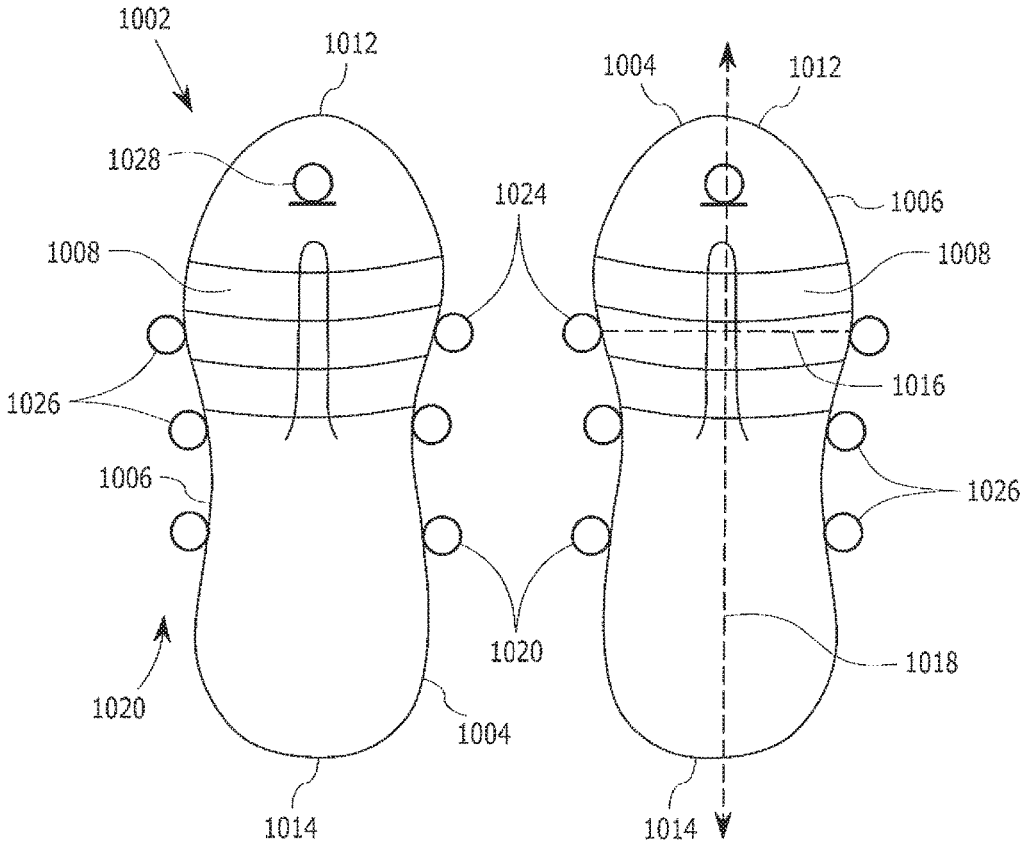
FIG. 51 is a plan view of a pair of shoes including connection rings mounted at the medial and lateral sides of the pair of shoes.

As shown in FIG. 51, a plurality of connection rings 1020 may be provided on both sides of the shoes 1002. Each of the shoes 1002 is configured to receive a foot of the human body and includes a medial side 1004, a lateral side 1006, a dorsal side 1008 a sole side 1010 (not shown in FIG. 51; see FIGS. 52A-C), a toe end 1012 and a heel end 1014. The shoes 1020 may be any athletic-type shoes appropriate for the desired conditioning activity. While shoes 1002 are disclosed as the article of footwear in the embodiment of FIG. 51, it will be recognized that in other embodiments, the article of footwear may be configured other than a shoe, such as a spat.

With continued reference to FIG. 51, the connection rings 1020 on the shoe 1002 include a plurality of medial connection rings 1024 and a plurality of lateral connection rings 1026. The medial connection rings 1024 are disposed on the medial side 1004 of each shoe 1002 directly opposite the lateral connection rings 1024 on the lateral side 1006 of the shoe. The dorsal side 1008 of the article of footwear extends between the medial connection rings 1022 and the lateral connection rings 1024. In the disclosed embodiment, the medial connection rings 1022 and the lateral connection rings 1024 are directly opposite from one another on the shoe such that a line 1016 between two opposing connection rings is substantially perpendicular (e.g., between 70° and 110°) to a centerline 1018 of the shoe 1002. Also in the disclosed embodiment, the connection rings 1020 include three medial connection rings 1024 and three lateral connection rings 1026, which are evenly spaced apart along the sides of the shoe 1002, allowing a user to connect an elastic resistance band to any pair of connection rings (i.e., any two opposing rings on opposite sides of the shoe), depending on the exercise to be performed or muscle group to be worked.

The connection rings 1020 may be connected to each shoe 1002 in any of various ways such as stitching, clamps, adhesives, welding or any of various other connection means. In at least one embodiment, the connection rings 1020 may be coupled to each shoe 1002 using straps. One or more straps may be used to couple pairs of the connection rings to the medial and lateral sides of the shoe. The straps may be configured in any of various manners. For example, in at least one embodiment, the straps are similar to the straps shown in FIG. 9, 21, 22 or 32 (as shown by reference numerals 63, 502 and 522), but do not extend completely across the dorsal side 1008 of the shoe 1002. Instead, each strap includes a portion providing a loop or other enclosure on the side of the shoe 1002 with a connection ring retained by the strap.

Figure 52A:
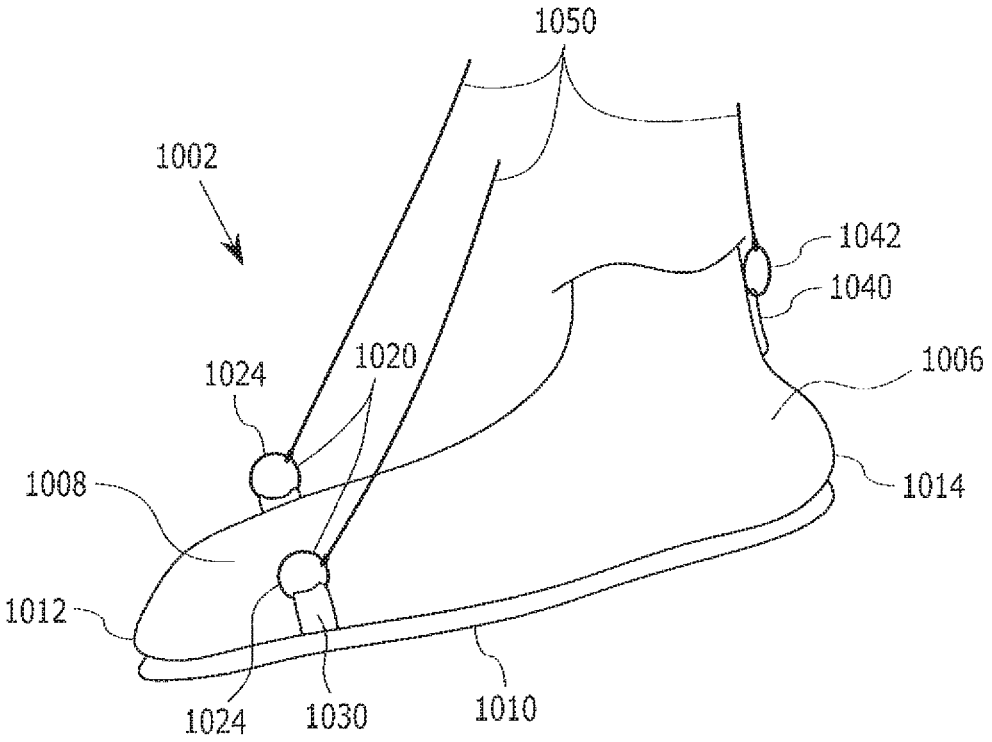
FIG. 52A is a lateral perspective view of a shoe with a medial connection ring and a lateral connection ring with resistance bands coupled thereto.
Figure 52B:
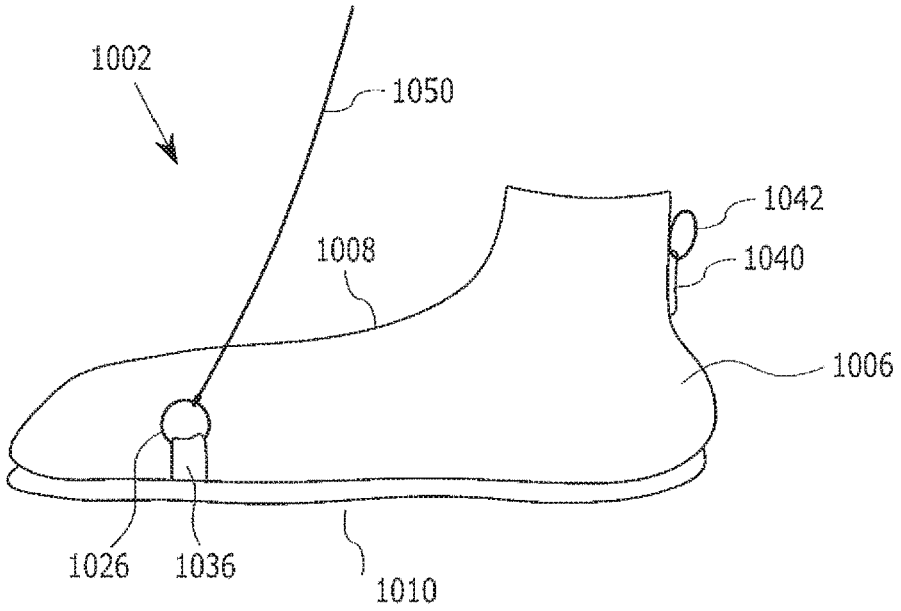
FIG. 52B is a lateral side view of the shoe of FIG. 52A.
Figure 52C:
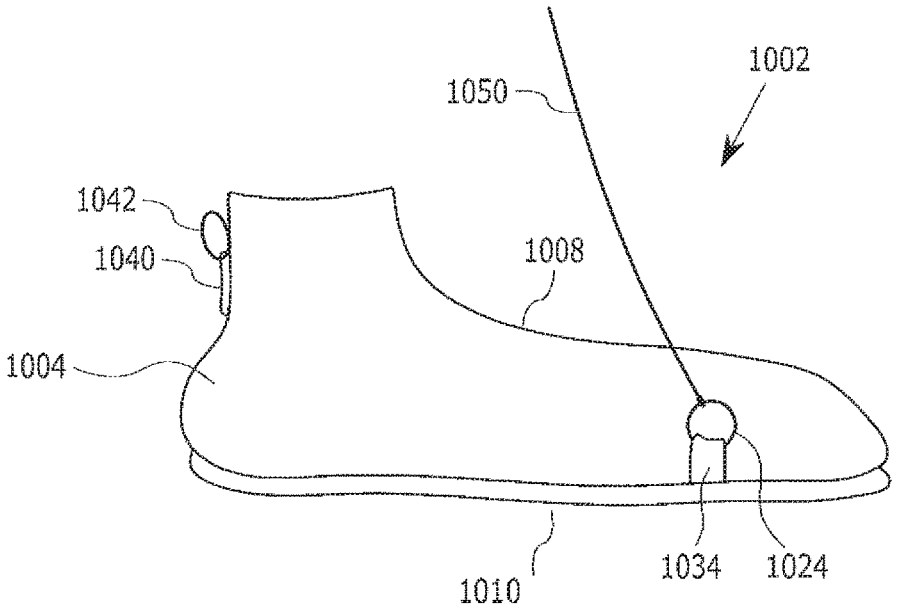
FIG. 52C is a medial side view of the shoe of FIG. 52A.

Referring now to FIGS. 52A-52C, an exemplary embodiment of a strap arrangement for the shoe 1002 is illustrated. The strap arrangement includes one or more straps 1030 provided on the shoe 1002, with the straps 1030 providing a medial strap portion 1034 and a lateral strap portion 1036 configured to retain the connection rings 1024 and 1026. Any of various means may be used to connect the straps 1030 to the connection rings 1024 and 1026, including a loop in the strap, stitching, adhesives, welding, or other means for connecting the connection rings to the strap. The straps 1030 may be coupled to the upper portion of the shoe 1002 in any of various configurations, including those configurations previously discussed herein.

In the embodiment of FIGS. 52A-52C, a first end of the straps 1030 provides the medial strap portion 1034 in the form of a loop or other enclosure configured to retain the medial connection ring 1024. A second end of the straps 1030 provides the lateral strap portion 1036 in the form of a loop or other enclosure configured to retain the lateral connection ring 1026. The straps 1030 are essentially parallel to and spaced rearwardly from one another along said shoe body. The straps 1030 are made of a strong material such as ballistic nylon or similar material and have sufficient slack so as to be loosely spaced above the shoe upper. A corresponding plurality of connection rings 1020 is disposed about the straps 1030. Each strap portion 1034, 1036 is configured and constructed to be connected, via the associated connection ring 1020, to an elastic resistance band 1050 such that, when the connected ring 1020 is pulled by a force applied through the elastic resistance band, the ring is free both traverse the strap portion 1034, 1036 and pull the associated strap 1030 in the direction of band 1050.

In the illustrated embodiment of FIGS. 52A-C, the straps 1030 associated with opposing connection rings (e.g., rings 1024 and 1026) may be provided as two separate straps with one strap coupled to the medial side 1004 of the shoe and providing the medial strap portion 1034, and another strap coupled to the lateral side 1006 of the shoe 1002 and providing the lateral strap portion 1036. Stitching or other appropriate connecting means may be utilized in order to connect the straps 1030 to the shoe upper. As discussed previously, the stitching of the straps 1030 at the connections is advantageously of the Box X type which is known to have particular strength, but other strong stitching may be utilized. In at least one alternative embodiment, the straps 1030 are provided as a single span of material that extends under or across the foot of the user on the sole side 1010 of the shoe 1002, the single span of material terminating at one end in the medial strap portion 1034 and at the opposite end in the lateral strap portion 1036.

Another feature of note in the shoes 1002 of FIG. 51 is the provision of multiple connection rings 1020 (and associated straps 1030) at different locations lengthwise of the shoe and the user's foot, thereby providing the user with options as to which strap and ring to use for a particular exercise. In this regard, at least the forwardmost strap is located forward of the arch portion of the shoe sole and the user's foot, approximately at the balls of the user's foot. Resistance band tension applied at this location is ideal for training for straight ahead running and similar activities. The rearwardmost strap is located slightly forward of the shoe opening corresponding to a location above the rearward part of the user's instep. Resistance band tension applied at this location is ideal for training for lateral movement and sudden directional changes. Two or more additional straps are located over the instep intermediate the forward and rearward straps and can be selected for combined training and/or user comfort at various exercise sessions.

Figure 53:
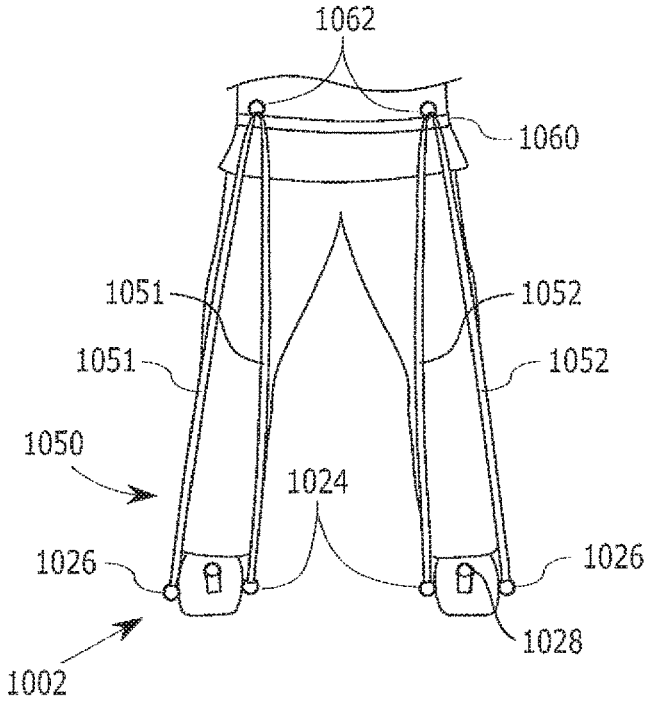
FIG. 53 is a front view of the lower body of a user of the sports performance enhancement system with a single resistance band extending between a belt and a right shoe and a single resistance band extending between the belt and a left shoe.

In various embodiments, the connection rings 1020 and straps 1030 on the medial side 1004 and the lateral side 1006 of the shoe 1002 may be used in association with any of various other connection ring and strap arrangements, including those arrangements described herein. For example, as shown in FIGS. 52A-C, a heel strap 1040 (or Achilles strap) and connection ring 1042 may be included on the shoe 1002. Alternatively, as shown in FIG. 53, medial and lateral connection rings 1024 and 1026 may be used in association with a shoe 1002 having one or more center connection rings 1028 on the dorsal side 1008 of the shoe 1002. Similarly, FIG. 54 shows an embodiment wherein medial and lateral connection rings 1024 and 1026 may be used in association with a shoe 1002 having a plurality central connection rings 1028 coupled to the shoe 1002 with straps 1030 that extending completely across the dorsal side of the shoe 1002 (similar to the embodiments shown in FIGS. 9, 21, 22 and 32 and the associated strap and connection ring arrangements).

Figure 54:
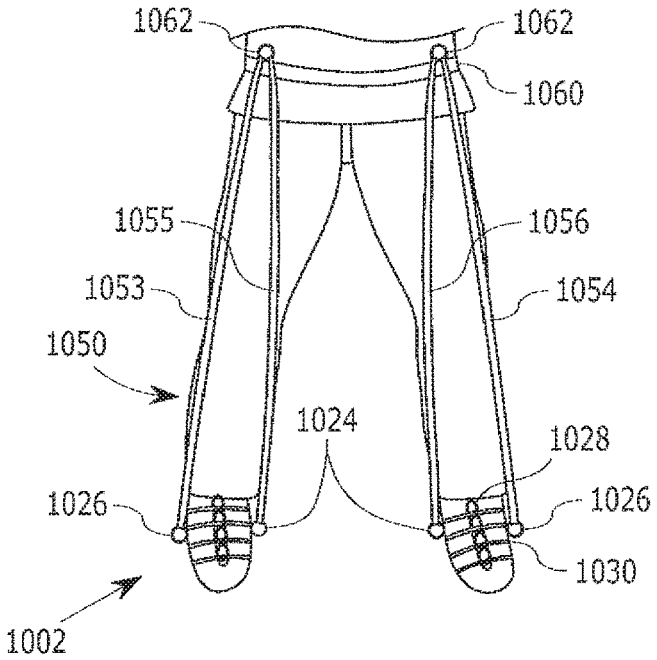
FIG. 54 is a front view of the lower body of the user of the sports performance enhancement system with two resistance bands extending between the belt and the right shoe and two resistance bands extending between the belt and the left shoe.

FIGS. 53 and 54 also illustrate various resistance band arrangements that may be used with the shoe 1002 and another device, such as an associated torso member. The torso member in each of the embodiments of FIGS. 53 and 54 is provided in the form of a belt 1060. In the embodiment of FIG. 53, a single resistance band is associated with each of the user's right leg and left leg. In particular, a right resistance band 1051 extends from the lateral connection ring 1026 on the shoe 1002 of user's right foot, through one of the rings 1062 on the belt 1060, and back to the medial connection ring 1024 on the shoe on the user's right foot. Similarly, a left resistance band 1052 extends from the lateral connection ring 1026 on the shoe 1002 of user's left foot, through one of the rings 1062 on the belt 1060, and back to the medial connection ring 1024 on the shoe on the user's left foot.

In contrast to the arrangement of FIG. 53, in the arrangement of FIG. 54, the resistance bands 1050 are configured such that multiple connection bands are associated with the user's left leg and right leg. In particular, in the embodiment of FIG. 54, a first resistance band 1053 and a second resistance band 1055 both extend from a single connection band 1062 on the right side of the belt 1060. In particular, the first resistance band 1053 extends from the belt 1060 to the lateral connection ring 1026 on the user's right foot, and a second resistance band 1055 extends from the belt 1060 to the medial connection ring 1024 on the user's right foot. Similarly, a third resistance band 1054 and a fourth resistance band 1056 both extend from a single connection band 1062 on the left side of the belt 1060. In particular, the third resistance band 1054 extends from the belt 1060 to the lateral connection ring 1026 on the user's left foot, and a fourth resistance band 1056 extends from the belt 1060 to the medial connection ring 1024 on the user's left foot.

Adaptable Connection Points and Alternative Embodiments

The system includes the capability for attaching each and every component in the system (i.e., the gloves, hand straps, shoes, over-the shoe-sock with mesh bottom, foot bed insert, ankle brace, etc.) to any connection point on any of the components of the system, as the user sees fit. The connections are by means of the resistance bands, and each connection can be effected by one or more resistance bands. If a user wants to connect the gloves with the belt via resistance bands, and bypass the vest, the user can do so. Thus, one of the unique advantages of the system is that it is customizable. If the user wants to connect the gloves to the shoes via resistance bands, the user can do so; if the user wants to connect only one glove with one shoe, the user can do so. If the user wants to connect just one shoe, over-the-shoe with mesh bottom, ankle brace with straps, or foot bed insert with straps to just the belt, perhaps in a rehabilitation setting, the user can do so.

The system as described and illustrated may be used with both vest and its attachments to the limbs and extremities of the user, or with the vest and its attachments alone, or with the belt and its attachments alone. How the system is used will depend on the exercise regimen desired by the user.

With regard to the fasteners that are used in the system, when the band and or bands form a V-shape in the center connection point on the belt (as shown in FIG. 34), the bands may supply equal resistance to each foot. Plastic fasteners or other means, including direct attachment of the ring to the belt, may be used in this way to provide equal resistance to each foot. When the user places the resistance band and or bands through the center connection point on the belt, the user will measure each end of the band so that one end is not extended further than the other end of the band and or bands as they lay centered on the middle connection point of the belt during set up. At this point the bands are not engaged or connected to the lower connection points in the shoe or ankle brace, etc. In at least one embodiment, it is recommended to make sure the band and or bands are equal when suspended vertically from the center belt connection point. The bands are secured so that once they become engaged and connected to any of the lower connection point options, they will not shift unevenly; thus, during the entire time of usage each foot will experience equal resistance. These fasteners can be used for the front or rear bands on the belt and can be made of plastic, metal, any sort of fabric, etc.

In at least one embodiment, the articles of footwear, including shoes, shoe inserts, socks, ankle brace, etc. can be provided with the capability of having affixed resistance bands permanently attached to them, and the belt likewise may be constructed to accommodate this permanent attachment. Likewise, the vest may have one or more connection points placed in the best and most suitable positions for optimal performance.

It is to be understood that particular ring configurations (e.g., O-rings, D-rings, triangle rings, etc.) are described and illustrated herein to accomplish various functions pertaining to engagement of straps and bands. It is to be understood that such configurations are not to be construed on limiting in the sense that any type of ring, as well as any type of ring attachment means, that performs the stated function may be utilized as part of the sports performance enhancement system. Regarding ring attachment means, it is contemplated that in certain instances rings may be attached directly to a shoe or belt or pad without the need for a strap or other structure described and illustrated herein, and such direction is to be construed as residing in various embodiments of the sports performance enhancement system. Moreover, in various embodiments, different connection members may be used to connect the resistance bands to the various components worn on the body. For example, in various embodiments disclosed herein, the connection members include first connection rings provided on a belt and second connection rings secured to an article of footwear using various straps. In at least some alternative embodiments, the connection members may be the straps themselves without the use of additional connection rings. Also, while embodiments described herein have included resistance bands with end clips that may be connected to connection rings on various articles of apparel such as belts, articles of footwear, gloves, vests, etc., in at least some alternative embodiments, the resistance bands may include connection rings at the ends of the bands, and these connection rings at the ends of the bands may be coupled to clips positioned on the articles of apparel.

Having described several embodiments of new and improved sports performance enhancement system, it is believed that other modifications, variations and changes will be suggested to those skilled in the art in view of the teachings set forth herein. It is therefore to be understood that all such variations, modifications and changes are believed to fall within the scope of the present claims. Although specific terms are employed herein, they are used in a generic and descriptive sense only and not for purposes of limitation.

Thus, it is also to be understood that the sports performance enhancement system described herein covers any of several modifications and variations provided they come within the scope of the appended claims and their equivalents. For example, it is to be understood that terms such as "left", "right" "top", "bottom", "front", "rear", "side", "height", "length", "width", "upper", "lower", "interior", "exterior", "inner", "outer", "horizontal", "vertical", and the like as may be used herein, merely describe points of reference for various orientations of elements and do not limit the elements or any associated components to any particular orientation or configuration.

The foregoing detailed description of one or more exemplary embodiments of the sports performance enhancement system has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. A physical training system configured to be worn on a human body, the physical training system comprising:

an article of footwear formed from an elastic material and configured to receive a foot of the human body such that a substantial entirety of the foot is covered with the elastic material, the article of footwear including a lateral side, a medial side, a dorsal side, and a plantar side;

a medial strap portion connected to the elastic material on the medial side of the article of footwear and extending to the plantar side of the article of footwear;

a lateral strap portion connected to the elastic material on the lateral side of the article of footwear and extending to the plantar side of the article of footwear;

a first connection ring connected to the medial strap portion and disposed on the medial side of the article of footwear;

a second connection ring connected to the lateral strap portion and disposed on the lateral side of the article of footwear opposite the first connection ring;

a torso member configured to engage a torso of the human body; and at least one elastic resistance band extending between the first connection ring and the torso member and between the second connection ring and the torso member.

2. The physical training system of claim 1 wherein the first strap portion and the second strap portion are portions of one strap extending across the plantar side of the article of footwear.

3. The physical training system of claim 1 wherein the medial strap portion and the lateral strap portion are portions of two distinct straps on the article of footwear, wherein the first connection ring is disposed on a free end of the medial strap portion and the second connection ring is disposed on a free end of the lateral strap portion, wherein the free ends of the medial strap portion and the lateral strap portion are freely moveable relative to the elastic material that forms the article of footwear.

4. The physical training system of claim 1 wherein the at least one elastic resistance band includes a first elastic resistance band portion and a second elastic resistance band portion, the first elastic resistance band portion extending between the first connection ring and the torso member and the second elastic resistance band portion extending between the second connection ring and the torso member.

5. The physical training system of claim 1 wherein the at least one elastic resistance band is a single elastic resistance band extending from the first connection ring to the torso member and from the torso member to the second connection ring.

6. The physical training system of claim 1 wherein the article of footwear is a spat.

7. The physical training system of claim 1 wherein the first connection ring is one of a plurality of connection rings disposed on the medial side of the article of footwear, and wherein the second connection ring is one of a plurality of connection rings disposed on the lateral side of the article of footwear, the physical training system further comprising a third connection ring connected to a heel end of the article of footwear and at least one additional elastic resistance band extending between the third connection ring and the torso member.

8. The physical training system of claim 1 wherein the first connection ring is directly opposed to the second connection ring with a strap on a dorsal side of the article of footwear extending between the first connection ring and the second connection ring.

9. The physical training system of claim 1 wherein the torso member is a belt.

10. The physical training system of claim 1 wherein the medial strap portion is directly connected to the elastic material the medial side of the article of footwear and the lateral strap portion is directly connected to the elastic material on the lateral side of the article of footwear.

11. The physical training system of claim 1 wherein the medial strap portion and the lateral strap portion are portions of one strap extending across and loosely spaced from the dorsal side of the article of footwear.

12. An article of footwear for use in a resistance exercise system of the type in which one or more elastic resistance bands are attached between a user's torso and one or more limbs or extremities, the article of footwear comprising:

an elastic sock configured to receive and cover at least most of a foot of the user, the sock including a lateral side, a medial side, a dorsal side, and a plantar side, said dorsal side defining a center section;

at least one strap connected to the elastic sock, the at least one strap including a first portion and a second portion, the first portion connected to the elastic material and extending to the plantar side of the article of footwear, and the second portion free from the elastic sock with sufficient slack so as to be loosely spaced above the center section of the dorsal side of the sock; and at least one connection member coupled to the at least one strap;

wherein the strap and the connection member are configured and constructed to be coupled to an elastic resistance band such that when the connection member is pulled by a force applied via the elastic resistance band, the connection member pulls the strap in a direction of the force.

13. The article of footwear of claim 12 wherein the second portion of the at least one strap has sufficient slack to extend from the lateral side to the medial side of the article of footwear and remain loosely spaced above the center section of the dorsal side of the sock.

14. The article of footwear of claim 13 wherein the at least one connection member is freely moveable along the second portion of the at least one strap.

15. The article of footwear of claim 12 wherein the first portion of the at least one strap extends from the lateral side of the article of footwear, completely across the plantar side, and to the medial side of the article of footwear.

16. The article of footwear of claim 15 further comprising a mounting pad positioned on the plantar side of the sock, the at least one strap connected to the mounting pad.

17. The article of footwear of claim 12 wherein the sock is formed from a neoprene material.

18. The article of footwear of claim 12 wherein the connection member is a ring.

19. The article of footwear of claim 12 wherein at least one strap is connected to the sock by a stitch, a fuse, a weld or an adhesive.

* * * * *